US006864221B1

(12) United States Patent
Takana et al.

(10) Patent No.: US 6,864,221 B1
(45) **Date of Patent: *Mar. 8, 2005**

(54) GRANULES FOR CARRYING SURFACTANT AND METHOD FOR PRODUCING THE SAME

(75) Inventors: Shuji Takana, Wakayama (JP); Hitoshi Takaya, Wakayama (JP); Hiroki Yamaboshi, Wakayama (JP); Yoichi Sugiyama, Wakayama (JP); Hiroshi Kitagaito, Wakayama (JP); Shu Yamaguchi, Wakayama (JP); Hiroyuki Yamashita, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/762,948

(22) PCT Filed: Jun. 14, 2000

(86) PCT No.: PCT/JP00/03856

§ 371 (c)(1),
(2), (4) Date: Feb. 14, 2001

(87) PCT Pub. No.: WO00/77148

PCT Pub. Date: Dec. 21, 2000

(30) Foreign Application Priority Data

| | | |
|---|---|---|
| Jun. 14, 1999 | (JP) | 11-167139 |
| Apr. 4, 2000 | (JP) | 2000-102792 |
| Apr. 4, 2000 | (JP) | 2000-102793 |
| May 2, 2000 | (JP) | 2000-133283 |

(51) Int. Cl.[7] ..... C11D 11/00; C11D 11/02; C11D 17/06; C11D 3/37

(52) U.S. Cl. ..... 510/438; 510/220; 510/229; 510/276; 510/349; 510/441; 510/443; 510/452

(58) Field of Search ..... 510/443, 441, 510/452, 349, 438, 220, 229, 276

(56) References Cited

U.S. PATENT DOCUMENTS

| | | | | |
|---|---|---|---|---|
| 4,547,352 A | | 10/1985 | Ertle | |
| 4,818,424 A | | 4/1989 | Evans et al. | |
| 4,820,441 A | | 4/1989 | Evans et al. | |
| 4,861,503 A | * | 8/1989 | Hollingsworth et al. | 510/351 |
| 4,882,074 A | * | 11/1989 | Kenyon et al. | 510/327 |
| 4,900,466 A | * | 2/1990 | Atkinson et al. | 510/443 |
| 5,139,693 A | * | 8/1992 | Wilms et al. | 510/438 |
| 5,821,207 A | * | 10/1998 | Kanai et al. | 510/531 |
| 6,376,453 B1 | * | 4/2002 | Kubota et al. | 510/438 |

FOREIGN PATENT DOCUMENTS

| | | |
|---|---|---|
| AU | 76747/87 | 3/1988 |
| EP | A2221776 | 5/1987 |
| EP | A1266863 | 5/1988 |
| EP | A2289311 | 11/1988 |
| EP | A2289312 | 11/1988 |
| EP | A2421664 | 4/1991 |
| EP | 639638 | 2/1995 |
| GB | 2097419 | 11/1982 |
| JP | 45-30705 | 10/1970 |
| JP | 50-25603 | 3/1975 |
| JP | 53-13203 | 5/1978 |
| JP | 60-262898 A | 12/1985 |
| JP | 61-26698 A | 2/1986 |
| JP | 2255520 | 10/1990 |
| JP | 4145200 | 5/1992 |
| JP | 4146999 | 5/1992 |
| WO | WO 97/19165 A | 5/1997 |

* cited by examiner

*Primary Examiner*—Lorna M. Douyon
(74) *Attorney, Agent, or Firm*—Birch, Stewart, Kolasch & Birch, LLP

(57) ABSTRACT

The present invention relates to particles for supporting a surfactant and a process for preparing the same. Further, the present invention relates to high-density detergent particles using the particles for supporting a surfactant, and a process for preparing the same. According to the present invention, there can be obtained particles for supporting a surfactant which are excellent in the supporting ability (supporting capacity/supporting strength) for the liquid surfactant composition, and particles for supporting a surfactant which are excellent in the absorption properties (supporting rate) for the liquid surfactant composition, by spray-drying a preparation liquid obtainable by a process comprising the steps of preparing a first preparation liquid comprising a solution or slurry comprising a water-soluble polymer and a water-soluble salt; and subjecting the first preparation liquid to a treatment of increasing a number of water-soluble salt particles, thereby preparing a second preparation liquid having an increased number of water-soluble salt particles, as compared to the number of water-soluble salt particles which are present in the first preparation liquid. Further, since the liquid surfactant composition is supported by the particles for supporting a surfactant, detergent particles which are excellent in detergent performance, quality and the like can be efficiently obtained.

15 Claims, 2 Drawing Sheets

GRANULES FOR CARRYING SURFACTANT AND METHOD FOR PRODUCING THE SAME

TECHNICAL FIELD

The present invention relates to particles for supporting a surfactant, and a process for preparing the same. Further, the present invention relates to high-density detergent particles using the particles for supporting a surfactant, and a process for preparing the same.

BACKGROUND ART

One process for obtaining a powdery detergent includes a process comprising the step of supporting a liquid surfactant in particles for supporting a surfactant. In this process, a high supporting ability of the liquid surfactant is demanded for the particles for supporting a surfactant. In other words, there are two factors for the supporting ability demanded for the particles for supporting a surfactant: A large amount of a liquid surfactant can be retained (supporting capacity); and the liquid surfactant once absorbed can be strongly retained in the inner portion of the particle without being bleeded out (supporting strength). The supporting capacity is important from the viewpoint of formulating a surfactant in an amount necessary for detergency performance, and the supporting strength is also important from the viewpoints of preventing lowering the flowability of powdery detergent, caking, and migration of the liquid surfactant to a container or its surface by suppressing the bleed-out of the liquid surfactant.

Further, from the viewpoint of productivity, a property of quickly absorbing the liquid surfactant (supporting rate) is also demanded for the particles for supporting a surfactant.

As to the structure demanded for the particles for supporting a surfactant having a high supporting ability, it is desired to have a structure so that the supporting capacity is increased by having a sufficient microporous capacity in the inner portion of the particle, and that the supporting strength is high by having fine micropore diameter. Such a structure is obtained by constructing the particles for supporting a surfactant with fine particles such that the particles are in contact with each other, with maintaining a sufficient air gap therebetween. As a supplying source for the fine particles, a water-soluble salt in a detergent composition can be utilized. For instance, a representative water-soluble salt usable for a detergent composition includes sodium carbonate. Sodium carbonate forms sodium carbonate monohydrate or burkeite, which is a compound salt with sodium sulfate, in a slurry, these compounds can form fine acicular crystals to serve as a base material for forming an effective supporting site in the inner portion of the particle for supporting a surfactant.

As a technique for actualizing such formation, Japanese Patent Laid-Open No. Sho 62-112697 discloses a process of obtaining a dry powder having a high adsorption capacity (particles for supporting a surfactant), comprising adding and mixing a crystal growth-controlling agent, which is an organic substance having at least 3 carboxyl groups in the molecule, in an effective amount, with a slurry, prior to mixing the slurry with sodium carbonate, thereby forming sodium carbonate monohydrate and/or burkeite, of which crystal growth is controlled, in the slurry; and thereafter spray-drying the mixture slurry.

However, the supporting ability of the particles for supporting a surfactant obtained by this process has not been sufficient. The causes therefor include the amount of the fine burkeite dispersed being insufficient in the slurry before spray-drying; and the amount of the fine acicular crystals of burkeite being insufficient also in the particle obtained by spray-drying. The fine burkeite crystals are a base material effective for improving the supporting ability. However, in this technique, since dissolved sodium sulfate forms burkeite on the surface or near the surface of granular sodium carbonate added afterwards, a majority exists as an aggregate which is hard and has a large particle size. Therefore, the amount of the burkeite in a fine acicular crystal state formed in the slurry is small, and the burkeite which could have been inherently formed into fine acicular crystals takes an aggregated state having a large particle size in the particle even after spray-drying. Therefore, the resulting particles have large microporous capacity and micropore diameter, so that a sufficient supporting ability cannot be exhibited.

Also, a polyacrylate (polymer), which is a polymer especially effective as a crystal growth-controlling agent, may form a coating film on the particle surface. Therefore, when the polymer is formulated as a detergent composition in an effective amount or more, there may be some cases where the resulting particle does not exhibit a sufficient supporting ability. In this publication the maximum supporting capacity is exhibited when the amount of the polymer in the particle is as small as about 1 to about 2% by weight, so that a certain limitation must have been added to the formulation amount of the water-soluble polymer.

The water-soluble polymer is a base material having a film-forming characteristic by drying. When the water-soluble polymer is formulated in the slurry, a coating film containing a water-soluble polymer on a particle surface after drying is formed, thereby lowering the degree of porocity. In this case, the supporting rate tends to be lowered, so that a certain period of time has been required for sufficiently supporting a liquid surfactant in the particles for supporting a surfactant. In order to efficiently prepare detergent particles by the process of supporting the liquid surfactant in the particles for supporting a surfactant, it has been desired to further increase the supporting rate for the liquid surfactant composition in the particles for supporting a surfactant.

DISCLOSURE OF INVENTION

Accordingly, an object of the present invention is to provide particles for supporting a surfactant which are excellent in the supporting ability (supporting capacity/supporting strength) of the liquid surfactant composition; a process for preparing the particles for supporting a surfactant; particles for supporting a surfactant which are excellent in the absorption property (supporting rate) of the liquid surfactant composition; detergent particles prepared by using the particles for supporting a surfactant; a detergent composition comprising the detergent particles; and a process for preparing detergent particles prepared by using the particles for supporting a surfactant.

These objects and other objects of the present invention will be apparent from the following description.

Specifically, the present invention relates to:

[1] a process for preparing particles for supporting a surfactant comprising the steps of preparing a preparation liquid comprising a water-soluble polymer and a water-soluble salt, and spray-drying the preparation liquid obtained thereby, wherein the step of preparing the preparation liquid comprises (a) preparing a first preparation liquid comprising a solution or slurry comprising a water-soluble polymer and a water-soluble salt, and (b) subjecting the first preparation liquid to a treatment of increasing a number of water-soluble salt particles, thereby preparing a second preparation liquid having an increased number of water-soluble salt particles, as compared to the number of water-soluble salt particles which are present in the first preparation liquid;

[2] particles for supporting a surfactant obtainable by spray-drying a preparation liquid comprising a water-soluble polymer and a water-soluble salt, wherein the particles for supporting a surfactant have a mode diameter of the microporous capacity distribution, as determined by mercury porosimeter, of 1.5 $\mu$m or less, a microporous capacity of 0.3 mL/g or more for one having a micropore diameter of from 0.01 to 3.0 $\mu$m, and a particle strength of from 15 to 100 MPa;

[3] particles for supporting a surfactant comprising a water-soluble polymer and a water-soluble salt, wherein at least a part of particles comprises a particle which is a cave-in particle having a structure that there exists a hollow, namely a cave-in hole, in an inner portion thereof, and that a particle surface is opened and communicated with the hollow in the inner portion;

[4] a process for preparing detergent particles having a bulk density of from 500 to 1000 g/L, comprising the step of mixing from 10 to 100 parts by weight of a surfactant composition with 100 parts by weight of particles for supporting a surfactant obtainable by the process of item [1] above or the particles of item [2] above;

[5] detergent particles having a bulk density of from 500 to 1000 g/L, wherein from 10 to 100 parts by weight of a surfactant composition is supported in 100 parts by weight of particles for supporting a surfactant obtainable by the process of item [1] above or the particles of item [2] above; and

[6] a detergent composition comprising the detergent particles of item [5] above.

BEST MODE FOR CARRYING OUT THE INVENTION

1. Definitions of Terminology

Figure 1:
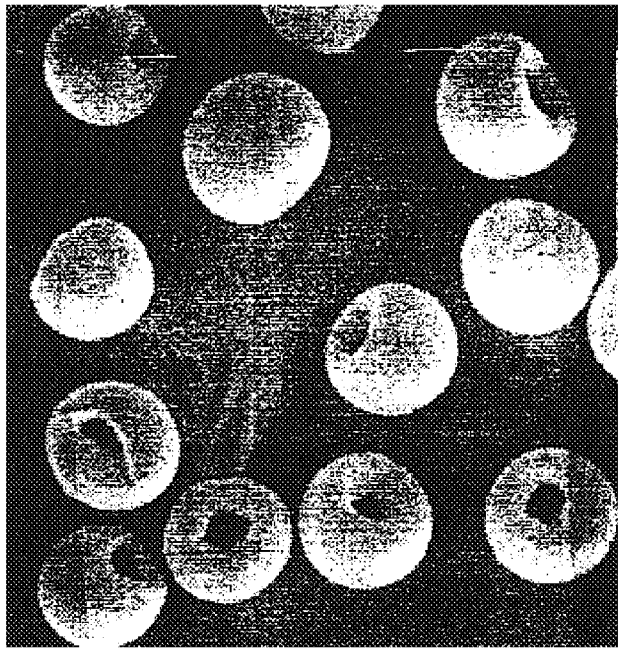
FIG. 1 is a show of an SEM photograph showing one example of an external appearance of the particles for supporting a surfactant comprising a cave-in particle.

The term "particle for supporting a surfactant" of the present invention refers to a particle obtainable by spray-drying a preparation liquid comprising a water-soluble polymer and a water-soluble salt, which is used for supporting a liquid surfactant composition, and an aggregate thereof is referred to as "particles for supporting a surfactant." The term "detergent particle" refers to a particle comprising a surfactant, a builder and the like, in which a liquid surfactant composition is supported in a particle for supporting a surfactant, and the term "detergent particles" means an aggregate thereof. The term "detergent composition" means a composition comprising detergent particles, and further comprising separately added detergent components other than the detergent particles as desired (for instance, builder particles, fluorescent dyes, enzymes, perfumes, defoaming agents, bleaching agents, bleaching activators, and the like). In the present specification, the preparation liquid may be referred to as a "first preparation liquid" and a "second preparation liquid" in some cases. The second preparation liquid is obtained by treating the first preparation liquid. The term "water-soluble salt particles which are present in the first preparation liquid" means undissolved substances and precipitates derived from a water-soluble salt. The term "undissolved substances" means a water-soluble salt, which cannot be dissolved in the liquid phase and is present as a solid, among raw materials added to the first preparation liquid, and the term "precipitate" means a solid derived from a water-soluble salt formed from a liquid phase of the first preparation liquid. Also, in the phrase "derived from a water-soluble salt," the water-soluble salt means a water-soluble salt per se, or compound salts or complex salts thereof The term "water-soluble salt" refers to a compound of which solubility is 0.5 g/100 g or more to water at 25° C., and molecular weight is less than 1000. The term "water-soluble polymer" refers to an organic polymer of which solubility is 0.5 g/100 g or more to water at 25° C., and molecular weight is 1000 or more. The term "water-insoluble compound" refers to a solid of which solubility is less than 0.5 g/100 g of water at 25° C. The term "liquid surfactant composition" refers to a composition comprising a liquid or paste-like surfactant when supporting the surfactant in the particles for supporting a surfactant.

2. Improvement in Supporting Ability of Particles for Supporting Surfactant

The properties required for the particle for supporting a surfactant (hereinafter also referred to as "particle for supports") to exhibit a high supporting ability include having much space (supporting sites) for supporting a liquid surfactant composition (hereinafter also referred to as "liquid composition") in the inner portion of the particle, namely having a large microporous capacity in the inner portion of the particle, thereby having a large supporting capacity for the liquid composition, and having a small micropore diameter in the inner portion of the particle, thereby having strong supporting strength for the liquid composition. In addition, it is necessary that the particle for supports has a high supporting rate for the liquid composition for effectively making use of the supporting sites in the inner portion of the particle, and has a particle strength durable when preparing a detergent particle for the operation such as mixing for supporting the liquid composition.

In the particles for supporting a surfactant obtainable by spray-drying a preparation liquid comprising a water-soluble polymer and a water-soluble salt, a method for improving a supporting rate with dramatic improvements in the supporting ability and the particle strength has been studied. As a result, completely new facts not conventionally found have been found that the microporous capacity of the inner portion of the particle obtainable by spray-drying the preparation liquid can be made even larger, and the micropore diameter of the inner portion of the particle can be made smaller by increasing the number of the water-soluble salt particles which are present in the preparation liquid to be spray-dried, and that the formation of the coating film in the particle surface is suppressed.

As the number of the water-soluble salt particles which are present in the preparation liquid increases, the particles are present as dispersion of fine particles in the preparation liquid. In addition, the fine particles are present in a dispersed state in the inner portion of droplets in the process of spray-drying the droplets of the preparation liquid. As described above, the fine water-soluble salt particles which are present in a dispersed state in the inner portion of the spraying droplets contribute to the formation of the supporting sites by being retained in a dispersed state even in the inner portion of the particle obtainable by spray-drying. In other words, the water-soluble salt which is present in the preparation liquid has a large specific surface area by increasing its number, and is utilized in a more effective formation of the supporting site for the liquid composition in the particle obtainable by spray-drying. Further, it has been found that there may be some cases where the fine water-soluble salt particles play a role as seed crystals when the water-soluble salt dissolved in the liquid phase of the preparation liquid is precipitated in the spray-drying process. Here, the fine water-soluble salt particles can serve as seed crystals, when the fine water-soluble salt particles contain the same salt as the water-soluble salt and/or a compound salt of the salt which is dissolved in the preparation liquid and/or a solid of a complex salt. Moreover, in the spray-drying process, the water-soluble salt dissolved in the liquid phase of the preparation liquid is precipitated as fine acicular crystals subjected to crystal growth adjustment action of the water-soluble polymer by having the seed crystals dispersed in the inner portion of the spray droplets as a core, thereby more effectively making use of improvements of the supporting sites of the inner portion of the particle. Since the particles for supports obtainable by this process can have small micropore diameter of the inner portion of the particle, they are excellent in the supporting ability, especially supporting strength, for the liquid composition, and have high particle strength.

The technique for improving the supporting ability of the particles for supporting a surfactant described above is effective when preparing both a phosphorus-containing detergent containing a phosphate, and a phosphorus-free detergent, and is a technique exhibiting especially high effects when preparing a phosphorus-free detergent which is more difficult to achieve the improvement in the supporting ability.

Incidentally, the internal structure of the particle for supporting a surfactant of the present invention can be confirmed by using a mercury porosimeter as expressed by the microporous capacity distribution of the particles for supports. In the distribution of the microporous capacity per micropore diameter of the inner portion of the particle for supports as determined by mercury porosimeter (for instance, "manufactured by SHIMADZU CORPORATION, "SHIMADZU Poresizer 9320") (hereinafter referred to as "microporous capacity distribution"), the larger the microporous capacity, the larger the supporting capacity for the liquid composition; the smaller the micropore diameter, the higher the ability of retaining a liquid composition once absorbed by capillary phenomenon (supporting strength). Therefore, in a case where the microporous capacity is even larger and a micropore diameter is even smaller, the supporting ability for the surfactant can be made high, thereby supporting a large amount of the liquid composition, and at the same time the bleed-out of the liquid composition can be suppressed. Therefore, the particles for supporting a surfactant of the present invention which are suitable for supporting the liquid composition have a mode diameter of the microporous capacity distribution (the micropore diameter having the largest microporous capacity in the obtained microporous capacity distribution) of 1.5 μm or less, preferably 1.3 μm or less, more preferably 1.1 μm or less, still more preferably 1.0 μm or less, especially preferably 0.9 μm or less, most preferably 0.8 μm or less.

In addition, with regard to the microporous capacity of the particles for supporting a surfactant of the present invention, the microporous capacity of one having a micropore diameter of from 0.01 to 3.0 μm is 0.3 mL/g or more. It is preferable that the microporous capacity of one having a micropore diameter of from 0.01 to 2.5 μm is 0.3 mL/g or more. It is more preferable that the microporous capacity of one having a micropore diameter of from 0.01 to 2.0 μm is 0.3 mL/g or more. It is still more preferable that the microporous capacity of one having a micropore diameter of from 0.01 to 1.5 μm is 0.3 mL/g or more. It is especially preferable that the microporous capacity of one having a micropore diameter of from 0.01 to 1.0 μm is 0.3 mL/g or more. In addition, in the ranges of each micropore diameter, it is more preferable that its microporous capacity is 0.35 mL/g or more, and it is still more preferable that its microporous capacity is 0.4 mL/g or more.

The particle strength of the particles for supporting a surfactant of the present invention is from 5 to 200 MPa, preferably from 10 to 150 MPa, more preferably from 15 to 100 MPa, particularly preferably from 20 to 80 MPa, especially preferably from 25 to 60 MPa, from the viewpoint of preventing undesirable lowering of the supporting capacity caused by disintegration of the particle constituting the particles when the liquid surfactant composition is added to the particles. Here, the particle strength can be determined by the method described in the measurement method of the particles described below.

It is even more preferable that the particles for supporting a surfactant of the present invention have both of the above-described preferable microporous capacity distribution and particle strength. The preferable properties are such that the mode diameter of the microporous capacity distribution is 1.5 μm or less, that the microporous capacity of one having a micropore diameter of 0.01 to 3.0 μm is 0.3 mL/g or more, and that the particle strength is from 15 to 100 MPa. The more preferable properties are such that the mode diameter of the microporous capacity distribution is 1.1 μm or less, that the microporous capacity of one having a micropore diameter of 0.01 to 2.0 μm is 0.3 mL/g or more, and that the particle strength is from 20 to 80 MPa.

3. Method for Increasing Number of Water-Soluble Salt Particles Which Are Present in Preparation Liquid There has been studied a treatment of increasing the number of water-soluble salt particles in the process of preparing a preparation liquid, which comprises (a) preparing a first preparation liquid comprising a solution or slurry comprising a water-soluble polymer and a water-soluble salt; and (b) subjecting the first preparation liquid mentioned above to a treatment of increasing the number of water-soluble salt particles, thereby giving a second preparation liquid having an increased number of the particles, as compared to the number of the water-soluble salt particles which are present in the first preparation liquid. As a result, the following means (1) to (3) mentioned below have been found.

Here, the preparation liquid subjected to a means for increasing the number of the water-soluble salt particles exemplified in (1) to (3) mentioned below is referred to as a second preparation liquid.

(1) precipitating a water-soluble salt dissolved in the first preparation liquid.

(2) subjecting the water-soluble salt particles in the first preparation liquid to a wet pulverization.

(3) adding to the first preparation liquid fine water-soluble salt particles which may be the same as or different from the water-soluble salt in the first preparation liquid, under the conditions that the fine particles can be present without being substantially dissolved in the first preparation liquid.

In addition, a combination of two or more of the means (1) to (3) mentioned above is a preferable embodiment of the present invention.

Further, a process for precipitating a water-soluble salt dissolved in the first preparation liquid described in (1) has been studied. As a result, there have been found the following means.

(1-1) adding a microcrystal-precipitating agent to the first preparation liquid.

(1-2) concentrating the first preparation liquid.

(1-3) adjusting the temperature of the first preparation liquid so that a dissolved amount of the water-soluble salt dissolved in the first preparation liquid is lowered.

In addition, the precipitation of the water-soluble salt by a combination of two or more of the means (1-1) to (1-3) mentioned above is a preferable embodiment of the present invention.

Here, as a method for confirming the fact that the number of water-soluble salt particles in the second preparation liquid is increased from that of the first preparation liquid, there can be employed, for instance, the following in-line type powder droplet monitoring system (manufactured by LASENTEC, "TSUB-TEC M100"). The method for confirmation will be exemplified below.

One-thousand grams of the preparation liquid is weighed and placed in a 1-L stainless beaker, and stirred in a thermostat of which temperature is adjusted to the same temperature as that of the preparation liquid with rotating agitation impellers with 3 propeller wings of 2×4 cm at a speed of 200 r/min. An in-line type powder droplet monitoring system (manufactured by LASENTEC, "TSUB-TEC M100") is penetrated at an angle of 45° to the liquid surface of the stand-still preparation liquid, and attached at a position 3 cm below the liquid surface. By the arrangement, particles are always collided to the window surface when stirred. Using "Control Interface for FBRM Ver. 5.4 Build 58b" (manufactured by LASENTEC) as a software, a focus position is set at a position on the inner side 0.02 mm from the window surface. The measurement duration (measurement time period for each run) is 14.5 seconds, and the averaging (moving average) is taken with 10 measurements. The number of counts (particles/s) at the time of 5-minute measurement is determined.

The above measurements are taken for the first preparation liquid and the second preparation liquid, and the obtained number of counts is compared. Specifically, by having a larger number of counts for the second preparation liquid than the number of counts for the first preparation liquid, there can be confirmed an increase in the number of the water-soluble salt particles in the second preparation liquid as compared to that in the first preparation liquid.

Also, the increase in the number of counts can also be directly confirmed by using the above in-line type powder droplet monitoring system when preparing the second preparation liquid from the first preparation liquid.

Here, the increased number of the water-soluble salt particles in comparison to the number of the water-soluble salt particles which are present in the first preparation liquid cannot be absolutely determined from the number of the water-soluble salt particles which are present in the first preparation liquid. For instance, the difference in the number of counts of the second preparation liquid from that of the first preparation liquid obtained by the above method may be preferably 500 particles/s or more, more preferably 1000 particles/s or more.

Here, among the above means, it is preferable that the amount of the water-soluble salt undissolved in the second preparation liquid (namely, precipitates derived from a water-soluble salt and/or fine water-soluble salt particles added to the first preparation liquid), which is increased by the treatment of increasing not only the number of the water-soluble salt particles which are present in the second preparation liquid but also the amount of the water-soluble salt undissolved in the second preparation liquid [treatment of (1), (3) or combining two or more means of (1) to (3)], is 3% by weight or more, based on the amount of the water-soluble salt dissolved in the first preparation liquid before carrying out the above means. From the viewpoint of forming further effective supporting sites in the inner portion of the particles after spray-drying, thereby improving the supporting ability, the amount is more preferably 5% by weight or more, still more preferably 8% by weight or more, most preferably 10% by weight or more. On the other hand, from the viewpoints of securing the microporous capacity of the particles for supporting a surfactant obtained after spray-drying and the handleability of the second preparation liquid after subjecting to the above means, the amount of the water-soluble salt undissolved in the second preparation liquid increased by the above means is preferably 50% by weight or less, more preferably 35% by weight or less, still more preferably 30% by weight or less, most preferably 25% by weight or less, based on the water-soluble salt dissolved in the first preparation liquid.

The amount A (%) of the water-soluble salt undissolved in the second preparation liquid, which is increased by a means of increasing the amount of the water-soluble salt undissolved in the preparation liquid, is determined by measuring the content, the dissolution rate and the ratio of undissolved portion of the water-soluble salt in the preparation liquid before and after the treatment as determined by the subsequent method.

First, a content T (%) of the water-soluble salt of the first and second preparation liquids is determined by ion chromatography, or the like.

Also, the dissolution rate of the water-soluble salt is obtained as follows.

A preparation liquid is filtered under reduced pressure, and a water concentration P (%) in the filtrate is determined by a far infrared ray heater-type moisture meter (manufactured by SHIMADZU CORPORATION) or the like. Further, the water-soluble salt concentration S (%) in the filtrate is obtained by ion chromatography or the like. Supposing that the water content of the preparation liquid is Q (%) and that content of the water-soluble salt in the preparation liquid is T (%), the dissolution rate U (%) of the water-soluble salt is obtained by the following equation:

$$\text{Dissolution Rate}(\%) = \frac{(100 \times S \times Q)}{(P \times T)} \quad \text{(I)}$$

However, when the above dissolution rate calculated exceeds 100%, the dissolution rate is considered as 100%. In addition, the ratio of undissolved portion V (%) is obtained by the following equation.

$$\text{Ratio of Undissolved} = 100 - \text{U Portion } (\%) \quad \text{(II)}$$

Supposing that the content of the water-soluble salt is T1 (%), the dissolution rate is U1 (%), and the ratio of undissolved portion is V1 (%) in the first preparation liquid, and that the content of the water-soluble salt is T2 (%), and the ratio of undissolved portion is V2 (%) in the second preparation liquid, the increased amount A (%) of the water-soluble salt undissolved in the above second preparation liquid is obtained by the following equation.

$$\begin{array}{l}\text{Increased Amount } A(\%) \\ \text{of Water-Soluble Salt} \\ \text{Undissolved in Second} \\ \text{Preparation Liquid}\end{array} = 100 \times \frac{(T2 \times V2 - T1 \times V1)}{T1 \times U1} \quad \text{(III)}$$

In addition, in the preparation of first preparation liquid comprising a water-soluble polymer and a water-soluble salt, and subsequent treatment of increasing the number of the water-soluble salt particles which are present in the first preparation liquid, the more finer the water-soluble salt particles which are present in the second preparation liquid which are increased by the treatment, the smaller the micropore diameter of the particles for supports obtainable by spray-drying, whereby an effect of improving the supporting ability is increased. From this viewpoint, the average particle size of the water-soluble salt particles which are present in the second preparation liquid increased by the treatment is preferably 40 μm or less, more preferably 35 μm or less, still more preferably 30 μm or less, especially preferably 25 μm or less, more especially preferably 20 μm or less, still more especially preferably 15 μm or less, most preferably 10 μm or less.

The average particle size refers to an average particle size calculated from the particle size distribution resulting from subtracting the particle size distribution of the particles which are present in the first preparation liquid from the particle size distribution of the particles which are present in the second preparation liquid as determined by the following measurement method.

The particle size distribution of the particles which are present in the first or second preparation liquid can be determined by using the in-line type particle droplet monitoring system (manufactured by LASENTEC, "TSUB-TEC M100") which is used for the determination of the number of counts mentioned above. The average particle size of the water-soluble salt particles which are present in the preparation liquid described in the present specification is a measured value using "TSUB-TEC M100." The measurement is carried out in the same manner as the measurement for the number of counts described above except for determining the particle size distribution at the point of 5-minute determination. Here, the median code (particle size at which the cumulative number of particles is 50%) is defined as an average particle size. It is preferable that the water-soluble salt particles which are present in the second preparation liquid are those comprising solids composed of the same salt as the water-soluble salt dissolved in the preparation liquid and/or compound salts thereof, which can serve as seed crystals during precipitation in the process of spray-drying the water-soluble salt dissolved in the liquid phase of the preparation liquid. The water-soluble salt particles which can serve as seed crystals are those which can serve as a core during the precipitation of the water-soluble salt dissolved in the liquid phase of the preparation liquid in the process of spray-drying. And the water-soluble salt precipitating in the process of spray-drying with seed crystals as a core which are present in the dispersion state in the sprayed droplets is precipitated as fine acicular crystals which are subjected to crystal growth adjustment action of a water-soluble polymer, whereby it can be effectively utilized for improving the supporting sites in the inner portion of the particle. From the viewpoints of precipitating microcrystals in the inner portion of the particle for supports obtainable by spray-drying, thereby making the micropore diameter even smaller, and improving the supporting strength for the liquid composition and the particle strength, it is preferable that the water-soluble salt particles which can serve as seed crystals are very fine and large in number.

4. Acceleration of Absorption of Liquid Surfactant Composition Through Cave-In Hole As conditions for the particle for supporting a surfactant to exhibit high supporting ability, it is necessary that the particle has a large amount of space (supporting site) for supporting the liquid surfactant composition in the inner portion of the particle. Moreover, it is especially important that in the production of powdery detergent that the liquid surfactant composition is quickly absorbed, from the viewpoint of improvement in the productivity.

As described above, when the preparation liquid generally comprising a water-soluble polymer and a water-soluble salt is spray-dried, since evaporation of moisture mainly takes place at the surfaces of the sprayed droplets, the water-soluble components dissolved in the preparation liquid migrate to the surface together with moisture with the progress of the spray-drying, so that the particle obtained after spray-drying takes a spherical structure, of which surface is coated with a coating film mainly constituted by a water-soluble salt and a water-soluble polymer. The coating film formed on the particle surface serves as a factor for delaying or inhibiting the absorption of the liquid surfactant composition into the inner portion of the particle.

Therefore, a method for increasing the supporting rate for the liquid surfactant composition in the particles for supports has been studied. As a result, it has been found that the absorption of the liquid surfactant composition is speeded up by changing the shape of the spray-dried particle (particle for supports). The spray-dried particle is obtained as an aggregate of a spherical particle obtained by influence of spherical or sprayed droplets, and it has been found that the absorption of the liquid surfactant composition is dramatically speeded up by poking a hole from the surface to the inner portion of the spray-dried particle in at least one location, for instance, poking a hole with a needle or the like. In other words, it has been found that the particles for supporting a surfactant having excellent supporting rate for the liquid surfactant composition can be obtained by changing the particle shape to have a cave-in hole having a structure that there exists a hollow in the inner portion of the spray-dried particle, and a particle surface is opened and communicated with the hollow in the inner portion (particle surface being caved-in).

As a method for efficiently preparing the particle for supports (cave-in particle) having the cave-in hole, a method for making caving-in the particle surface at the point of spray-drying has been studied. As a result, it has been found that the content of the cave-in particle in the spray-dried particle can be dramatically increased by adjusting the composition to a particular range, and adjusting the water content of the preparation liquid and spray-drying conditions.

The cave-in particle in the present invention will be described in further detail. The cave-in hole (hole) is basically present in at least one location of one particle. The action for sufficiently speeding up the absorption of the liquid surfactant composition is exhibited by this cave-in hole, and a plurality of cave-in holes may be present in one particle for causation such as interference of droplets in the drying tower.

5. Explanation of Cave-In Particle

Figure 2:
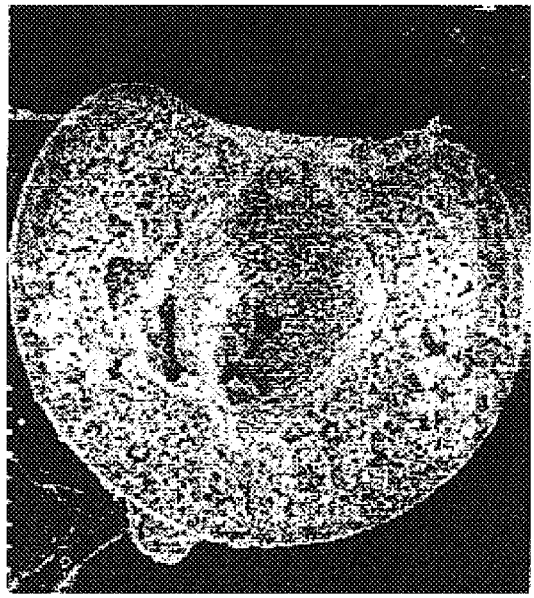
FIG. 2 is a show of an,SEM photograph for a split cross section of the cave-in particle.

The phrase "particle which is cave-in particle having a structure that there exists a hollow, namely a cave-in hole, in the inner portion of the spray-dried particle, and that a particle surface is opened and communicated with the hollow in the inner portion" contained in the particles for supports of the present invention refers to a particle having an external appearance, for instance, as shown in FIG. 1, and having a cross section as shown in FIG. 2.

Figure 3:
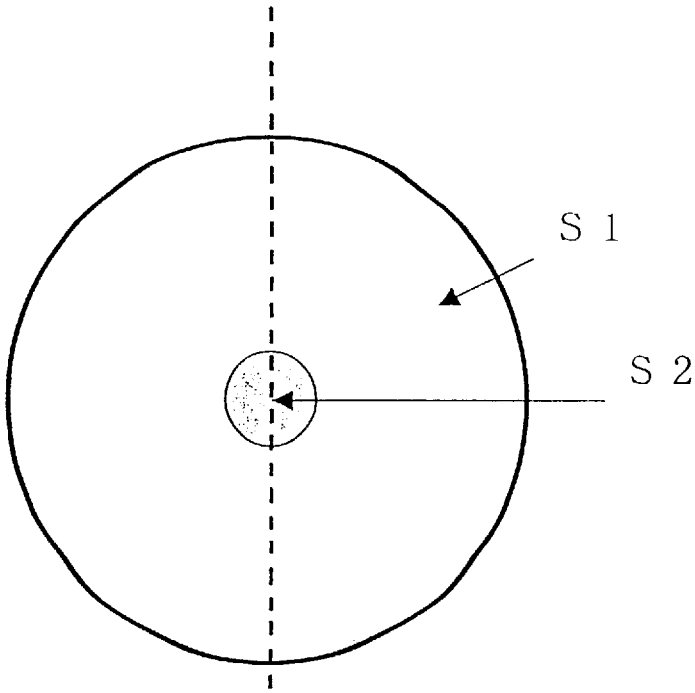
FIG. 3 is a schematic view of the particle observed from the surface centering about a cave-in hole.

In addition, the preferable size of the cave-in hole in the cave-in particle contained in the particles for supports of the present invention will be defined. The projected area diameter of the particle can be obtained by photographing a particle using a microscope centering about the opening of the cave-in hole as shown in FIG. 3, and calculating the projected area diameter from the equation (IV) by using the projected area (S1) of the particle measured from the photographed particle image.

$$\text{Projected Area Diameter of Particle}=2\times(S1/\pi)^{1/2} \quad \text{(IV)}$$

In addition, the projected area diameter of the hole (cave-in hole) can be obtained by the equation (V) by using the projected area (S2) of the hole determined in the same manner as the projected area of the particle mentioned above with an opening as shown in FIG. 3.

$$\text{Projected Area Diameter of Hole}=2\times(S2/\pi)^{1/2} \quad \text{(V)}$$

Here, as the microscope for the above measurement, there can be used, for instance, a digital microscope "VH-6300" manufactured by KEYENCE CORPORATION and SEM such as a field emission scanning electron microscope "Model S-4000," manufactured by Hitachi, Ltd. In the calculation of the projected area, there can be used, for instance, WinRoof manufactured by Mitsutani, and the like.

A preferable diameter for the hole which is present in the cave-in particle contained in the particles for supports of the present invention is a hole in which:

$$\frac{\text{(Projected Area Diameter of Hole)}}{\text{(Projected Area Diameter of Particle)}}\times 100$$

is 2% or more. In addition, from the viewpoints that the liquid surfactant composition is easily infiltrated by and entered through the cave-in hole, and that a particle shape even closer to a spherical shape is desired for external appearance, the above ratio is preferably from 2 to 70%, more preferably from 4 to 60%, still more preferably from 6 to 50%, especially preferably from 8 to 40%, most preferably from 10 to 30%.

Figure 4:
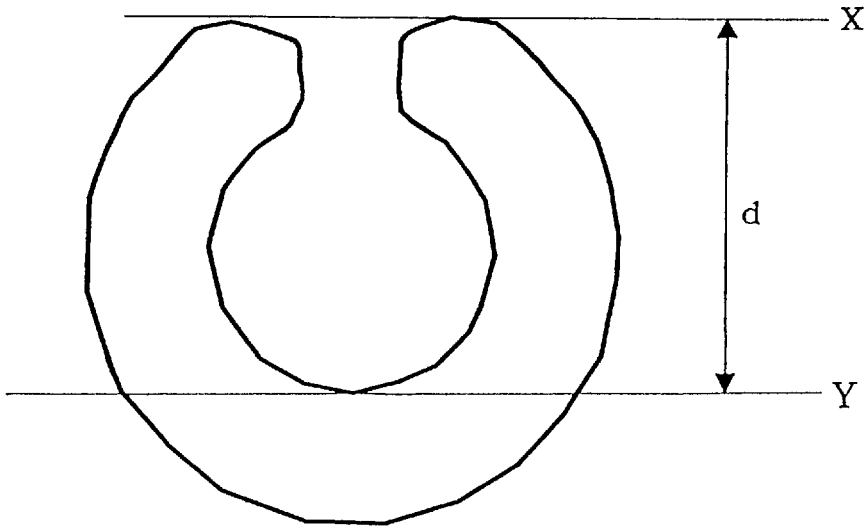
FIG. 4 is a schematic side view of a cross section obtained by perpendicularly splitting the particle against the face centering about a cave-in hole as shown by a broken line in FIG. 3.

The depth of the hole which is present in the cave-in particle contained in the particles for supports of the present invention is expressed by the ratio of a distance d between a tangent line X of an open surface of the cave-in hole and a tangent line Y with the bottom of the hole in parallel to the tangent line X as shown in FIG. 4 to the projected area diameter of the particle described above, i.e., $$\frac{\text{(Distance } d\text{)}}{\text{(Projected Area Diameter of Particle)}}\times 100$$

Here, the depth of the hole can be determined, for instance, by splitting a particle with a surgical knife or the like at a plane perpendicular to the open hole portion of the cave-in hole as shown by the broken line in FIG. 3, and photographing the cross section with SEM or the like. It is preferable that the depth of the hole which is present in the cave-in particle contained in the particles for supporting a surfactant of the present invention is such that the ratio as defined above is 10% or more. In addition, from the viewpoints of even more increasing the supporting rate for the liquid surfactant composition and even more securing the supporting capacity for the liquid surfactant composition in the inner portion of the particle in a large amount, the ratio is more preferably from 10 to 90%, more preferably from 15 to 80%, especially preferably from 20 to 70%.

It is desired that the content of the cave-in particle in the constituent particle of the particles for supports of the present invention is 30% or more, preferably 50% or more, more preferably 70% or more, still more preferably 80% or more, most preferably 90% or more and 100% or less, from the viewpoint of more speedily and effectively absorbing the liquid surfactant composition, thereby increasing the productivity.

In addition, the constituent particle other than the cave-in particle mentioned above in the present invention includes particles having a hole having a size outside that defined as the cave-in hole mentioned above, a split particle and a spherical particle having no cave-in holes, and the like. It is desired that the content of these constituent particles is 70% or less, preferably 50% or less, more preferably 30% or less, still more preferably 20% or less, most preferably 10% or less.

Here, the content of the cave-in particle in the present invention is determined by the following method. Specifically, using nine-step sieves each having a sieve-opening as defined by JIS Z 8801 of 2000 μm, 1400 μm, 1000 μm, 710 μm, 500 μm, 355 μm, 250 μm, 180 μm, or 125 μm, and a receiving tray are used, the sieves and the receiving tray being attached to a rotating and tapping shaker machine (manufactured by HEIKO SEISAKUSHO, tapping: 156 times/min, rolling: 290 times/min), a 100 g sample of the supporting particles is vibrated for 10 minutes to be classified. Thereafter, the weights of the receiving tray and the particles on each sieve are determined, and the mass base frequency at each particle size (T1% by weight, . . . T10% by weight) is calculated. Next, 100 or more particles (U1 particles, . . . U10 particles) are collected arbitrarily from the sample sieved to each particle size, and the number of particles of the cave-in particles described above for each particle size (V1 particles, . . . V10 particles) is evaluated. And a sum of products each obtained by multiplying the content of the cave-in particle at each particle size (V1/U1, . . . V10/U10) by the above mass base frequency is defined as the content of the cave-in particle.

6. Composition of Particles for Supporting Surfactant

The particles for supports of the present invention are mainly composed of a water-soluble polymer and a water-soluble salt. The water-soluble polymer and the water-soluble salt are important for forming a supporting site and a cave-in hole for a liquid surfactant composition. In addition, the water-soluble polymer has an action of imparting strength to the particle.

The preferable water-soluble polymer can be exemplified, for instance, by one or more kinds selected from the group consisting of carboxylic acid-based polymers; cellulose derivatives such as carboxymethyl celluloses; aminocarboxylic acid-based polymers such as polyglyoxylates and polyaspartates; water-soluble starches; sugars; and the like. Among them, the carboxylic acid-based polymers are preferable, from the viewpoints of the action of making the water-soluble salt fine and the detergency, concretely including the action of capturing metal ions, the action of dispersing solid particle stains from garments into a washtub, and the action of preventing the particle stains from re-depositing to the garments.

Among the carboxylic acid-based polymers, acrylic acid homopolymers and the salts thereof (Na, K, $NH_4$, and the like), and acrylic acid-maleic acid copolymers and the salts thereof (Na, K, $NH_4$, and the like) are especially excellent.

The weight-average molecular weight of these water-soluble polymers is preferably from 1000 to 300000, more preferably from 2000 to 100000, still more preferably from 2000 to 80000, particularly preferably from 5000 to 50000, especially preferably from 6000 to 20000.

The molecular weight is determined as follows

1. Standard substance for calculation: polyacrylic acid (AMERICAN STANDARDS CORP)
2. Eluent: 0.2 mol/L phosphate buffer/$CH_3CN$: 9/1 (volume ratio)
3. Column: PWXL+G4000PWXL+G2500PWXL (manufactured by Tosoh Corporation)
4. Detector: RI
5. Sample concentration: 5 mg/mL
6. Injected amount: 0.1 mL
7. Temperature for determination: 40° C.
8. Flow rate: 1.0 mL/min In addition to the above carboxylic acid-based polymers, polymers such as polyglyoxylates; cellulose derivatives such as carboxymethyl cellulose; and aminocarboxylic acid-based polymers such as polyaspartates can be used as ones having a metal ion capturing ability, a dispersibility and an ability of preventing re-deposition.

Other polymers include polyvinyl pyrrolidones (PVP), polyethylene glycols (PEG), polypropylene glycols (PPG), and the like. The PVP is preferable as a dye-transfer inhibitor, and the PEG and the PPG having a molecular weight of from about 1000 to about 20000 are preferable, because the viscous characteristic of a paste, which is caused by containing water of a powder detergent, is improved.

The content of the water-soluble polymer in the particles for supports is preferably from 2 to 30% by weight, more preferably from 5 to 30% by weight, still more preferably from 6 to 26% by weight, still more preferably from 8 to 24% by weight, most preferably from 10 to 22% by weight. Within the above range, the particle has a sufficiently high strength.

The water-soluble salt includes water-soluble inorganic salts having a carbonate group, a sulfate group, a hydrogencarbonate group, a sulfite group, a hydrogensulfate group, a phosphate group, and the like (for instance, alkali metal salts, ammonium salts, or amine salts). In addition, there may be included halides such as chlorides, bromides, iodides, and fluorides of alkali metal salts (for instance, sodium or potassium salt) and alkaline earth metal salts (for instance, calcium or magnesium salt). In addition, there can be included compound salts containing these salts (for instance, burkeite, sodium sesquicarbonate, and the like).

Among them, carbonates, sulfates and sulfites are preferable. Carbonates are preferable as an alkalizing agent for showing a suitable pH buffering region in a washing liquid, and salts having a high degree of dissociation such as sulfates and sulfites enhance an ionic strength of a washing liquid, and favorably act to sebum stains. In addition, sulfites reduce hypochlorite ions contained in tap water, and have an effect of preventing detergent components such as enzymes and perfumes from oxidation degradation by the hypochlorite ions.

Sodium tripolyphosphates can also be used as the water-soluble salt.

The water-soluble salt may be composed of a single component, or may be a combination of a plurality of components such as a carbonate and a sulfate.

In addition, since the water-soluble salt changes its crystal structure when precipitated in the presence of a water-soluble polymer, the water-soluble salt plays an important role in the improvement of the supporting ability of the particles for supports. Among them, as a base material for forming the supporting sites of the particles for supports, carbonates and/or sulfates are more preferable, and especially a combination of sodium carbonate and sodium sulfate is most preferable. Especially, sodium carbonate and/or burkeite, which is a compound salt of sodium carbonate and sodium sulfate, is important as a base material for forming the supporting sites of the particles for supports.

In addition, since halides of alkali metals and/or alkaline earth metals, such as sodium chloride, effectively form the supporting sites of the particles for supports as microcrystal-precipitating agents, because they have an effect, when added to a first preparation liquid comprising sodium carbonate and/or sodium sulfate, of dissolving themselves and in turn precipitating microcrystals of sodium carbonate or sodium sulfate, or a compound salt thereof. Further, these halides also are especially favorable because they also have an action of partially suppressing the formation of a surface coating film in the drying process, whereby exhibiting an action of increasing supporting rate for the liquid composition in the particles for supports.

In addition, from the viewpoints of satisfying both the supporting ability of the particles for supporting a surfactant and the deterging performance when used as a detergent composition, a preferable weight ratio of (sodium carbonate) to (sodium sulfate) in the particles for supports is from 1:0 to 1:5, more preferably from 1:0 to 1:4, still more preferably from 1:0 to 1:3, especially preferably from 1:0 to 1:2, most preferably from 1:0 to 1:1.

In addition, from the viewpoints of satisfying both the particle strength of the particles for supporting a surfactant and the deterging performance when used as a detergent composition, a preferable weight ratio of (sodium carbonate and/or sodium sulfate) to (water-soluble polymer) in the particles for supports is from 19:1 to 1:1, more preferably from 15:1 to 1.5:1, still more preferably from 10:1 to 2:1, most preferably from 8:1 to 2.5:1.

In addition, a water-soluble organic salt having a low molecular weight can also be used as the water-soluble salt, and includes, for instance, carboxylates such as citrates and fumarates. In addition, from the viewpoint of the detergency, preferable ones include methyliminodiacetates, iminodisuccinates, ethylenediaminedisuccinates, taurine diacetates, hydroxyethyliminodiacetates, P-alanine diacetate, hydroxyiminodisuccinates, methylglycine diacetate, glutamic acid diacetate, asparagine diacetate, serine diacetate, and the like.

The content of the water-soluble salt in the particles for supports is preferably from 20 to 90% by weight, more preferably from 30 to 80% by weight, most preferably from 40 to 70% by weight. Within these ranges, the particles for supports have a sufficiently high particle strength, and the ranges are preferable from the viewpoint of the dissolubility of the detergent particles.

In addition, the particles for supporting a surfactant of the present invention can comprise a water-insoluble substance. As the water-insoluble substance, there can be used crystalline aluminosilicates, amorphous aluminosilicates, silicon dioxides, hydrated silicate compounds, clay compounds such as perlite and bentonite, and the like. From the viewpoints of its contribution to support for the liquid surfactant composition and not promoting generation of undissolved remnants, and the like, the crystalline aluminosilicates and the amorphous aluminosilicates are preferable. In addition, the average particle size of the aluminosilicates is preferably from 0.1 to 10 $\mu$m, more preferably from 0.5 to 5 $\mu$m.

Preferable crystalline aluminosilicates include A-type zeolites (for instance, trade name: "TOYOBUILDER," manufactured by Tosoh Corporation; trade name: "Gosei Zeolite," manufactured by Nippon Builder K.K.; trade name: "VALFOR 100," manufactured by PQ CHEMICALS (Thailand) Ltd.; trade name: "ZEOBUILDER," manufactured by ZEOBUILDER Ltd.; trade name: "VEGOBOND A," manufactured by OMAN CHEMICAL INDUSTRIES Ltd.; and trade name: "Zeolite," manufactured by THAI SILICATE CHEMICALS Ltd.), from the viewpoints of the metal ion capturing ability and the economic advantages. Here, the value of the oil-absorbing ability of A-type zeolite determined by the method according to JIS K 5101 is preferably from 40 to 50 mL/100 g. Besides the above, there are included P-type (for instance, trade names: "Doucil A24," "ZSE064" and the like; manufactured by Crosfield B. V.; oil-absorbing ability: 60 to 150 mL/100 g); and X-type zeolite (for instance, trade name: "Wessalith XD"; manufactured by Degussa-A G; oil-absorbing ability: 80 to 100 mL/100 g). A hybrid zeolite described in WO 98/42622 can be also included as preferable crystalline aluminosilicates.

In addition, amorphous aluminosilicates, amorphous silicas, and the like, which have a high oil-absorbing ability but a low metal ion capturing ability, can be used as the water-insoluble substances. Examples include amorphous aluminosilicates including those described in Japanese Patent Laid-Open No. Sho 62-191417, page 2, lower right column, line 19 to page 5, upper left column, line 17 (especially, the initial temperature being preferably within the range from 15° to 60° C.); and those described in Japanese Patent Laid-Open No. Sho 62-191419, page 2, lower right column, line 20 to page 5, lower left column, line 11 (especially, the oil-absorbing amount being 170 mL/100 g); amorphous aluminosilicates (oil-absorbing ability: 285 mL/100 g) described in Japanese Patent Laid-Open No. Hei 9-132794, column 17, line 46 to column 18, line 38; Japanese Patent Laid-Open No. Hei 7-10526, column 3, line 3 to column 5, line 9; Japanese Patent Laid-Open No. Hei 6-22781 1, column 2, line 15 to column 5, line 2; Japanese Patent Laid-Open No. Hei 8-119622, column 2, line 18 to column 3, line 47, and the like. For instance, there can be used oil-absorbing carriers, for instance, "TOKSIL NR" (manufactured by Tokuyama Soda Co., Ltd.; oil-absorbing ability: 210 to 270 mL/100 g); "FLOWRITE" (the same as above; oil-absorbing ability: 400 to 600 mL/100 g); "TIXOLEX 25" (manufactured by Kofran Chemical; oil-absorbing ability: 220 to 270 mL/100 g); "SILOPURE" (manufactured by Fuji Devison Co., Ltd.; oil-absorbing ability: 240 to 280 mL/100 g), and the like. Especially, as the oil-absorbing carriers, favorable are those described in Japanese Patent Laid-Open No. Hei 6-179899, column 12, line 12 to column 13, line 1, and column 17, line 34 to column 19, line 17.

The water-insoluble substance may be composed of a single component, or a plurality of components.

The content of the water-insoluble substance in the particles for supports, when the water-insoluble substance is contained therein, is preferably from 8 to 49% by weight, more preferably from 16 to 45% by weight, most preferably from 24 to 40% by weight. Within this range, the particles for supporting a surfactant excellent in the particle strength and the dissolubility can be obtained.

Especially, in the particles for supports of the present invention, it is preferable that the content of the water-soluble polymer is from 2 to 30% by weight, that the content of the water-soluble salt is from 20 to 90% by weight, and that the content of the water-insoluble substance is from 8 to 49% by weight.

As other components, a surfactant can be formulated in the particles for supports. However, in a case where the second preparation liquid comprises a surfactant, a coating film tends to be formed on the surface of the resulting particle for supports in the process of spray-drying for preparing the particles for supports. Therefore, as a result, not only the absorption rate of the liquid surfactant composition to the particles for supports is lowered, but also the formation of the cave-in hole is hindered. Therefore, from these viewpoints, the lower the content of the surfactant in the particles for supports the better, and it is preferable that the surfactant is rather not present. From the above reasons, the content of the surfactant in the particles for supports is preferably from 0 to 3% by weight, more preferably from 0 to 2% by weight, particularly preferably from 0 to 1% by weight, and especially most preferably substantially not contained.

As examples of the surfactant, the same ones as those for the liquid surfactant composition to be supported in the particles for supports described below can be used.

The amorphous silicates have an action of enhancing the particle strength of the particles for supports. In a case where the particles for supports comprise a water-insoluble substance such as an aluminosilicate, when the amorphous silicate is contained in the second preparation liquid for preparing the particles for supports, aggregated lumpy masses are formed, which become slightly water-soluble with the passage of time. Therefore, it is preferable that the crystalline silicate is substantially not contained. In addition, since the crystalline silicate also dissolves in the second preparation liquid to become amorphous, it is also preferable in the same manner as the amorphous silicate that the crystalline silicate is not contained in the second preparation liquid. Also, in a case where a water-insoluble substance such as an aluminosilicate is not used, when the silicate is formulated in the second preparation liquid, there is exhibited a tendency of a lowered dissolution rate of the particles for supports obtained after spray-drying. Therefore, it is preferable that the amount of the silicate contained in the second preparation liquid is 10% by weight or less, more preferably 5% by weight or less, still more preferably 2% by weight or less, most preferably substantially not contained, based on the water-soluble salt excluding the silicate contained in the second preparation liquid.

In addition, the particles for supports can contain auxiliary components such as fluorescent dyes, pigments, dyes and enzymes. The content of the auxiliary components in the particles for supports is preferably 10% by weight or less, more preferably 5% by weight or less, especially preferably 2% by weight or less.

7. Process for Preparing Particles for Supporting a Surfactant

The particles for supporting a surfactant of the present invention can be prepared by spray-drying a second preparation liquid obtained by a process comprising step (a) and step (b) described below.

Step (a): preparing a first preparation liquid comprising a solution or slurry comprising a water-soluble polymer and a water-soluble salt; and Step (b): subjecting the first preparation liquid to a treatment of increasing a number of water-soluble salt particles, thereby preparing a second preparation liquid having an increased number of particles of water-soluble salt particles, as compared to the number of water-soluble salt particles which are present in the first preparation liquid.

Here, as to the step of drying a preparation liquid prepared by the process comprising step (a) and step (b), the second preparation liquid may be directly subjected to drying, or as occasion demands, for instance, it may be subjected to drying after such a process as dilution or defoaming in order to improve the handleability of the preparation liquid. As to the drying process, all sorts of drying processes, for instance, freeze-drying, drying under reduced pressure, and the like, can be employed. From the viewpoint of effectively acting the water-soluble salt particles contained in the second preparation liquid in which the number of particles is increased for supporting the liquid composition, it is preferable that the preparation liquid to be subjected to drying is instant-dried. Therefore, an especially preferable drying process is a spray-drying process. As to the spray-drying tower, those of the forms of both the countercurrent tower and cocurrent tower can be used, and the countercurrent tower is preferable from the viewpoint of productivity. In addition, as a heat source for the spray-drying tower, a pulse-impulse wave dryer using a pulse combustor may be exemplified as one of preferable drying apparatus. In the pulse-impulse wave dryer, since the droplets of the preparation liquid subjected to drying are dried in combustion gas at a high temperature along with impulse waves, the drying speed of the droplets is accelerated. One example of the pulse-impulse wave dryer includes PULCON (manufactured by Osaka Fuji Kogyo Kabushiki Kaisha).

Preferred embodiments of step (b), as described above, are roughly classified into:

(1) an embodiment of precipitating a water-soluble salt dissolved in the first preparation liquid;

(2) an embodiment of subjecting water-soluble salt particles in the first preparation liquid to wet pulverization; and (3) an embodiment of adding fine water-soluble salt particles to the first preparation liquid under conditions that the fine particles are capable of being present without substantially being dissolved in the first preparation liquid.

These embodiments will be described in detail below.

7-1. Precipitation of Water-Soluble Salt Dissolved in First Preparation Liquid

This embodiment comprises (a) preparing a first preparation liquid comprising a solution or slurry comprising a water-soluble polymer and a water-soluble salt; and (b) precipitating a water-soluble salt dissolved in the first preparation liquid. The water-soluble salt precipitated in this embodiment is formed from a liquid phase of a first preparation liquid and takes a form of fine particles from the action of the water-soluble polymer. The first preparation liquid before precipitation of the water-soluble salt is prepared by a known process, and the water-soluble polymer and the water-soluble salt may be formulated in any order. When the water-insoluble substance is formulated, the water-insoluble substance may be formulated before precipitation of the water-soluble salt dissolved in the first preparation liquid, from the viewpoint of suppressing the elevation of the viscosity of the second preparation liquid caused by precipitation of the water-soluble salt, and the water-insoluble substance may be formulated after the precipitation, from the viewpoint of increasing the production efficiency of the second preparation liquid.

Examples of precipitating a water-soluble salt dissolved in the first preparation liquid will be described below.

7-1-1. Precipitation by Addition of Microcrystal-Precipitating Agent

The process for precipitating the water-soluble salt mentioned above has been studied. As a result, a process of precipitation by means of a microcrystal-precipitating agent has been found. Specifically, by adding to the first preparation liquid a microcrystal-precipitating agent having an effect of precipitating microcrystals derived from a fine water-soluble salt, the water-soluble salt dissolved in the first preparation liquid before adding the microcrystal-precipitating agent is allowed to precipitate as microcrystals, whereby a second preparation liquid can be obtained. The microcrystal-precipitating agent of the present invention will be described in further detail. Here, from the viewpoint of forming effective supporting sites in the particles for supports, it is preferable that the precipitated water-soluble salt comprises sodium carbonate and/or sodium sulfate.

The microcrystal-precipitating agent refers to a substance which has an effect of precipitating a substance derived from a water-soluble salt different from the precipitating agent by addition to the first preparation liquid.

First, in a case where the microcrystal-precipitating agent is a water-soluble substance, an embodiment where a first preparation liquid comprises a water-soluble salt a and a water-soluble salt b before the step of adding a microcrystal-precipitating agent is described. In this embodiment, the microcrystal-precipitating agent is a substance having a dissolving strength greater than a dissolving strength of the water-soluble salt a and the water-soluble salt b at a temperature in which the precipitating agent is added. The term "dissolving strength" as referred herein means an extent of easiness in dissolving. The microcrystal-precipitating agent can be variously selected depending upon the kinds of the water-soluble salt contained in the first preparation liquid. A substance which can be used as a microcrystal-precipitating agent can be obtained by the following method. For instance, when a water-soluble substance c is added to a saturated solution containing the water-soluble salt a and the water-soluble salt b, in an embodiment where c is dissolved and a substance derived from b, such as b and/or a compound salt or complex salt of a and b, is precipitated, it means that c has a dissolving strength greater than that of b, so that c acts as a microcrystal-precipitating agent.

For instance, when sodium sulfate, sodium carbonate and sodium chloride are added in that order, since sodium chloride is dissolved in a saturated solution of sodium sulfate and sodium carbonate, fine acicular crystals of burkeite, which is a compound salt of sodium sulfate and sodium carbonate, are precipitated without being aggregated. In this case, sodium chloride is a preferable microcrystal-precipitating agent against the preparation liquid comprising sodium carbonate and sodium sulfate.

The crystals precipitating in the preparation liquid by the microcrystal- precipitating agent are very fine. The size of the crystals precipitating in the second preparation liquid can be determined by using the in-line type powder droplet monitoring system (manufactured by LASENTEC, "TSUB-TEC M100") mentioned above.

In addition, the effect of precipitating microcrystals by the microcrystal-precipitating agent can be confirmed as an increase in the number of particles with the passage of time which is observed after addition of the precipitating agent by the in-line type powder droplet monitoring system.

As described above, the confirmation of the microcrystal-precipitating agent can be made also in the preparation liquid of any composition, and a method for confirming a microcrystal-precipitating agent in a preparation liquid containing sodium carbonate and sodium sulfate will be exemplified.

First, a saturated solution containing both sodium sulfate and sodium carbonate is prepared by the following method. Four-hundred grams of sodium sulfate (purity: 99% or more) is added to 1500 g of ion-exchanged water, which is adjusted to the preparation temperature of the first preparation liquid. The mixture is sufficiently stirred for 20 minutes in a thermostat set at the preparation temperature of the first preparation liquid to dissolve sodium sulfate. Further, 400 g of sodium carbonate ("DENSE ASH" manufactured by Central Glass Co., Ltd.) is added thereto, and the mixture is stirred for 30 minutes, to give a suspension. A saturation solution of sodium sulfate/sodium carbonate is prepared by a method of collecting supernatant after allowing the suspension to stand, or by a method of filtrating the suspension. Here, the term "the preparation temperature of the first preparation liquid" refers to any temperature within the temperature range of from 30° to 80° C.

One-thousand grams of the saturated solution of sodium sulfate/sodium carbonate prepared in the manner described above is weighed and placed in a 1-L stainless beaker, and stirred in a thermostat of which temperature is adjusted to the same temperature as that of the preparation liquid with rotating agitation impellers with 3 propeller wings of 2×4 cm at a speed of 200 r/min. The measurement is initiated in the same manner as described above by using the in-line type powder droplet monitoring system, manufactured by LASENTEC. A 100 g test sample is added within 30 seconds, and proceeded with 60-minute stirring and measurement. When at least any one of microcrystals derived from sodium carbonate and/or sodium sulfate, of which average particle size after 60 minutes (code length at which the cumulative value of the number of particles is 50%) is 40 μm or less, for instance, sodium carbonate and hydrates thereof, sodium sulfate and hydrates thereof, compound salts of sodium carbonate and sodium sulfate, is precipitated, the test sample is a microcrystal-precipitating agent against sodium carbonate and/or sodium sulfate. In addition, the average particle size of the precipitated microcrystals is more preferably 30 μm or less, still more preferably 20 μm or less, most preferably 10 μm or less. Here, the precipitate is identified by analyzing with X-ray diffraction, elemental analysis, and the like.

The microcrystal-precipitating agent includes, for instance, salts having high dissolving strength such as chlorides, bromides, iodides and fluorides of alkali metals and/or alkaline earth metals, such as sodium, potassium, calcium and magnesium. In addition, there may be also included, as microcrystal-precipitating agent, solvents which are compatible with water such as ethanol, methanol, and acetone; and substances having a large hydration force, such as zeolite (anhydride). In other words, by dissolution, hydration, and the like of the microcrystal-precipitating agent, water used for dissolution of the water-soluble salt in the first preparation liquid is taken away, thereby serving as a base material having an effect of precipitating the water-soluble salt from the liquid phase of the first preparation liquid.

From the viewpoint of the dissolving strength, the bromides and iodides are preferable, and from the viewpoint of the storage stability of the detergent particles, the chlorides are preferable. Also, from the viewpoint of the influence given to the detergency performance, the alkali metal salts are preferable. Among them, from the economic viewpoint, sodium chloride is especially preferable.

The content of the microcrystal-precipitating agent in the particles for supporting a surfactant is preferably from 0.2 to 35% by weight, more preferably from 0.5 to 30% by weight, more still preferably from 1 to 25% by weight, particularly preferably from 2 to 20% by weight, especially preferably from 4 to 15% by weight, from the viewpoint of exhibiting a sufficient effect for microcrystal precipitation and the viewpoint of maintaining the detergency performance when used as a detergent composition.

In addition, it is preferable that as to the dissolution rate of the water-soluble, microcrystal-precipitating agent in the second preparation liquid, the higher the dissolution rate, the better, from the viewpoints of generating a large amount of precipitates in the second preparation liquid by largely dissolving in the solution portion of the first preparation liquid, so as to have a preferable structure for a supporting site in the particles for supports obtainable after spray-drying to the liquid composition. The dissolution rate of the microcrystal-precipitating agent is preferably 75% by weight or more, more preferably 80% by weight or more, still more preferably 85% by weight or more, particularly preferably 90% by weight or more, still more preferably 95% by weight or more, most preferably being completely dissolved.

The dissolution rate of the microcrystal-precipitating agent in the second preparation liquid can be determined by combining known analyzing means. For instance, the second preparation liquid is filtered under reduced pressure, and thereafter the water concentration P (%) in the filtrate is measured with a far infrared ray heater-type moisture meter (manufactured by SHIMADZU CORPORATION) or the like. Further, the concentration of the microcrystal-precipitating agent S (%) in the filtrate is obtained by ion chromatography or the like. Supposing that the water content of the second preparation liquid is Q (%) and the content of the microcrystal-precipitating agent in the second preparation liquid is T (%), the dissolution rate of the microcrystal-precipitating agent is calculated by the following equation, with proviso that when the above dissolution rate calculated exceeds 100%, the dissolution rate is considered as 100%.

$$\text{Dissolution Rate}(\%) = \frac{(100 \times S \times Q)}{(P \times T)} \quad \text{(VI)}$$

In an embodiment where sodium carbonate and sodium sulfate are together contained in the first preparation liquid, it is preferable that sodium carbonate is added after sufficiently dissolving sodium sulfate, from the viewpoint of increasing the supporting ability of the particles for supports.

The water content of the second preparation liquid is preferably from 30 to 70% by weight, more preferably from 35 to 65% by weight, most preferably from 40 to 60% by weight, from the viewpoints of reducing undissolved substances of the water-soluble components which are not microcrystals and effectively exhibiting the effect of the microcrystal-precipitating agent. The temperature of the preparation liquid is preferably from 300 to 80° C., more preferably from 350 to 75° C., from the viewpoints of the dissolved amount of the water-soluble salt and the liquid conveyability with a pump.

Concrete examples of the process for preparation of this embodiment include, for instance, initially adding all or substantially all of water to a mixing vessel, and sequentially adding other components, preferably after the water temperature almost reaches a set temperature, to give a first preparation liquid. A preferable order of addition is such that liquid components and sodium sulfate, sodium carbonate, and the like are initially added. In addition, small amounts of auxiliary components such as water-insoluble substances, such as zeolite, and dyes can be also added. The microcrystal-precipitating agent is added in a state where the solution portion of the first preparation liquid is saturated. Alternatively, in a case where the solution portion is in an unsaturated state, the microcrystal-precipitating agent is added in an amount exceeding that necessary for the solution portion to be saturated. The water-insoluble substance may be added before the addition, after the addition, or in divided portions before and after the addition of the microcrystal-precipitating agent. In order to finally obtain a homogeneous second preparation liquid, after the addition of the entire components to the preparation liquid, the mixture is mixed for preferably 10 minutes or more, more preferably 30 minutes or more.

7-1-2. Precipitation by Concentration of First Preparation Liquid

The process for precipitating the water-soluble salt mentioned above has been studied. As a result, a process of precipitating by concentrating the preparation liquid has been found. In other words, a large number of microcrystals can be generated in the second preparation liquid by carrying out the operation of precipitation by means of concentration of the water-soluble salt in a dissolving state in the presence of the water-soluble polymer. The concentration of the preparation liquid in this embodiment will be described in further detail.

A process of obtaining a concentrated slurry in which a part of the water-soluble salt dissolved in the first preparation liquid is precipitated by concentrating the first preparation liquid comprising a water-soluble polymer and a water-soluble salt will be described.

First, the first preparation liquid before concentration may be prepared by a known process, and the water-soluble polymer and the water-soluble salt may be formulated in any order. In addition, in a case where a water-insoluble substance is formulated, the water-insoluble substance may be formulated before concentration of the first preparation liquid, or it may be formulated afterwards. In addition, the concentration operation may be carried out to the second preparation liquid subjected to a treatment, for instance, formulation of a microcrystal-precipitating agent or the like.

The smaller the amount of the coarse particles of the undissolved water-soluble salt which are present in the first preparation liquid before concentration, the higher the supporting ability of the particles for supports obtainable after spray-drying. Therefore, the dissolution rate of the water-soluble salt in the first preparation liquid before the concentration is preferably from 50 to 100% by weight, more preferably from 70 to 100% by weight, especially preferably from 90 to 100% by weight. When the dissolution rate does not reach 100% by weight, there is a preferable embodiment where the undissolved substances are made finer by pulverizing the first preparation liquid by using the subsequently described wet pulverization device or the like. The wet pulverization of the first preparation liquid may be carried out to of a concentrated slurry. Here, the dissolution rate of the water-soluble salt is determined by the method described above.

Next, the water-soluble salt dissolved in the first preparation liquid is precipitated by concentrating the first preparation liquid. The extent of the concentration can be determined by the amount of water loss in the first preparation liquid. The amount of water loss in the first preparation liquid is not particularly limited, and it may be appropriately set so that the amount of the water-soluble salt precipitated takes a preferred range. In addition, the water content in the first preparation liquid is not particularly limited. As a device for concentration, it may be any sorts of concentrators which are widely used. For instance, a natural circulation evaporator in which a liquid naturally circulates by rising with boiling within a heating tube in the inner portion of the evaporator, and dropping by being collected to a central concentrate-trapping tube; a forced circulation evaporator with external heating in which a liquid is circulated at a high speed between an evaporator and a heater with a circulation pump, and water is evaporated with an evaporator; and a falling thin-film evaporator in which a liquid is allowed to flow into the evaporator from a top of a vertical heater, and subjected to evaporation and concentration by forming homogeneous liquid film on the inner wall of the heater during falling. These evaporators may be used alone or together for multiple effects. A flash evaporating device in which water is evaporated by ejecting a liquid heated to a temperature of a boiling point or higher in the evaporator under reduced pressure is also effective.

Since the first preparation liquid used in this embodiment produces crystals of the water-soluble salt along with the concentration, the scales are likely to deposit in the concentrator. Therefore, it is more preferable to use a concentrator having a function that can remove the deposited scales, or a concentrator having a structure in which scales are less likely to deposit. A former device includes a device in which the above-described falling thin-film evaporator is equipped with agitation impellers for scraping off the scales, for instance, Wiplen (manufactured by Shinko Pantec Co., Ltd.). A latter device includes Losco evaporator (manufactured by SUMITOMO HEAVY INDUSTRIES, LTD.) which comprises a plate-type heating element in the inner portion thereof, in which concentration is carried out by allowing to flow a liquid on a surface of this heating element under reduced pressure.

7-1-3. Precipitation by Reduction of Dissolved Amount by Temperature Adjustment of First Preparation Liquid The process for precipitating the water-soluble salt mentioned above has been studied. As a result, a process of precipitating the water-soluble salt by changing the temperature of the first preparation liquid so as to lower the dissolved amount of the water-soluble salt has been found. In other words, a large number of microcrystals can be precipitated in the preparation liquid by temperature-adjustment so as to lower the dissolving amount of the water-soluble salt in the first preparation liquid, thereby allowing to precipitate the water-soluble salt in a dissolved state in the presence of a water-soluble polymer. The precipitation by reduction of the dissolved amount by temperature-adjustment of the preparation liquid in this embodiment will be described in further detail.

A process of obtaining a second preparation liquid in which a part of the dissolved water-soluble salt is precipitated by changing the temperature of a first preparation liquid so as to lower the dissolved amount of the water-soluble salt in the first preparation liquid comprising a water-soluble polymer and a water-soluble salt will be described.

First, the first preparation liquid before the temperature-changing operation may be prepared by a known process. Also, when a water-insoluble substance is formulated, the water-insoluble substance may be formulated before the temperature-changing operation of the first preparation liquid, or after the temperature-changing operation. In addition, a part of the water-soluble polymer may be formulated in the second preparation liquid after the above operation. By the formulation, the size of the precipitated water-soluble salt crystals can be also adjusted. Also, the temperature-changing operation may be carried out to the second preparation liquid in the same manner as in the concentration operation.

The smaller the amount of the coarse particles of the undissolved water-soluble salt which are present in the first preparation liquid before the temperature-changing operation, the higher the supporting ability of the resulting particles for supporting a surfactant. Therefore, the dissolution rate of the water- soluble salt in the first preparation liquid before the temperature-changing operation is preferably from 50 to 100% by weight, more preferably from 70 to 100% by weight, especially preferably from 90 to 100% by weight. When the dissolution rate does not reach 100% by weight, there is a preferable embodiment where the undissolved substances are made finer by pulverizing the first preparation liquid by using the subsequently described wet pulverization device or the like. The wet pulverization of the preparation liquid may be carried out to the second preparation liquid after the temperature-changing operation. Here, the dissolution rate of the water-soluble salt is determined by the method described above.

Next, a part of the dissolved water-soluble salt is precipitated by changing the temperature of the first preparation liquid. A process of changing the temperature of the first preparation liquid includes a process of heating or cooling the first preparation liquid by using a device equipped with an external jacket, an internal coil, or the like when preparing the first preparation liquid, or the like.

It is preferable that the temperature of the first preparation liquid before the temperature-changing operation is set so that the dissolution rate of the water-soluble salt contained in the preparation liquid is high, and an optimal temperature is determined by the kinds and the amounts of the formulated water-soluble salt.

The temperature of the second preparation liquid after the temperature-changing operation is set so that the dissolution rate of the water-soluble salt in the preparation liquid is lowered, and selection of heating or cooling must be made depending upon the kinds and amounts of the formulated water-soluble salt. Sodium sulfate and sodium carbonate suitably used as detergent raw materials show a maximum dissolved amount near 40° C. Therefore, when these raw materials are used, it is preferable that the temperature of the first preparation liquid before the temperature-changing operation is adjusted to 40° C. or so, and that the temperature of the second preparation liquid after the temperature-changing operation is adjusted to 500 to 70° C.

Here, there is also a preferable embodiment in which the precipitation of the dissolved water-soluble salt is accelerated, for example, by subjecting the preparation liquid to flash concentration together with changing the temperature of the first preparation liquid.

7-2. Wet Pulverization of Water-Soluble Salt Particles in First Preparation Liquid This embodiment comprises (a) preparing a first preparation liquid comprising a solution or slurry comprising a water-soluble polymer and a water-soluble salt; and (b) subjecting water-soluble salt particles in the first preparation liquid to wet pulverization. In this embodiment, the first preparation liquid before wet pulverization may be prepared by a known process, and the water-soluble polymer and the water-soluble salt may be added in any order. A water-insoluble substance may be formulated before subjecting the first preparation liquid to wet pulverization, or it may be formulated after subjecting the first preparation liquid to wet pulverization. From the viewpoint of uniform dispersion by disintegrating the aggregated mass of the water-insoluble substance, it is preferable to formulate before the wet pulverization treatment. For instance, the calcium exchange speed of the crystalline aluminosilicate can be improved.

In addition, the finer the water-soluble salt particles which are present in the first preparation liquid are pulverized, the larger the effect of improving the supporting ability of the particles for supporting a surfactant obtainable in the subsequent spray-drying process.

The wet pulverization treatment of the first preparation liquid can utilize the water-soluble salt in the formation of supporting sites in the particles for supports obtainable in the subsequent spray-drying process by pulverizing the water-soluble salt particles in the preparation liquid. The wet pulverization has an especially large effect when a water-soluble solid derived from sodium carbonate is present in the first preparation liquid. As a concrete illustration, when burkeite, which is a compound salt derived from sodium carbonate, is formed in the first preparation liquid obtained by blending polycarboxylate polymer and sodium sulfate prior to blending with sodium carbonate, a majority of the burkeite is present as coarse particles formed on the surface of sodium carbonate added. Although the burkeite substantially does not contribute to the formation of the supporting sites in the particles for supports when being present as coarse particles, it can be effectively utilized in the formation of the supporting sites in the particles for supports by making them fine by wet pulverization, whereby the supporting ability of the particles is improved.

In addition, the advantages of a case where sodium carbonate is formulated in the first preparation liquid are as follows. In an embodiment where sodium carbonate is formulated in the preparation liquid by finely pulverizing by a dry-type pulverizer, the undissolved substances undesirably form coarse particles by aggregation upon hydration. However, in an embodiment where sodium carbonate is formulated in the first preparation liquid and thereafter the mixture is subjected to wet pulverization, the formation of the coarse particles by the aggregation described above can be suppressed.

Conditions for the wet pulverization treatment cannot be limited absolutely, as they depend on the concentration of the water-soluble salt in the first preparation liquid, the pulverizers used, and the like. The pulverizers which can be used in this embodiment may be any ones, as long as they are generally known wet pulverizers. The usually employed wet grinders include (i) devices in which fine pulverization is carried out by utilizing pulverization media; and (ii)

devices in which fine pulverization is carried out with a gap between a pulverization blade and a stator.

The device (i) includes a device in which pulverization is carried out with a shearing force caused by the difference between the flow rates of the media by supplying a solution to be treated from the bottom of the vessel, and discharging the solution to be treated from the top of the vessel, with stirring the media inside the vertical cylindrical vessel with agitation impellers and an agitation disc. Such continuous process-type devices include a sand grinder (manufactured by Igarashi Kikai Seizo K.K.), and a universal mill (manufactured by K.K. Mitsui Miike Seisakusho); and batch process-type devices include AQUAMIZER (manufactured by Hosokawa Micron Corporation). Horizontal continuous process-type devices having a similar structure include DYNOMILL (manufactured by WAB). Also included are those comprising a cylindrical rotor and an annular casing enveloping it, in which pulverization of a solution to be treated fed from the bottom center of a rotor is carried out by high-speed rotation force of the media, including DIAMOND FINE MILL (manufactured by Mitsubishi Heavy Industries, Ltd.), and KOBOL MILL (manufactured by Shinko Pantec Co., Ltd.).

The device (ii) includes those comprising a rotor and a stator each having grinding teeth, in which pulverization is carried out by repeatedly applying a shearing force when the solution to be treated is passed through the gap, including Colloid Mill (manufactured by Shinko Pantec Co., Ltd.), and Trigonal (manufactured by Mitsui Miike Machinery Co., Ltd.). Included are those having a similar grinding mechanism, except that a rotor and a stator is a grinding stone, including Glo-Mill (manufactured by K.K. Glo Engineering), Super Maskoroider (manufactured by Masuko Sangyo K.K.), and Corandom Mill (manufactured by Shinko Pantec Co., Ltd.). Also included is one in which the solution to be treated is roughly pulverized with a first turbine and a stator, and the roughly pulverized mixture is then finely pulverized with a second rotor and a stator, including Homomix Line Mill (manufactured by Tokushu KiKa Kogyo K.K.). Further included is one in which a dispersion effect of the level of high-pressure homogenizer can be attained by applying to the liquid a strong impact of the order of megahertz with a wet-type emulsification disperser having all of the functions of emulsification and dispersion, homogenous mixing, and finely powdering by a rotator having a peculiar shape and being high-speed rotated and a stator which is engaged therewith, including CABITRON (manufactured by PACIFIC MACHINERY & ENGINEERING Co., Ltd.).

7-3. Addition of Fine Particles to Preparation Liquid

This embodiment comprises (a) preparing a first preparation liquid comprising a solution or slurry comprising a water-soluble polymer and a water-soluble salt, and (b) adding to the first preparation liquid fine water-soluble salt particles, under the conditions that fine water-soluble salt particles are capable of being present without substantially being dissolved in the first preparation liquid. In this embodiment, the phrase "under the conditions that fine water-soluble salt particles are capable of being present without substantially being dissolved in the first preparation liquid" means that when the solution portion of the first preparation liquid is saturated, the added fine particles are not dissolved, and that when the solution portion is in an unsaturated state, the fine particles dissolve until the solution is saturated by the addition thereof, but once the saturation is reached, no more fine particles are dissolved. The fine water-soluble salt particles are those salts which are substantially the same as the water-soluble salt which remains undissolved in the first preparation liquid and/or the same salt as the water-soluble salt firstly precipitated and/or those salts having the smallest dissolving strength in the second preparation liquid.

In addition, the first preparation liquid before adding the fine water-soluble salt particles is prepared by a known process, and the water-soluble polymer and the water-soluble salt may be formulated in any order. When the water-insoluble substance is formulated, the water-insoluble substance may be formulated before addition of the fine particles to the first preparation liquid, or it may be formulated afterwards.

Here, as the fine water-soluble salt particles mentioned above, the fine particles having, substantially the same composition as the firstly precipitated water-soluble salt from the first preparation liquid are preferable. The phrase "the fine particles having substantially the same composition as the firstly precipitated water-soluble salt from the first preparation liquid" refers to fine particles having substantially the same composition as a substance precipitated when a part of moisture in the first preparation liquid before adding the fine particles is evaporated, and/or as a substance precipitated when the temperature is changed, when the water-soluble salt particles are not present in the first preparation liquid before addition of the fine particles. Here, as a process for preparing the fine particles, there can be considered to fine pulverization of the commercially available appropriate substances, and it is more preferable to form microcrystals in the presence of the water-soluble polymer. Concretely, a substance having the same composition as the fine particles is dissolved in water together with the water-soluble polymer, and is allowed to crystallize by spray-drying or the like, and the crystals are made fine with a pulverizer, to give fine particles. The fine pulverizers include roller mills, ball-mills, collision-type pulverizers, and the like. The roller mills include USV mill (manufactured by Ube Industries, Ltd.), MRS mill (manufactured by Mitsubishi Heavy Industries, Ltd.), SH mill (manufactured by IHI), and the like; the ball-mills include Dynamic Mill (manufactured by Mitsui Miike Machinery Co., Ltd.), Vibration Mill (manufactured by Chuo Kakoki Shoji K.K.), and the like; and the collision-type pulverizers include Atomizer, Pulverizer (both being manufactured by Fuji Paudal Co., Ltd.), and the like.

In addition, the smaller the average particle size of the fine particles, the larger the effect of improving the supporting ability of the particles for supporting a surfactant obtainable by spray-drying in the subsequent process.

From this viewpoint, the average particle size of the fine particles is preferably 40 $\mu$m or less, more preferably 35 $\mu$m or less, still more preferably 30 $\mu$m or less, still more preferably 25 $\mu$m or less, still more preferably 20 $\mu$m or less, still more preferably 15 $\mu$m or less, especially preferably 10 $\mu$ or less. Here, the average particle size is determined by the following method.

One-thousand grams of ethanol is weighed and placed into a 1-L stainless beaker, and stirred in a thermostat at 20° C. with rotating agitation impellers with 3 propeller wings of 2×4 cm at a speed of 200 r/min. Subsequently, 20 g of the fine particles mentioned above are supplied. The particle size distribution at a point of measuring for 10 minutes is determined in the same manner as described above by using the in-line type powder droplet monitoring system, manufactured by LASENTEC (TSUB-TEC M100). Here, a median code (particle size at which the cumulative value of the number of particles is 50%) is considered as an average particle size.

In addition, in the embodiments described above, regarding step (b), it is preferable that the treatment of increasing the number of the water-soluble salt particles comprises one or more processes selected from the group consisting of (1) adding a microcrystal-precipitating agent to the first preparation liquid; (2) concentrating the first preparation liquid; (3) adjusting a temperature of the first preparation liquid so that the dissolved amount of the water-soluble salt is lowered; (4) subjecting water-soluble salt particles in the first preparation liquid to wet pulverization; and (5) adding to the first preparation liquid fine water-soluble salt particles which may be the same as or different from the water-soluble salt in the first preparation liquid, under conditions that the fine water-soluble salt particles are capable of being present without substantially being dissolved in the first preparation liquid.

By carrying out the steps (a) and (b) in the embodiments as described above, the second preparation liquid is obtained.

8. Process for Preparing Cave-In Particle

It is preferable that in the particles for supports of the present invention, at least a part of particles is composed of a particle which is a cave-in particle having a structure that there exists a hollow, namely a cave-in hole, in an inner portion thereof, and that a particle surface is opened and communicated with the hollow in the inner portion. The particles for supports are prepared by providing holes with a very fine needle and the like from the surface to the inner portion of the particle to which a surfactant can be supported.

In addition, a process for effectively preparing the cave-in particle in the present invention includes a process comprising adjusting a surfactant content of the second preparation liquid mainly comprising a water-soluble polymer and a water-soluble salt obtained in the manner described above to from 0 to 2% by weight, and adjusting a water content of the second preparation liquid having an increased number of water-soluble salt particles to a range of from 35 to 65% by weight, and spray-drying the preparation liquid.

In the present invention, there is exhibited an effect that the content of the cave-in particle in the spray-dried particles is remarkably increased by adjusting the surfactant content and the water content of the second preparation liquid to the ranges as specified above, respectively, and increasing the number of the water-soluble salt particles in the second preparation liquid, namely by allowing the water-soluble salt to be present in an undissolved state.

The content of the surfactant in the second preparation liquid is from 0 to 2% by weight, preferably from 0 to 1% by weight, more preferably 0% by weight, from the viewpoint of increasing the content of the cave-in particle in the particles obtainable by spray-drying the preparation liquid.

The water content of the second preparation liquid is preferably from 35 to 65% by weight. In addition, the water content is 35% by weight or more, preferably 37% by weight or more, more preferably 39% by weight or more, still more preferably 41% by weight or more, especially preferably 43% by weight or more, most preferably 45% by weight or more, from the viewpoints of making the supporting capacity of the particles for supports larger and opening a cave-in hole of a sufficient size. Also, the water content is 65% by weight or less, preferably 62.5% by weight or less, more preferably 60% by weight or less, still more preferably 57.5% by weight or less, most preferably 55% by weight or less, from the viewpoint of suppressing the bursting of the droplets by the temperature elevation.

In addition, as contents of other components in the second preparation liquid, the water-soluble polymer is contained in an amount of preferably from 1 to 20% by weight, more preferably from 3 to 15% by weight, still more preferably from 5 to 10% by weight; the water-soluble salt is contained in an amount of preferably from 7 to 59% by weight, more preferably from 14 to 45% by weight, still more preferably from 20 to 35% by weight. Further, when the water-insoluble substance is contained, the water-insoluble substance is contained in an amount of preferably from 3 to 32% by weight, more preferably from 7 to 25% by weight, still more preferably from 10 to 18% by weight.

The preparation liquid having the composition described above may be those which are liquid-conveyable and non-curable. In addition, the addition method for each component and its order can be appropriately varied depending upon the conditions.

In addition, in the second preparation liquid, a part of the water-soluble salt is present in an undissolved state. In the present invention, there are advantages in the preparation liquid as described above in that a cave-in hole is generated in the particles for supports and a supporting ability for the liquid surfactant composition can be enhanced by allowing a part of the water-soluble salt to be present in an undissolved state.

The undissolved amount of the water-soluble salt is preferably from 0.5 to 15% by weight, more preferably from 1 to 11% by weight, still more preferably from 2 to 9% by weight, most preferably from 3 to 7% by weight, of the second preparation liquid. In addition, the undissolved water-soluble salt particles mentioned above (hereinafter also referred to as "undissolved substance") have an average particle size of preferably 80 $\mu$m or less, more preferably 60 $\mu$m or less, still more preferably 40 $\mu$m or less, especially preferably 30 $\mu$m or less, most preferably 20 $\mu$m or less.

Here, a process for allowing the undissolved substance to be present in the second preparation liquid includes, for instance, a means of adjusting the content of the water-soluble salt and the content of water to those within the ranges described above, a means of adjusting a temperature of the preparation liquid by considering the dissolved amount of the water-soluble salt, and the like. In addition, the means of making a particle size of the undissolved substance smaller includes means described above such as a means of adding fine water-soluble salt particles to a first preparation liquid, under conditions that the fine particles are capable of being present without substantially being dissolved in the first preparation liquid; a means of making its size smaller by a means of pulverizing or the like of undissolved substances of the first preparation liquid; a means of lowering a dissolved amount by varying a temperature of the first preparation liquid, thereby precipitating the crystals; a means of evaporating a part of moisture of the first preparation liquid, thereby precipitating the crystals; a means of formulating a microcrystal-precipitating agent to the first preparation liquid, thereby precipitating the crystals of the water-soluble salt which is dissolved therein, and the like.

Here, with regard to the determination of the undissolved amount of the water-soluble salt, the second preparation liquid is centrifuged, thereby collecting supernatant, namely the solution portion of the second preparation liquid. About 3 g of the solution is weighed with an accurate balance in an amount of a (g), and dried at 105° C. for 4 hours. Thereafter, the resulting solution is cooled in a desiccator for 30 minutes, and the dried remnant of the supernatant is weighed with an accurate balance in an amount of b (g). Here, the dissolved amount of the supernatant c (%) is calculated by:

$$\frac{b}{a-b} \times 100$$

Also, the content d (%) of the water-soluble salt contained in the dried remnant is analyzed. Using the water content e (%) of the second preparation liquid and the content f (%) of the water-soluble salt in the second preparation liquid, the undissolved amount (%) of the water-soluble salt is calculated by the following equation:

$$\begin{matrix}\text{Undissolved} \\ \text{Amount(\%)}\end{matrix} = f - e \times \frac{c}{100} \times \frac{d}{100} \qquad \text{(VII)}$$

In addition, with regard to the measurement of the average particle size of the undissolved water-soluble salt, the average particle size can be determined by using the in-line type powder droplet monitoring system (manufactured by LASENTEC, "TSUB-TEC M100") mentioned above.

The second preparation liquid is obtained by obtaining a first preparation liquid by a known process, and thereafter subjecting the preparation liquid to a treatment of increasing the number of the water-soluble salt particles mentioned above.

In the spray-drying process, a method for generating a cave-in particle in the particles for supports includes, though differences are caused in the optimal control ranges by the difference in the composition for the particles for supports, a means of controlling to a range of drying conditions suitable for the composition, and a means for controlling the water content of the second preparation liquid.

In the control for the drying conditions, it is preferable that conditions which quickly dry the sprayed droplets, namely a temperature of the periphery of the droplets immediately after spraying is preferably 85° C. or more, more preferably 90° C. or more, still more preferably 95° C. or more. However, from the viewpoint of thermal degradation of the constituents, the air blow temperature is preferably 400° C. or less, more preferably 350° C. or less, still more preferably 325° C. or less, especially preferably 300° C. or less.

9. Properties of Particles for Supporting Surfactant

The bulk density of the particles for supports of the present invention is preferably from 300 to 1000 g/L, more preferably from 350 to 800 g/L, still more preferably from 400 to 700 g/L, especially preferably from 450 to 600 g/L, from the viewpoint of securing the supporting capacity for the liquid surfactant composition and the viewpoint of securing the bulk density after supporting the liquid surfactant composition.

In addition, from the viewpoints of generation of fine powder dusts and dissolubility when using a detergent composition comprising detergent particles comprising particles for supports and a liquid surfactant composition supported thereby, the average particle size of the particles for supports is preferably from 140 to 600 μm, more preferably from 160 to 500 μm, still more preferably from 180 to 400 μm.

The supporting capacity for a preferable liquid surfactant composition to the particles for supports is 0.35 mL/g or more, more preferably 0.40 mL/g or more, especially preferably 0.45 mL/g or more, most preferably 0.50 mL/g or more, from the viewpoint of increasing the permitted range of the formulation amount of the liquid surfactant composition.

A preferable supporting rate of the particles for supports is preferably 0.2 mL/g or more, more preferably 0.3 mL/g or more, still more preferably 0.4 mL/g or more, from the viewpoint of more quickly and efficiently absorbing the liquid surfactant composition, thereby increasing the productivity.

The lower the water content of the particles for supports as determined by an infrared moisture meter, the better, from the viewpoint of making the supporting capacity for the liquid surfactant composition of the particles larger. The water content is preferably 14% by weight or less, more preferably 10% by weight or less, still more preferably 6% by weight or less.

Here, the bulk density, the average particle size, the supporting capacity for the liquid surfactant composition, the supporting rate, and the water content can be determined by the method described under the method for determining properties described below.

10. Composition and Properties of Detergent Particles

The detergent particles of the present invention comprise the surfactant for supports mentioned above and a surfactant composition supported therein.

In the surfactant composition, an anionic surfactant and a nonionic surfactant can be each used alone, and it is more preferable to use both surfactants in admixture. Especially in a case of using a nonionic surfactant having a melting point of 30° C. or less, it is preferable to use it in combination with a water-soluble nonionic organic compound (hereinafter referred to as "melting point-elevating agent") having a melting point of from 45° to 100° C. and a molecular weight of from 1000 to 30000, or an aqueous solution thereof, which has a function of elevating a melting point of this nonionic surfactant. Here, the melting point-elevating agent which can be used in the present invention includes, for instance, polyethylene glycols, polypropylene glycols, polyoxyethylene alkyl ethers, pluronic type nonionic surfactants, and the like. In addition, an amphoteric surfactant or a cationic surfactant can be also used in combination therewith in accordance with its purpose. Also, since an anionic surfactant such as an alkylbenzenesulfonate is formulated in the detergent particles in an amount of from 5 to 25% by weight, an effect of improving the dispersibility of the detergent particles in low-temperature water is exhibited.

As the surfactant composition, there can be used, for instance, one or more kinds selected from the group consisting of anionic surfactants, nonionic surfactants, cationic surfactants and amphoteric surfactants. The anionic surfactants are exemplified by alkylbenzenesulfonates; alkyl ether or alkenyl ether sulfates; α-olefinsulfonates; salts of α-sulfonated fatty acids or esters thereof; alkyl ether or alkenyl ether carboxylates, amino acid-type surfactants; N-acyl amino acid-type surfactants, and the like. Especially included are linear alkylbenzenesulfonates of which alkyl moiety has 10 to 14 carbon atoms; and alkyl sulfates or alkyl ether sulfates, of which each alkyl moiety has 10 to 18 carbon atoms. The counter ions are preferably alkali metals such as sodium and potassium, and amines such as monoethanolamine and diethanolamine.

Further, in order to obtain defoaming effects, a fatty acid salt can be used in combination therewith. The preferable number of carbon atoms of the fatty acid moiety is from 12 to 18.

The nonionic surfactants include polyoxyethylene alkyl or alkenyl ethers, polyoxyethylene alkyl- or alkenylphenyl ethers, polyoxyethylene-polyoxypropylene alkyl or alkenyl ethers, polyoxyethylene-polyoxypropylene glycols as represented by the trade name "pluronic," polyoxyethylene alkylamines, higher fatty acid alkanolamides, alkyl glucosides, alkyl glucosamides, alkylamine oxides, and the like. Among them, those having high hydrophilicity and those having a low forming ability of liquid crystals or having no formation of liquid crystals when mixed with water are preferable, and the polyoxyalkylene alkyl or alkenyl ethers are especially preferable. Preferable are ethylene oxide (hereinafter simply "EO) adducts of which alcohol moiety has 10 to 18 carbon atoms, preferably 12 to 14 carbon atoms, and an average mole of ethylene oxide of 5 to 30 moles, preferably 7 to 30 moles, more preferably 9 to 30 moles, still more preferably 11 to 30 moles. Besides, the EO adducts and propylene oxide (PO) adducts are preferable, each of which alcohol moiety has 8 to 18 carbon atoms. As the order of addition, there can be employed embodiments including an embodiment of adding EO, and thereafter adding PO; an embodiment of adding PO, and thereafter adding EO; or an embodiment of adding randomly EO and PO. Especially preferable order of addition includes an embodiment of adding EO, thereafter adding PO in a block form, and further adding EO in a block form to give a compound represented by the general formula:

$$R—O—(EO)_X—(PO)_Y(EO)_Z—H$$

wherein R is a hydrocarbon group, preferably an alkyl group or an alkenyl group; EO is an oxyethylene group; PO is an oxypropylene group; and X, Y and Z are each average moles thereof, among which most preferable average moles have the relations of X>0; Z>0; X+Y+Z=6 to 14; X+Z=5 to 12; and Y=1 to 4.

The cationic surfactants include quaternary ammonium salts such as alkyl timethyl ammonium salts.

The amphoteric surfactants are exemplified by carbobetain-type and sulfobetain-type surfactants and the like.

The formulation amount of the anionic surfactant is preferably from 0 to 300 parts by weight, more preferably from 20 to 200 parts by weight, especially preferably from 30 to 180 parts by weight, based on 100 parts by weight of the nonionic surfactant. The formulation amount of the melting point-elevating agent of the nonionic surfactant is preferably from 1 to 100 parts by weight, more preferably from 5 to 50 parts by weight, based on 100 parts by weight of the nonionic surfactant. In the above range, the composition is preferable, because the composition has a temperature range so that the viscosity of the composition at a temperature of a pour point or higher is adjusted to 10 Pa·s or less, preferably 5 Pa·s or less, especially preferably 2 Pa·s or less, and also has a temperature range so that the inserting hardness of the composition in the temperature range lower than the pour point of the composition and higher than the melting point of the nonionic surfactant is 10 kPa or more, preferably 30 kPa more, especially preferably 50 kPa or more, whereby the handleability of the composition and the detergent particles during production becomes excellent, and the bleed-out of the nonionic surfactant during storage of the detergent particles can be suppressed.

The values for the properties of the surfactant composition can be determined by the following method. The pour point can be measured by the method according to JIS K 2269. The melting point is determined by using FP800 Thermosystem "Mettler FP81" (manufactured by Mettler Instrumente AG) and heating at a heating rate of 0.2° C./min. The viscosity is obtained by measuring with a B-type viscometer ("DVM-B model" manufactured by TOKYO KEIKI), rotor No. 3 under the condition of 60 r/min. In addition, when the measurement value under the above conditions exceeds 2 Pa·s, to be undeterminable, the viscosity is obtained by measuring with rotor No. 3, under the condition of 12 r/min. The inserting hardness is a value obtained by determining a load when an adaptor is inserted for 20 mm at an inserting rate of 20 mm/min into an inner portion of the surfactant composition by using a rheometer ("NRM-3002D" manufactured by Fudo Kogyo K.K.) and a disc-shaped adaptor (No. 3, 8ϕ) having a diameter of 8 mm and a bottom area of 0.5 $cm^2$, and dividing the resulting load by the bottom area of the disc-shaped adaptor.

The amount of the surfactant composition is preferably in a range of from 10 to 100 parts by weight, more preferably in a range of from 20 to 80 parts by weight, especially preferably in a range of from 30 to 60 parts by weight, based on 100 parts by weight of the particles for supports, from the viewpoints of the detergency and the dissolubility. The "amount of the surfactant composition" as referred to herein does not include the amount of the surfactant even if the surfactant were added to the preparation liquid.

When the surfactant composition is mixed with the particles for supports, powdery raw materials other than the particles may be added as desired, and the amount thereof is preferably from 0 to 150 parts by weight, based on 100 parts by weight of the particles. The powdery raw materials include, for instance, aluminosilicates, crystalline silicates such as SKS-6 (manufactured by Clariant), and the like.

In addition, the detergent particles can contain the water-soluble polymer, the water-soluble salt, the water-insoluble substance, and other components, each of which is exemplified in the particles for supports as components other than the above-mentioned surfactant composition. In a case where a water-insoluble substance is used, the crystalline silicates described below and the like can be also contained.

Here, when the detergent particles are prepared by using components such as a surfactant which can serve as a binder, and powdery raw materials, the detergent particles are coated, with an aggregated layer formed by the above components, so that there may be some cases where the shape of the particles for supports cannot be confirmed simply from their external appearance. A method of differentiating the shape of the particles for supports in such cases includes a method of confirming the shape by extracting an organic solvent-soluble component from the detergent particles, thereby separating the particles for supports. The kinds of the organic solvents used in extraction are appropriately selected depending upon the kinds of the binder substances bound to each constituent unit of the detergent particle.

The method for confirmation of a shape of the particles for supporting a surfactant by solvent extraction will be illustrated hereinbelow.

Fifteen grams of the detergent particles which are accurately sample-reduced and weighed are subjected to reflux operation for 1 hour with 300 mL of 95% ethanol heated in a water bath. Thereafter, an ethanol-insoluble component is gradually filtered off by means of suction filtration with sufficiently washing with hot ethanol. The separated ethanol-insoluble component is dried for 24 hours under reduced pressure, and thereafter the insoluble component is cautiously collected so as not to disintegrate the particle structure of the insoluble component. Such an operation is carried out several times, to obtain 100 g of an ethanol-insoluble component. The resulting ethanol-insoluble component is vibrated for 10 minutes with standard sieves according to JIS Z 8801. Thereafter, the weight on each sieve is measured, and the particle classified in accordance with each sieve-opening mentioned above is observed and analyzed, to confirm whether or not the resulting particles are the particles for supports of the present invention, or to confirm the absence or presence of an ethanol-insoluble component added in subsequent steps. In a case where the ethanol-insoluble component added to the particles for supports in subsequent steps is confirmed in the separated ethanol-insoluble component, the average particle size of the particles for supports is obtained by eliminating the factors influencing the particle size distribution by the subsequent steps of addition. Specifically, the separation operation of the solvent-insoluble component is carried out by a properly selected solvent, or a combination thereof, so that the shape of the particles for supports can be confirmed after removing the surfactant composition and the components added in the subsequent steps.

The preferable properties of the detergent particles according to the present invention are as follows.

The bulk density is preferably from 500 to 1000 g/L, more preferably from 600 to 1000 g/L, especially preferably from 650 to 850 g/L.

The average particle size is preferably from 150 to 500 $\mu$m, more preferably from 180 to 400 $\mu$m.

11. Process for Preparing Detergent Particles

A preferable process for preparing detergent particles comprises the following step (I), and it may further comprise step (II) as occasion demands.

Step (I): mixing a surfactant composition with the particles for supporting a surfactant obtained in the process of the present invention, under condition that the surfactant composition is in a liquid or pasty state.

Step (II): mixing the mixture obtained in step (I) with a surface coating agent, thereby coating the surface of the powder detergent particles with the surface coating agent, provided that there is also included a case where step (II) proceeds simultaneously with the disintegration.

<Step (I)>

A process for supporting a surfactant composition by the particles for supports includes, for instance, a process comprising mixing the particles for supports with a surfactant composition by using a mixer for a batch process or continuous process. In the case of mixing by a batch process, as a process of supplying to a mixer, there may be employed such processes as (1) a process comprising previously supplying particles for supports in a mixer, and thereafter adding thereto a surfactant composition; (2) a process comprising supplying particles for supports and a surfactant composition in the mixer in small amounts at a time; (3) a process comprising supplying a part of particles for supports in a mixer, and thereafter supplying the remaining particles for supports and a surfactant composition in the mixer in small amounts at a time, and the like.

Among the surfactant compositions, those which are present as solids or pasty states even if heated within a practical temperature range, for instance, from 500 to 90° C., are previously dispersed or dissolved in a nonionic surfactant having low viscosity, an aqueous solution of a nonionic surfactant, or water, to prepare a liquid mixture or aqueous solution of a surfactant composition, to be added to the particles for supports in the form of a liquid mixture or aqueous solution. By this process, those surfactant compositions which are present as solids or pasty form can be easily added to the particles for supports. The mixing ratio of the surfactant composition having a low viscosity or water to the solid or pasty surfactant composition is preferably such that the resulting liquid mixture or aqueous solution has a viscosity range of which is sprayable.

The process for preparing the above liquid mixture includes, for instance, a process for mixing by supplying a solid or pasty surfactant composition to a surfactant having a low viscosity or water; or a process for preparing a liquid mixture of a surfactant composition by neutralizing an acid precursor of a surfactant, for instance, an acid precursor of an anionic surfactant, with an alkalizing agent, for instance, an aqueous sodium hydroxide or an aqueous potassium hydroxide, in a surfactant having a low viscosity or water.

Also, in this step, an acid precursor of an anionic surfactant can be also added before adding a surfactant composition, simultaneously with adding a surfactant composition, in the course of adding a surfactant composition, or after adding a surfactant composition. By adding the acid precursor of an anionic surfactant, there can be achieved improvements in properties and quality, such as high concentration of the surfactants, supporting ability of particles for supports, control for the supporting ability thereof, and suppression of bleed-out of the nonionic surfactant and the flowability, of the resulting detergent particles.

The acid precursor of an anionic surfactant which can be used in the present invention includes, for instance, alkylbenzenesulfonic acids, alkyl ether or alkenyl ether sulfuric acids, alkyl- or alkyenylsulfuric acids, $\alpha$-olefinsulfonic acids, $\alpha$-sulfonated fatty acids, alkyl ether or alkenyl ether carboxylic acids, fatty acids, and the like. It is especially preferable that the fatty acid is added after adding the surfactant, from the viewpoint of improvement in the flowability of the detergent particles.

The amount of the acid precursor of an anionic surfactant used is preferably from 0.5 to 30 parts by weight, more preferably from 1 to 20 parts by weight, still more preferably from 1 to 10 parts by weight, especially preferably from 1 to 5 parts by weight, based on 100 parts by weight of the particles for supports. Here, the amount of the acid precursor used is not counted as the amount of the surfactant composition in the present invention. In addition, as the process for adding the acid precursor of an anionic surfactant, it is preferable that those in a liquid state at an ordinary temperature are supplied by spraying, and that those in a solid state at an ordinary temperature may be added as a powder, or they may be supplied by spraying after melting the solid. Here, in a case of adding the acid precursor as a powder, it is preferable that the temperature of the detergent particles in the mixer is raised to a temperature at which the powder melts.

Preferable mixers are concretely as follows. In a case of mixing by a batch process, those of (1) to (3) are preferable: (1) Henschel Mixer (manufactured by Mitsui Miike Machinery Co., Ltd.); High-Speed Mixer (Fukae Powtec Corp.); Vertical Granulator (manufactured by Powrex Corp.); Lodige Mixer (manufactured by Matsuzaka Giken Co., Ltd.); PLOUGH SHARE Mixer (manufactured by PACIFIC MACHINERY & ENGINEERING Co., LTD.); mixers disclosed in Japanese Patent Laid-Open Nos. Hei 10-296064 and Hei 10-296065, and the like; (2) Ribbon Mixer (manufactured by Nichiwa Kikai Kogyo K.K.); Batch Kneader (manufactured by Satake Kagaku Kikai Kogyo K.K.); Ribocone (manufactured by K.K. Okawahara Seisakusho), and the like; (3) Nauta Mixer (manufactured by Hosokawa Micron Corp.), SV Mixer (Shinko Pantec Co., Ltd.), and the like. Among the above-mentioned mixers, preferable are Lodige Mixer, PLOUGH SHARE Mixer, and the mixers disclosed in Japanese Patent Laid-Open Nos. Hei 10-296064 and Hei 10-296065, and the like. Since step (II) described below can be carried out by the same mixer, these mixers are preferable from the viewpoint of simplification of equipments. Especially, the mixers disclosed in Japanese Patent Laid-Open Nos. Hei 10-296064 and Hei 10-296065 are preferable, because the moisture and temperature of the mixture can be regulated by aeration, whereby the disintegration of the particles for supporting a surfactant can be suppressed. In addition, mixers, such as Nauta Mixer, SV Mixer and Ribbon Mixer, which are capable of mixing powders with liquids without applying a strong shearing force, are preferable from the viewpoint that the disintegration of the particles for supporting a surfactant can be suppressed.

Also, the particles for supports may be mixed with a surfactant composition by using the above-mentioned continuous process-type mixer. Also, the continuous process-type mixer other than those listed above includes Flexo Mix (manufactured by Powrex Corp.), Turbulizer (manufactured by Hosokawa Micron Corporation), and the like.

In addition, in this step, when a nonionic surfactant is used, it is preferable that a water-soluble nonionic organic compound (hereinafter referred to as "melting point-elevating agent") having a melting point of from 45° to 100° C. and a molecular weight of from 1000 to 30000, or an aqueous solution thereof, which has a function of elevating a melting point of this nonionic surfactant, can be added before adding a surfactant composition, simultaneously with adding a surfactant composition, in the course of adding a surfactant composition, or after adding a surfactant composition, or previously mixed with a surfactant composition. By adding the melting point-elevating agent, the caking property of the detergent particles and the bleed-out property of the surfactants in the detergent particles can be suppressed. Here, the same ones as those exemplified in the melting point-elevating agent in the composition of the detergent particles described above can be used. The amount of the melting point-elevating agent used is preferably from 0.5 to 8 parts by weight, more preferably from 0.5 to 5 parts by weight, most preferably from 1 to 3 parts by weight, based on 100 parts by weight of the particles for supports. The above range is preferable from the viewpoints of the suppression of the aggregation between particles, the fast dissolubility, and the suppression of the bleed-out property and the caking property, each property of which is owned by the detergent particle contained in the detergent particles. A process for adding the melting point-elevating agent, comprising adding by previously mixing the melting point-elevating agent with a surfactant by an arbitrary process, or a process comprising adding a surfactant, and thereafter adding the melting point-elevating agent, is advantageous for the suppression of the bleed-out property and the caking property of the detergent particles.

As to the temperature within the mixer in this step, it is more preferable that mixing is carried out by heating to a temperature equal to or higher than the pour point of the surfactant. Incidentally, the pour point of the surfactant composition is measured according to the method of JIS K 2269. Here, the temperature to be heated may be a temperature higher than the pour point of the surfactant added in order to promote the support of the surfactant composition, and the practical temperature range is preferably from a temperature exceeding a pour point to a temperature higher than the pour point by 50° C., more preferably a temperature higher than the pour point by 10° to 30° C. In addition, in the case where an acid precursor of an anionic surfactant is added in this step, it is more preferable to mix the components after heating to a temperature at which the acid precursor of an anionic surfactant can react.

The mixing time in a batch process and the average residence time in the mixing in a continuous process for obtaining the suitable detergent particles are preferably from 1 to 20 minutes, more preferably from 2 to 10 minutes.

In addition, in the case where an aqueous solution of a surfactant or an aqueous solution of a water-soluble nonionic organic compound is added, a step of drying excess water contents during mixing and/or after mixing may be included.

A powdery surfactant and/or a powdery builder can also be added before adding a surfactant composition, simultaneously with adding a surfactant composition, in the course of adding a surfactant composition, or after adding a surfactant composition. By adding the powdery builder, the particle size of the detergent particles can be controlled, and an improvement in detergency can be achieved. Especially in the case where the acid precursor of an anionic surfactant is added, it is effective to add a powdery builder showing alkaline property prior to adding the acid precursor, from the viewpoint of accelerating the neutralization reaction. Incidentally, the term "powdery builder" mentioned herein refers to an agent for enhancing detergency other than surfactants which is in a powdery form, concretely, including base materials showing metal ion capturing ability, such as zeolite and citrates; base materials showing alkalizing ability, such as sodium carbonate and potassium carbonate; base materials having both metal ion capturing ability and alkalizing ability, such as crystalline silicates; other base materials enhancing ionic strength, such as sodium sulfate; and the like.

Here, as crystalline silicates, those described in Japanese Patent Laid-Open No. Hei 5-279013, column 3, line 17 (especially, those prepared by a process comprising calcinating and crystallizing at a temperature of from 500° to 1000° C. being preferable); Japanese Patent Laid-Open No. Hei 7-89712, column 2, line 45; and Japanese Patent Laid-Open No. Sho 60-227895, page 2, lower right column, line 18 (especially the silicates in Table 2 being preferable) can be used as powdery builders. Here, the alkali metal silicates having an $SiO_2/M_2O$ ratio, wherein M is an alkali metal, of from 0.5 to 3.2, preferably from 1.5 to 2.6, are favorably used.

The amount of the powdery builder used is preferably from 0.5 to 12 parts by weight, more preferably from 1 to 6 parts by weight, based on 100 parts by weight of the particles for supports. When the amount of the powdery builder for detergents used is in the above range, those having an excellent fast dissolubility are obtained.

Further, subsequent to step (I), it is preferable to add step (II) comprising surface-modifying the detergent particles.

<Step (II)>

In the present invention, in order to modify the particle surface of the detergent particles by which the surfactant is supported in step (I), the embodiments for addition may include a process comprising one or more steps of step (II) comprising adding various surface coating agents such as (1) fine powder, and (2) a liquid material.

Since the flowability and the anti-caking property of the detergent particles tend to improve by coating the particle surface of the detergent particles of the present invention, it is preferable to include a surface-modifying step. The devices used in step (II) are preferably those equipped with both agitation blades and disintegration blades among the mixers exemplified in step (I). Each of the surface coating agents will be explained below.

(1) Fine Powder

As the fine powder, it is preferable that the average particle size of its primary particle is 10 μm or less, more preferably from 0.1 to 10 μm. When the particle size is in the above range, it is favorable from the viewpoints of the improvements in the coating ratio of the particle surface of the detergent particles, and improvements in the flowability and the anti-caking property of the detergent particles. The average particle size of the fine powder can be measured by a method utilizing light scattering by, for instance, a particle analyzer (manufactured by Horiba, LTD.), or it may be measured by a microscopic observation or the like. In addition, it is preferable that the fine powder has a high ion exchange capacity or a high alkalizing ability from the aspect of detergency.

The fine powder is desirably aluminosilicates, which may be crystalline or amorphous. Besides them, fine powders of sodium sulfate, calcium silicate, silicon dioxide, bentonite, talc, clay, amorphous silica derivatives, crystalline silicates, and the like are preferable. In addition, there can be also similarly used a metal soap of which primary particles have a size of 0.1 to 10 μm, a powdery surfactant (for instance, alkylsulfates, and the like), or a water-soluble organic salt. In addition, when the crystalline silicate is used, it is preferably used in admixture with fine powder other than the crystalline silicate for the purpose of preventing deterioration owing to aggregation of the crystalline silicates by moisture absorption and carbon dioxide absorption, and the like.

The amount of the fine powder used is preferably from 0.5 to 40 parts by weight, more preferably from 1 to 30 parts by weight, especially preferably from 2 to 20 parts by weight, based on 100 parts by weight of the detergent particles. When the amount of the fine powder used is in the above range, the flowability is improved, thereby giving a good sense of feel to consumers.

(2) Liquid Materials

The liquid materials include water-soluble polymers, fatty acids, and the like, which may be added in the form of aqueous solutions and molten states.

(2-1) Water-Soluble Polymer

The water-soluble polymer includes carboxymethyl celluloses, polyethylene glycols, polycarboxylates such as sodium polyacrylates and copolymers of acryl acid and maleic acid and salts thereof, and the like. The amount of the water-soluble polymer used is preferably from 0.5 to 10 parts by weight, more preferably from 1 to 8 parts by weight, especially preferably from 2 to 6 parts by weight, based on 100 parts by weight of the detergent particles. When the amount of the water-soluble polymer used is in the above range, the detergent particles exhibiting excellent dissolubility and excellent flowability and anti-caking properties can be obtained.

(2-2) Fatty Acid

The fatty acid includes, for instance, fatty acids having 10 to 22 carbon atoms, and the like. The amount of the fatty acid used is preferably from 0.5 to 5 parts by weight, especially preferably from 0.5 to 3 parts by weight, based on 100 parts by weight of the detergent particles. In a case of a fatty acid in a solid state at ordinary temperature, it is preferable that the fatty acid is heated to a temperature exhibiting flowability, and then supplied to the detergent particles by spraying.

12. Detergent Composition

The detergent composition in the present invention is a composition comprising the detergent particles described above, and the composition further comprises separately added detergent components other than the detergent particles (for instance, builder particles, fluorescent dyes, enzymes, perfumes, defoaming agents, bleaching agents, bleaching activators, and the like).

The content of the detergent particles in the detergent composition is preferably 50% by weight or more, more preferably 60% by weight or more, still more preferably 70% by weight or more, still more preferably 80% by weight or more, especially preferably 100% by weight.

The content of the detergent components other than the detergent particles in the detergent composition is preferably 50% by weight or less, more preferably 40% by weight or less, still more preferably 30% by weight or less, especially preferably 20% by weight or less.

13. Method for Measurement of Properties

The values for the properties in the present specification are measured by the following methods.

(Bulk Density): measured by a method according to JIS K 3362.

(Average Particle Size): measured using standard sieves according to JIS Z 8801. For example, nine-step sieves each having a sieve-opening of 2000 μm, 1400 μm, 1000 μm, 710 μm, 500 μm, 355 μm, 250 μm, 180 μm, and 125 μm, and a receiving tray are used, and the sieves and the receiving tray are attached to a rotating and tapping shaker machine (manufactured by HEIKO SEISAKUSHO, tapping: 156 times/min, rolling: 290 times/min). A 100 g sample is vibrated for 10 minutes to be classified. Thereafter, the mass base frequency is sequentially cumulated for each of sieve-on particles in the order of the receiving tray, and sieves having a sieve-opening of 125 μm, 180 μm, 250 μm, 355 μm, 500 μm, 710 μm, 1000 μm, 1400 μm, and 2000 μm. When a sieve-opening of a first sieve of which cumulative mass base frequency is 50% or more is defined as α μm, and a sieve-opening of one sieve-opening larger than α μm is defined as β μm, in the case where the cumulative mass base frequency from the receiving tray to α μm-sieve is defined as γ%, and the mass base frequency of particles on the α μm-sieve is defined as θ%, the average particle size can be calculated according to the following equation:

$$(\text{Average particle size})=10^{A}:$$

wherein $$A=\frac{50-\left(\gamma-\frac{\theta}{\log\beta-\log\alpha}\times\log\beta\right)}{\frac{\theta}{\log\beta-\log\alpha}}$$

(Particle Strength): A cylindrical vessel of an inner diameter of3 cm and a height of 8 cm is charged with 20 g of a sample, and the sample-containing vessel (manufactured by Tsutsui Rikagaku Kikai K.K., "Model TVP1" tapping-type close-packed bulk density measurement device; tapping conditions: period 36 times/minute, free flow from a height of 60 mm) is tapped for 30 times. The sample height (an initial sample height) at that time is measured. Thereafter, an entire upper surface of the sample kept in the vessel is pressed at a rate of 10 mm/min with a pressing machine to take measurements for a load-displacement curve. The slope of the linear portion at a displacement rate of 5% or less is multiplied by an initial sample height, and the resulting product is divided by a pressed area, to give a quotient which is defined as particle strength.

(Supporting Capacity and Supporting Rate of Liquid Surfactant Composition): A cylindrical mixing vessel of an inner diameter of 5 cm and a height of 15 cm which is equipped with agitation impellers in the inner portion thereof is charged with 100 g of the particles. With stirring the contents at 350 rpm, a polyoxyethylene alkyl ether ($C_{12}/C_{14}$=6/4; EO=7.7; melting point: 25° C.) is added dropwise at 30° C. at a rate of 10 mL/min, and the change of agitation torque with the passage of time is measured. A value obtained by dividing the amount of the polyoxyethylene alkyl ether supplied at a point where the agitation torque reaches the highest level by the weight (100 g) of the particles is defined as the supporting capacity (mL/g) of the particles. In addition, the supporting rate is expressed as a value (mL/g) obtained by dividing the amount of the polyoxyethylene alkyl ether supplied at a point where the amount of change per unit time is the largest in the process of increasing the agitation torque until the agitation torque exhibits the highest level by the weight (100 g) of the particles. The larger this numerical value, the more excellent the supporting rate, i.e. the more excellent the supporting rate of the particles, the more suppressed the excess polyoxyethylene alkyl ether is suppressed, thereby resulting in a delay in the time period for which the agitation torque is increased.

(Water Content): The water content of the particles is measured by infrared moisture meter method. Specifically, a 3 g sample is weighed and placed on a weighing dish of a known weight, and the sample is heated and dried for 3 minutes with an infrared moisture meter (manufactured by Kett Kagaku Kenkyujo K.K. (infrared ray lamp: 185 W)). After drying, the dried sample and the weighing dish are weighed. The water content in the sample is calculated by taking the difference in the weights of the container and the sample before and after drying obtained by the above operation, dividing the difference with the weight of the sample weighed, and multiplying the results with 100.

(Microporous Capacity Distribution): The microporous capacity of the particles for supporting a surfactant is determined as follows by using mercury porosimeter, "manufactured by SHIMADZU CORPORATION, "Poresizer 9320") in accordance with its instruction manual. Specifically, a cell is charged with 200 mg of particles for supporting a surfactant and the pressed mercury is measured separately for a low-pressure portion (0 to 14.2 psia) and a high-pressure portion (14.2 to 30000 psia). The leveling of the measurement data is carried out by taking an average of two each to obtain a mode diameter of 0.01 to 3 μm and a microporous capacity.

(Flowability): The flow time refers to a time period required for flowing 100 mL of detergent powder from a hopper used in a measurement of bulk density as defined in JIS K 3362.

(Anti-Caking Property): An open-top carton having dimensions of 10 cm in length, 6 cm in width, and 4 cm in height is made out of a Model No. 2 filter paper defined by JIS P 3801 (for instance, qualitative No. 2 filter paper, manufactured by Toyo Roshi K.K.). A 100 g sample is placed in this carton, and an acrylic resin plate and a lead plate (or an iron plate) with a total weight of 15 g+250 g are placed on the sample. The above carton is maintained in a thermostat kept at a temperature of 30° C. and at a humidity of 80%, and the caking conditions after 7 days are evaluated as explained below. The evaluation is made by obtaining the permeability as follows. The higher the permeability, the higher the anti-caking property, which is preferable properties as the detergent particles.

(Permeability): A sample obtained after the above test is gently placed on a sieve (sieve opening: 4760 μm, as defined by JIS Z 8801), and the weight of the powder passing through the sieve is measured. The permeability based on the sample after the test is calculated.

(Bleed-Out Property): An open-top carton having dimensions of 10 cm in length, 6 cm in width, and 4 cm in height is made out of a Model No. 2 filter paper defined by JIS P 3801 (for instance, qualitative No. 2 filter paper, manufactured by Toyo Roshi K.K.). A line with a width of 0.5 to 1.0 mm is diagonally drawn on the bottom surface of the carton, which is the surface of the packed sample, using a Magic Marker (manufactured by K.K. UCHIDA YOKO, "Magic Ink M700-T1"). A 100 g sample is packed in this carton, and an acrylic resin plate and a lead plate (or an iron plate) with a total weight of 15 g +250 g are placed on the sample. The carton is placed in a moisture-proof carton, and allowed to stand in a thermostat kept at a temperature of 30° C. After 7 days, the bleed-out property was evaluated by visually examining the degree of blur of the Magic Marker. The evaluation criteria are as follows.

Rank 5: Blurred width of the Magic Marker being 2 cm or more.

Rank 4: Blurred width of the Magic Marker being 1 cm or more.

Rank 3: Blurred width of the Magic Marker being 0.5 cm or more.

Rank 2: Slight blur of the Magic Marker being found.

Rank 1: No blur of the Magic Marker being found.

14. Process for Preparing Detergent Composition

The process for preparing a detergent composition is not particularly limited, and an example thereof include a process of mixing the detergent particles and separately added detergent components. Since the detergent composition obtained in the manner described above contain a detergent particle having a large supporting capacity of the surfactant, sufficient detergent effects can be exhibited even with a small amount. The application of such a detergent composition is not particularly limited, as long as it is applied to powder detergent, including, for instance, laundry powder detergents, detergents for dishwasher, and the like.

EXAMPLES

In the present examples, the following starting materials were used unless otherwise specified.

Sodium sulfate: anhydrous neutral sodium sulfate (manufactured by Shikoku Kasei K.K.)

Sodium sulfite: sodium sulfite (manufactured by MITSUI CHEMICALS, INC.)

Fluorescent dye: Tinopal CBS-X (manufactured by Ciba Specialty Chemicals)

Sodium carbonate: DENSE ASH (average particle size: 290 μm; manufactured by Central Glass Co., Ltd.)

40% By weight aqueous solution of sodium polyacrylate: weight-average molecular weight: 10000 (manufactured by Kao Corporation)

Sodium chloride: roast salt S (manufactured by Nippon Seien K.K.)

Crystalline sodium aluminosilicate (zeolite): TOYO-BUILDER (4A type; average particle size: 3.5 μm) (manufactured by Tosoh Corporation)

Polyoxyethylene alkyl ether: EMULGEN 108 KM (average moles of ethylene oxides: 8.5; number of carbon atoms in alkyl moiety: 12 to 14; manufactured by Kao Corporation)

Polyethylene glycol: K-PEG 6000 (weight-average molecular weight: 8500; manufactured by Kao Corporation)

Amorphous aluminosilicate: a product prepared by pulverizing the composition of Preparation Example 2 described in Japanese Patent Laid-Open No. Hei 9-132794 to an average particle size of 8 μm.

Example 1

A mixing vessel was charged with 375 parts by weight of water. After the water temperature reached 35° C., 127 parts by weight of sodium sulfate, 5 parts by weight of sodium sulfite, and 1 part by weight of a fluorescent dye were added thereto, and the resulting mixture was agitated for 10 minutes. One-hundred and twenty-seven parts by weight of sodium carbonate were added to the mixture, and 75 parts by weight of a 40% by weight aqueous solution of sodium polyacrylate were added thereto. The resulting mixture was agitated for 10 minutes, to give a first preparation liquid. Twenty-four parts by weight of sodium chloride, a microcrystal-precipitating agent, were added thereto, and the resulting mixture was agitated for 10 minutes. Further, 266 parts by weight of zeolite were added, and the resulting mixture was agitated for 30 minutes, to give a homogenous second preparation liquid (water content of slurry: 42% by weight). The final temperature of this preparation liquid was 40° C. The amount of the water-soluble inorganic salt precipitated by the addition of sodium chloride was 16.3% by weight of that dissolved in the first preparation liquid.

After the preparation of the first preparation liquid and 10 minutes after the addition of sodium chloride, a sample was taken from each of the preparation liquids, and the number of particles and the particle size distribution were determined by TSUB-TEC M100.

The number of particles in the first preparation liquid was 778 counts/s, and the average particle size (on a number basis) was 172 sum. The number of particles in the second preparation liquid after the addition of sodium chloride was 2634 counts/s, and the average particle size was 21.2 μm. From these determination results, the number of water-soluble salt was increased by 1856 counts/s by the addition of sodium chloride, and the average particle size of the increased water-soluble salt was 12.5 μm.

The second preparation liquid was fed to a spray-drying tower (countercurrent flow type) by a pump, and sprayed from a pressure-spray nozzle attached near the top of the tower at a spraying-pressure of 2.5 MPa. The high-temperature gas to be fed to the spray-drying tower was fed at a temperature of 200° C. from the bottom of the tower, and exhausted at 90° C. from the top of the tower. The water content of the resulting Particles for Supporting Surfactant 1 was 4% by weight. Detergent Particles 1 were prepared using Particles for Supporting Surfactant 1 by the method shown below.

A surfactant composition (polyoxyethylene alkyl ether/polyethylene glycol/sodium alkylbenzenesulfonate/water= 42/8/42/8 (weight ratio)) was adjusted to 80° C. Next, 100 parts by weight of the resulting Particles for Supporting Surfactant 1 were supplied into a Lodige Mixer (manufactured by Matsuzaka Giken Co., Ltd.; capacity: 130 L; equipped with a jacket), and the agitation of a main shaft (agitation impellers; rotational speed: 60 rpm; peripheral speed: 1.6 m/s) was started. Incidentally, hot water at 80° C. was allowed to flow through the jacket at 10 L/minute. Fifty parts by weight of the above surfactant composition were supplied into the above mixer in 2 minutes, and thereafter the resulting mixture was agitated for 5 minutes. Further, 6 parts by weight, as the minimum amount in which the bleed-out property of the detergent particles is to be evaluated as 1, of an amorphous aluminosilicate were supplied thereinto. The agitations of the main shaft (rotational speed: 120 rpm; peripheral speed: 3.1 m/s) and a chopper (rotational speed: 3600 rpm; peripheral speed: 28 m/s) were carried out for 1 minute, and Detergent Particles 1 were discharged.

Example 2

Particles for Supporting Surfactant 2 were obtained in the same manner as in Example 1. Detergent Particles 2 were prepared in the same manner as in Example 1 using Particles for Supporting Surfactant 2. The amount of an amorphous aluminosilicate supplied, as the minimum amount in which the bleed-out property of the detergent particles is to be evaluated as 1, was 4 parts by weight.

Comparative Example 1

Particles for Supporting Surfactant 3 were obtained in the same manner as in Example 1 except that sodium chloride, a microcrystal-precipitating agent, was added prior to the addition of a water-soluble salt, and agitated for 10 minutes to be completely dissolved. Detergent Particles 3 were prepared in the same manner as in Example 1 using the resulting Particles for Supporting Surfactant 3. However, in the case where the amorphous aluminosilicate was used in an amount of 6 parts by weight, the same amount as that of Example 1, Particles for Supporting Surfactant 3 did not sufficiently support the surfactant composition and became aggregated during the agitation in a Lodige Mixer, so that the values of the properties were deteriorated to an extent to be undeterminable.

Example 3

Particles for Supporting Surfactant 4 were obtained in the same manner as in Example 1 except that sodium bromide (manufactured by OTSUKA CHEMICAL CO., LTD) was used as a microcrystal-precipitating agent. The amount of the water-soluble inorganic salt precipitated by the addition of sodium bromide was 2.7% by weight of that dissolved in the first preparation liquid. Detergent Particles 4 were prepared in the same manner as in Example 1 using the resulting Particles for Supporting Surfactant 4. The amount of an amorphous aluminosilicate supplied, as the minimum amount in which the bleed-out property the detergent particles is to be evaluated as 1, was 7 parts by weight.

Comparative Example 2

Particles for Supporting Surfactant 5 were obtained in the same manner as in Comparative Example 1 except that sodium bromide (manufactured by OTSUKA CHEMICAL CO., LTD) was used as a microcrystal-precipitating agent. Detergent Particles 5 were prepared in the same manner as in Example 1 using the resulting Particles for Supporting Surfactant 5. However, in the case where the amorphous aluminosilicate was used in an amount of 7 parts by weight, the same amount as that of Example 3, Particles for Supporting Surfactant 5 did not sufficiently support the surfactant composition and became aggregated during the agitation in a Lodige Mixer, so that the values of the properties were deteriorated to an extent to be undeterminable.

The composition and the properties of each group of the resulting Particles for Supporting Surfactant 1 to 5 are shown in Table 1, and the properties of each group of Detergent Particles 1 to 5 are shown in Table 2. In Examples of the present invention, the particle size of the water-soluble salt precipitated in the slurry is made fine due to the effect of the microcrystal-precipitating agent. In addition, by increasing the amount of the microcrystal-precipitating agent, more water-soluble salt can be precipitated. Therefore, the particles for supporting a surfactant of the present invention (each group of Particles for Supporting Surfactant 1, 2 and 4) have a smaller mode diameter of microporous capacity distribution than that in Comparative Examples, thereby having a microporous capacity distribution advantageous for improvement in the supporting ability. For this reason, in the detergent particles of the present invention (each group of Detergent Particles 1, 2 and 4), the amount of the amorphous aluminosilicate could be reduced.

TABLE 1

| | Ex. 1 | Ex. 2 | Comp. Ex. 1 | Ex. 3 | Comp. Ex. 2 |
|---|---|---|---|---|---|
| Composition % By Weight | | | | | |
| Zeolite | 44.0 | 42.0 | 44.0 | 44.0 | 44.0 |
| Sodium Carbonate | 21.0 | 20.0 | 21.0 | 21.0 | 21.0 |
| Sodium Sulfate | 21.0 | 20.0 | 21.0 | 21.0 | 21.0 |
| Sodium Sulfite | 0.8 | 0.8 | 0.8 | 0.8 | 0.8 |
| Sodium Polyacrylate | 5.0 | 5.0 | 5.0 | 5.0 | 5.0 |
| Fluorescent Dye | 0.2 | 0.2 | 0.2 | 0.2 | 0.2 |
| Sodium Chloride | 4.0 | 8.0 | 4.0 | 0.0 | 0.0 |
| Sodium Bromide | 0.0 | 0.0 | 0.0 | 4.0 | 4.0 |
| Water | 4.0 | 4.0 | 4.0 | 4.0 | 4.0 |
| TOTAL | 100.0 | 100.0 | 100.0 | 100.0 | 100.0 |
| Operation | | | | | |
| Post-Addition of Microcrystal-Precipitating Agent | ○ | ○ | | ○ | |
| Concentration Operation | | | | | |
| Precipitation by Temperature Adjustment | | | | | |
| Slurry Pulverization | | | | | |
| Slurry | | | | | |
| Water Content of Slurry [%] | 42 | 42 | 42 | 42 | 42 |
| Temperature of Slurry [° C.] | 40 | 40 | 40 | 40 | 40 |
| Increased Amount of Undissolved Salt [%] | 16.3 | 32.5 | — | 3.0 | — |
| Particle Properties | | | | | |
| Average Particle Size [μm] | 250 | 253 | 245 | 240 | 242 |
| Bulk Density [g/L] | 601 | 603 | 599 | 607 | 610 |
| Particle Strength [MPa] | 29 | 34 | 28 | 32 | 30 |
| Supporting Capacity [mL/g] | 0.45 | 0.51 | 0.44 | 0.38 | 0.37 |
| Mode Diameter of Microporous Capacity Distribution [μm] | 0.81 | 0.67 | 1.63 | 0.78 | 1.58 |
| 0.01–3 μm [mL/g] | 0.32 | 0.34 | 0.29 | 0.33 | 0.29 |

TABLE 2

| | Ex. 1 | Ex. 2 | Comp. Ex. 1 | Ex. 3 | Comp. Ex. 2 |
|---|---|---|---|---|---|
| Composition of Detergent Parts by Weight | | | | | |
| Particles for Supporting Surfactant 1 | 100 | | | | |
| Particles for Supporting Surfactant 2 | | 100 | | | |
| Particles for Supporting Surfactant 3 | | | 100 | | |
| Particles for Supporting Surfactant 4 | | | | 100 | |
| Particles for Supporting Surfactant 5 | | | | | 100 |
| Surfactants | 50 | 50 | 50 | 50 | 50 |
| (Sodium Alkylbenzenesulfonate) | (21) | (21) | (21) | (21) | (21) |
| (Polyoxyethylene Alkyl Ether) | (21) | (21) | (21) | (21) | (21) |
| (Polyethylene Glycol) | (4) | (4) | (4) | (4) | (4) |
| (Water) | (4) | (4) | (4) | (4) | (4) |
| Amorphous Aluminosilicate | 6 | 4 | 6 | 7 | 11 |
| Properties | | | | | |
| Average Particle Size [μm] | 258 | 264 | Undeterminable | 262 | Undeterminable |
| Bulk Density [g/L] | 738 | 748 | Undeterminable | 745 | Undeterminable |
| Flowability [s] | 6.2 | 6.1 | Undeterminable | 6.2 | Undeterminable |
| Bleed-out Property | 1 | 1 | 5 | 1 | 5 |

Example 4

A mixing vessel equipped with a jacket comprising a pressure-reducing device and an agitator, was charged with 515 parts by weight of water and the temperature was raised to 35° C. One-hundred and eight parts by weight of sodium carbonate, 108 parts by weight of sodium sulfate, 4 parts by weight of sodium sulfite, 58 parts by weight of a 40% by weight aqueous solution of sodium polyacrylate, 1 part by weight of a fluorescent dye, and 206 parts by weight of zeolite were sequentially added thereto, and the resulting mixture was agitated for 30 minutes, to give a first preparation liquid in which water-soluble components were completely dissolved. The final temperature of this preparation liquid was adjusted to 60° C. (water content: 55% by weight).

Water was evaporated, with heating the first preparation liquid by allowing hot water at 65° C. to flow through the jacket under a reduced pressure of 100 Torr, to concentrate the liquid to a water content of 45% by weight. The amount of the water-soluble inorganic salt (average particle size: 18 μm) precipitated by the concentration operation was 25% by weight of that dissolved in the first preparation liquid.

The concentrated second preparation liquid was spray-dried in the same manner as in Example 1. The high-temperature gas to be supplied to the spray-drying tower was fed at a temperature of 220° C. from the bottom of the tower, and exhausted at 110° C. from the top of the tower. The water content of the resulting Particles for Supporting Surfactant 6 was 4% by weight.

Detergent Particles 6 were prepared in the same manner as in Example 1 using the resulting Particles for Supporting Surfactant 6. The amount of an amorphous aluminosilicate supplied, as the minimum amount in which the bleed-out property the detergent particles is to be evaluated as 1, was 1.5 parts by weight.

Example 5

Particles for Supporting Surfactant 7 were obtained in the same manner as in Example 4 except that a first preparation liquid having a water content of 50% by weight was prepared by adjusting the amount of water to be added, and that a second preparation liquid was obtained by concentrating the first preparation liquid to a water content of 45% by weight. The amount of the water-soluble inorganic salt (average particle size: 20 μm) precipitated in the second preparation liquid was 19% by weight of that dissolved in the first preparation liquid.

The number of particles and the particle size distribution before and after the concentration in the preparation liquid were determined by TSUB-TEC M100. Incidentally, in order to increase the accuracy of the determination, the determination was carried out using a liquid (water content of slurry: 64.9% by weight) corresponding to a first preparation liquid prepared in a separate mixing vessel without blending zeolite, and a liquid (water content of slurry: 60.1% by weight) corresponding to a second preparation liquid prepared by concentrating the liquid corresponding to a first preparation liquid. The number of particles in the liquid corresponding to a first preparation liquid was 426 counts/s, and the average particle size (on a number basis) was 114 μm. The number of particles in the liquid corresponding to a second preparation liquid after the concentration was 6351 counts/s, and the average particle size was 20.0 μm. From these determination results, the number of particles of the water-soluble salt was increased by 5925 counts/s by the concentration, and the average particle size of the increased water-soluble salt was 18.5 am.

Detergent Particles 7 were prepared in the same manner as in Example 1 using the resulting Particles for Supporting Surfactant 7. The amount of an amorphous aluminosilicate supplied, as the minimum amount in which the bleed-out property of the detergent particles is to be evaluated as 1, was 2.5 parts by weight.

Comparative Example 3

Particles for Supporting Surfactant 8 were obtained in the same manner as in Example 4 except that a preparation liquid having a water content of 45% by weight was prepared by adjusting the amount of water to be added, and that the concentration was not carried out. Detergent Particles 8 were prepared in the same manner as in Example 1 using the resulting Particles for Supporting Surfactant 8. The amount of an amorphous aluminosilicate supplied, as the minimum amount in which the bleed-out property of the detergent particles is to be evaluated as 1, was 8 parts by weight. In the case where the amorphous aluminosilicate was used in an amount of less than 8 parts by weight, the bleed-out property evaluated as 1 was not obtained.

Comparative Example 4

Particles for Supporting Surfactant 9 were obtained in the same manner as in Example 4 except that a preparation liquid having a water content of 55% by weight was prepared by adjusting the amount of water to be added, and that the concentration was not carried out. The water-soluble components in the preparation liquid were completely dissolved. Detergent Particles 9 were prepared in the same manner as in Example 1 using the resulting Particles for Supporting Surfactant 9. The amount of an amorphous aluminosilicate supplied, as the minimum amount in which the bleed-out property of the detergent particles is to be evaluated as 1, was 6 parts by weight. In the case where the amorphous aluminosilicate was used in an amount of less than 6 parts by weight, the bleed-out property evaluated as 1 was not obtained.

Example 6

A first preparation liquid was prepared in the same manner as in Example 4, and concentrated to a water content of 46% by weight. Subsequently, 19 parts by weight of sodium chloride, a microcrystal-precipitating agent, were further added thereto, and thereafter the resulting mixture was agitated for 30 minutes, to give a second preparation liquid (water content: 45% by weight). The amount of the water-soluble inorganic salt precipitated by the concentration operation and the addition of the microcrystal-precipitating agent was 35.7% by weight of that dissolved in the first preparation liquid.

The second preparation liquid was spray-dried in the same manner as in Example 1, to give Particles for Supporting Surfactant 10.

Detergent Particles 10 were prepared in the same manner as in Example 1 using the resulting Particles for Supporting Surfactant 10. Detergent Particles 10 had a sufficiently excellent flowability, and the level of the bleed-out property was evaluated as 1 without addition of an amorphous aluminosilicate.

Example 7

A first preparation liquid was prepared in the same manner as in Example 5, and thereafter Particles for Supporting Surfactant 11 were obtained in the same manner as in Example 6. Detergent Particles 11 were prepared in the same manner as in Example 1 using the resulting Particles for Supporting Surfactant 11. The amount of an amorphous aluminosilicate supplied, as the minimum amount in which the bleed-out property of the detergent particles is to be evaluated as 1, was 1 part by weight.

The composition and the properties of each group of the resulting Particles for Supporting Surfactant 6 to 11 are shown in Table 3, and the properties of each group of Detergent Particles 6 to 11 are shown in Table 4.

From the results shown in Tables 3 and 4, since each group of Particles for Supporting Surfactant 8 and 9 has a relatively low supporting ability, it was necessary to add a large amount of an amorphous aluminosilicate when trying to obtain detergent particles having an excellent bleed-out property using the particles.

On the other hand, since each group of Particles for Supporting Surfactant 6 and 7 obtained by the concentration operation has a mode diameter of microporous capacity distribution of 1.5 μm or less and a high supporting ability, detergent particles having an excellent bleed-out property could be obtained by using these groups of the particles, even in the case where the amount of the amorphous aluminosilicate was reduced. In addition, the supporting ability of the particles for supporting a surfactant could be further improved by carrying out both a concentration operation of slurry and addition of a microcrystal-precipitating agent.

TABLE 3

| | Ex. 4 | Ex. 5 | Comp. Ex. 3 | Comp. Ex. 4 | Ex. 6 | Ex. 7 |
|---|---|---|---|---|---|---|
| Composition % By Weight | | | | | | |
| Zeolite | 44.0 | 44.0 | 44.0 | 44.0 | 40.0 | 40.0 |
| Sodium Carbonate | 23.0 | 23.0 | 23.0 | 23.0 | 23.0 | 23.0 |
| Sodium Sulfate | 23.0 | 23.0 | 23.0 | 23.0 | 23.0 | 23.0 |
| Sodium Sulfite | 0.8 | 0.8 | 0.8 | 0.8 | 0.8 | 0.8 |
| Sodium Polyacrylate | 5.0 | 5.0 | 5.0 | 5.0 | 5.0 | 5.0 |
| Fluorescent Dye | 0.2 | 0.2 | 0.2 | 0.2 | 0.2 | 0.2 |
| Sodium Chloride | 0.0 | 0.0 | 0.0 | 0.0 | 4.0 | 4.0 |
| Sodium Bromide | 0.0 | 0.0 | 0.0 | 0.0 | 0.0 | 0.0 |
| Water | 4.0 | 4.0 | 4.0 | 4.0 | 4.0 | 4.0 |
| TOTAL | 100.0 | 100.0 | 100.0 | 100.0 | 100.0 | 100.0 |
| Operation | | | | | | |
| Post-Addition of Microcrystal-Precipitating Agent | | | | | ○ | ○ |
| Concentration Operation | ○ | ○ | | | ○ | ○ |
| Precipitation by Temperature Adjustment | | | | | | |
| Slurry Pulverization | | | | | | |
| Slurry | | | | | | |
| Water Content of Slurry [%] | 55→45 | 50→45 | 45 | 55 | 55→45 | 50→45 |
| Temperature of Slurry [° C.] | 60 | 60 | 60 | 60 | 60 | 60 |
| Increased Amount of Undissolved Salt [%] | 25 | 19 | — | — | 35.7 | 27 |
| Particle Properties | | | | | | |
| Average Particle Size [μm] | 280 | 265 | 235 | 210 | 264 | 258 |
| Bulk Density [g/L] | 615 | 600 | 600 | 480 | 601 | 605 |
| Particle Strength [MPa] | 28 | 28 | 28 | 17 | 30 | 30 |
| Supporting Capacity [mL/g] | 0.68 | 0.6 | 0.42 | 0.53 | 0.66 | 0.64 |
| Mode Diameter of Microporous Capacity Distribution [μm] | 0.82 | 0.96 | 1.8 | 2.2 | 0.55 | 0.54 |
| 0.01–3 μm [mL/g] | 0.37 | 0.36 | 0.35 | 0.47 | 0.38 | 0.37 |

TABLE 4

| | Ex. 4 | Ex. 5 | Comp. Ex. 3 | Comp. Ex. 4 | Ex. 6 | Ex. 7 |
|---|---|---|---|---|---|---|
| Composition of Detergent Parts by Weight | | | | | | |
| Particles for Supporting Surfactant 6 | 100 | | | | | |
| Particles for Supporting Surfactant 7 | | 100 | | | | |
| Particles for Supporting Surfactant 8 | | | 100 | | | |
| Particles for Supporting Surfactant 9 | | | | 100 | | |
| Particles for Supporting Surfactant 10 | | | | | 100 | |
| Particles for Supporting Surfactant 11 | | | | | | 100 |
| Surfactants | 50 | 50 | 50 | 50 | 50 | 50 |
| (Sodium Alkylbenzenesulfonate) | (21) | (21) | (21) | (21) | (21) | (21) |
| (Polyoxyethylene Alkyl Ether) | (21) | (21) | (21) | (21) | (21) | (21) |
| (Polyethylene Glycol) | (4) | (4) | (4) | (4) | (4) | (4) |
| (Water) | (4) | (4) | (4) | (4) | (4) | (4) |
| Amorphous Aluminosilicate | 1.5 | 2.5 | 8 | 6 | 0 | 1 |
| Properties | | | | | | |
| Average Particle Size [μm] | 300 | 280 | 245 | 230 | 271 | 268 |
| Bulk Density [g/L] | 740 | 740 | 730 | 660 | 742 | 743 |
| Flowability [s] | 6.3 | 6.3 | 6.3 | 6.4 | 6.3 | 6.3 |
| Bleed-out Property | 1 | 1 | 1 | 1 | 1 | 1 |

Example 8

A mixing vessel equipped with a jacket, comprising an agitator, was charged with 407 parts by weight of water, and hot water at 40° C. was allowed to flow through the jacket. One-hundred and thirty-two parts by weight of sodium sulfate, 5 parts by weight of sodium sulfite, and 1 part by weight of a fluorescent dye were added thereto, and the resulting mixture was agitated for 10 minutes. One-hundred and thirty-two parts by weight of sodium carbonate were added to the mixture, and 72 parts by weight of a 40% by weight aqueous solution of sodium polyacrylate and 252 parts by weight of zeolite were sequentially added thereto. The resulting mixture was agitated for 15 minutes, to give a first preparation liquid at 40° C.

Next, hot water at 60° C. was allowed to flow through the jacket, and the liquid mixture was agitated for 30 minutes, thereby adjusting the temperature of the preparation liquid to 60° C., to give a second preparation liquid. The viscosity of the preparation liquid was increased from 60 mPa·s to 1200 mPa·s by the heating operation. The amount of the water-soluble inorganic salt precipitated by the operation was 8.2% by weight of that dissolved in the first preparation liquid.

The resulting second preparation liquid was spray-dried in the same manner as in Example 1. The high-temperature gas to be fed to the spray-drying tower was fed at a temperature of 210° C. from the bottom of the tower, and exhausted at 105° C. from the top of the tower. The water content of the resulting Particles for Supporting Surfactant 12 was 4% by weight.

Detergent Particles 12 were prepared in the same manner as in Example 1 using the resulting Particles for Supporting Surfactant 12. The amount of an amorphous aluminosilicate supplied, as the minimum amount in which the bleed-out property of the detergent particles is to be evaluated as 1, was 6 parts by weight.

Example 9

A first preparation liquid at 40° C. was prepared under the same procedures as in Example 8. The preparation liquid was allowed to flow through a shell and tube-type heat exchanger, thereby raising the temperature of the preparation liquid to 70° C., to give a second preparation liquid. In the preparation liquid, precipitation of microcrystals of the water-soluble inorganic salt was confirmed. The viscosity of the preparation liquid was increased from 60 mPa·s to 2500 mPa·s by the heating operation. The amount of the water-soluble inorganic salt precipitated by the operation was 10.2% by weight of the amount dissolved in the first preparation liquid.

The number of particles and the particle size distribution before and after the concentration in the preparation liquid were determined by TSUB-TEC M100. Incidentally, the determination was carried out in the same manner as in Example 4, using a liquid corresponding to a first preparation liquid (water content of slurry: 60.1% by weight) prepared in a separate mixing vessel without blending zeolite, and a liquid corresponding to a second preparation liquid prepared by heating the liquid corresponding to a first preparation liquid to 70° C. The number of particles in the liquid corresponding to a first preparation liquid was 769 counts/s, and the average particle size (on a number basis) was 170 μm. The number of particles in the liquid corresponding to a second preparation liquid after raising the temperature was 8255 counts/s, and the average particle size was 28.0 μm. From these determination results, the number of particles of the water-soluble salt was increased by 7486 counts/s by the heating operation, and the average particle size of the increased water-soluble salt was 23.4 μm.

The resulting second preparation liquid was spray-dried in the same manner as in Example 1. The high-temperature gas to be fed to the spray-drying tower was fed at a temperature of 220° C. from the bottom of the tower, and exhausted at 110° C. from the top of the tower. The water content of the resulting Particles for Supporting Surfactant 2 was 4% by weight.

Detergent Particles 13 were prepared in the same manner as in Example 1 using the resulting Particles for Supporting Surfactant 13. The amount of an amorphous aluminosilicate supplied, as the minimum amount in which the bleed-out property of the detergent particles is to be evaluated as 1, was 5 parts by weight.

Comparative Example 5

A first preparation liquid at 40° C. was prepared under the same procedures as in Example 8, and the preparation liquid was spray-dried under the same conditions as in Example 8 without heating the preparation liquid, to give Particles for Supporting Surfactant 14. Detergent Particles 14 were prepared in the same manner as in Example 1 using the resulting Particles for Supporting Surfactant 14. The amount of an amorphous aluminosilicate supplied, as the minimum amount in which the bleed-out property of the detergent particles is to be evaluated as 1, was 8 parts by weight. When the amorphous aluminosilicate was used in an amount of less than 8 parts by weight, the bleed-out property evaluated as 1 was not obtained.

Comparative Example 6

Particles for Supporting Surfactant 15 were prepared in the same manner as in Comparative Example 5 except that a first preparation liquid at 70° C. was obtained by changing the temperature of hot water to be allowed to flow into the jacket to 70° C. Detergent Particles 15 were prepared in the same manner as in Example 1 using the resulting Particles for Supporting Surfactant 15. The amount of an amorphous aluminosilicate supplied, as the minimum amount in which the bleed-out property of the detergent particles is to be evaluated as 1, was 10 parts by weight. When the amorphous aluminosilicate was used in an amount of less than 10 parts by weight, the bleed-out property evaluated as 1 was not obtained.

Example 10

A first preparation liquid was prepared in the same manner as in Example 9. Next, the slurry was allowed to flow into a shell and tube-type heat exchanger, thereby raising the temperature of the preparation liquid to 70° C. Thereafter, a microcrystal-precipitating agent was further added thereto, to give a second preparation liquid. The amount of the water-soluble inorganic salt precipitated by the heating operation of the preparation liquid was 25.2% by weight of the amount dissolved in the first preparation liquid.

The resulting second preparation liquid was spray-dried in the same manner as in Example 1. The high-temperature gas to be fed to the spray-drying tower was fed at a temperature of 205° C. from the bottom of the tower, and exhausted at 95° C. from the top of the tower. The water content of the resulting Particles for Supporting Surfactant 16 was 4% by weight.

Detergent Particles 16 were prepared in the same manner as in Example 1 using the resulting Particles for Supporting Surfactant 16. The amount of an amorphous aluminosilicate supplied, as the minimum amount in which the bleed-out property of the detergent particles is evaluated as 1, was 3 parts by weight.

The composition, the properties and the like of each group of the resulting Particles for Supporting Surfactant 12 to 16 are shown in Table 5, and the properties of each group of Detergent Particles 12 to 16 are shown in Table 6.

From the results shown in Tables 5 and 6, since each group of Particles for Supporting Surfactant 14 and 15 has a relatively low supporting ability, it was necessary to add a large amount of an amorphous aluminosilicate when trying to obtain detergent particles having an excellent bleed-out property using the particles.

On the other hand, since each group of Particles for Supporting Surfactant 12 and 13 has a mode diameter of microporous capacity distribution of 1.5 μm or less and a high supporting ability, detergent particles having an excellent bleed-out property could be obtained by using these groups of the particles for supporting a surfactant, even when the amount of the amorphous aluminosilicate was reduced.

In addition, the supporting ability of the particles for supporting a surfactant could be further improved by carrying out both a concentration operation of slurry and addition of a microcrystal-precipitating agent.

TABLE 5

| | Ex. 8 | Ex. 9 | Comp. Ex.5 | Comp. Ex.6 | Ex. 10 |
|---|---|---|---|---|---|
| Composition % By Weight | | | | | |
| Zeolite | 44.0 | 44.0 | 44.0 | 44.0 | 40.0 |
| Sodium Carbonate | 23.0 | 23.0 | 23.0 | 23.0 | 23.0 |
| Sodium Sulfate | 23.0 | 23.0 | 23.0 | 23.0 | 23.0 |
| Sodium Sulfite | 0.8 | 0.8 | 0.8 | 0.8 | 0.8 |
| Sodium Polyacrylate | 5.0 | 5.0 | 5.0 | 5.0 | 5.0 |
| Fluorescent Dye | 0.2 | 0.2 | 0.2 | 0.2 | 0.2 |
| Sodium Chloride | 0.0 | 0.0 | 0.0 | 0.0 | 4.0 |
| Sodium Bromide | 0.0 | 0.0 | 0.0 | 0.0 | 0.0 |
| Water | 4.0 | 4.0 | 4.0 | 4.0 | 4.0 |
| TOTAL | 100.0 | 100.0 | 100.0 | 100.0 | 100.0 |
| Operation | | | | | |
| Post-Addition of Microcrystal-Precipitating Agent | | | | | ○ |
| Concentration Operation | | | | | ○ |
| Precipitation by Temperature Adjustment | ○ | ○ | | | |
| Slurry | | | | | |
| Water Content of Slurry [%] | 45 | 45 | 45 | 45 | 45 |
| Temperature of Slurry [° C.] | 40→60 | 40→70 | 40 | 70 | 40→70 |
| Increased Amount of Undissolved Salt [%] | 8.2 | 10.2 | — | — | 25.2 |
| Particle Properties | | | | | |
| Average Particle Size [μm] | 248 | 245 | 260 | 244 | 238 |
| Bulk Density [g/L] | 608 | 615 | 598 | 620 | 614 |
| Particle Strength [MPa] | 30 | 30 | 28 | 30 | 32 |
| Supporting Capacity [mL/g] | 0.47 | 0.49 | 0.42 | 0.38 | 0.55 |
| Mode Diameter of Microporous Capacity Distribution [μm] | 1.2 | 1.1 | 1.9 | 1.6 | 0.95 |
| 0.01–3 μm [mL/g] | 0.33 | 0.32 | 0.37 | 0.32 | 0.31 |

TABLE 6

| | Ex. 8 | Ex. 9 | Comp. Ex. 5 | Comp. Ex. 6 | Ex. 10 |
|---|---|---|---|---|---|
| Composition of Detergent Parts by Weight | | | | | |
| Particles for Supporting Surfactant 12 | 100 | | | | |
| Particles for Supporting Surfactant 13 | | 100 | | | |
| Particles for Supporting Surfactant 14 | | | 100 | | |
| Particles for Supporting Surfactant 15 | | | | 100 | |
| Particles for Supporting Surfactant 16 | | | | | 100 |
| Surfactants | 50 | 50 | 50 | 50 | 50 |
| (Sodium Alkylbenzenesulfonate) | (21) | (21) | (21) | (21) | (21) |
| (Polyoxyethylene Alkyl Ether) | (21) | (21) | (21) | (21) | (21) |
| (Polyethylene Glycol) | (4) | (4) | (4) | (4) | (4) |

TABLE 6-continued

| | Ex. 8 | Ex. 9 | Comp. Ex. 5 | Comp. Ex. 6 | Ex. 10 |
|---|---|---|---|---|---|
| (Water) | (4) | (4) | (4) | (4) | (4) |
| Amorphous Aluminosilicate | 6 | 5 | 8 | 10 | 3 |
| Properties | | | | | |
| Average Particle Size [μm] | 265 | 267 | 278 | 266 | 250 |
| Bulk Density [g/L] | 740 | 752 | 732 | 745 | 748 |
| Flowability [s] | 6.1 | 6.2 | 6.3 | 6.2 | 6.1 |
| Bleed-out Property | 1 | 1 | 1 | 1 | 1 |

Example 11

A first preparation liquid prepared in the same manner as in Comparative Example 1 was subjected to wet pulverization by COLLOID MILL, Model: MZ-80 (manufactured by SHINKO PANTEC CO., LTD.) at a flow rate of 800 kg/h.

The number of particles and the particle size distribution before and after the pulverization in the preparation liquid were determined by TSUB-TEC M100. Incidentally, during the determination, in the same manner as in Example 4, there were provided a liquid corresponding to a first preparation liquid prepared in a separate mixing vessel without blending zeolite, and a liquid corresponding to a second preparation liquid prepared by pulverizing the liquid corresponding to a first preparation liquid at a flow rate of 800 kg/h. The number of particles in the liquid corresponding to a first preparation liquid was 778 counts/s, and the average particle size (on a number basis) was 172 μm. The number of particles in the liquid corresponding to a second preparation liquid after the pulverization was 2648 counts/s, and the average particle size was 24.5 μm. From these determination results, the number of particles of the water-soluble salt was increased by 2476 counts/s by the pulverization. The pulverized second preparation liquid was spray-dried in the same manner as in Example 1. The high-temperature gas to be fed to the spray-drying tower was fed at a temperature of 200° C. from the bottom of the tower, and exhausted at 90° C. from the top of the tower. The water content of the resulting Particles for Supporting Surfactant 17 was 4%.

Detergent Particles 17 were prepared in the same manner as in Example 1 using the resulting Particles for Supporting Surfactant 17. The amount of an amorphous aluminosilicate supplied, as the minimum amount in which the bleed-out property of the detergent particles is to be evaluated as 1, was 8 parts by weight.

Example 12

A second preparation liquid prepared in the same manner as in Example 1 was subjected to wet pulverization by CAVITRON Model: CD1010 (manufactured by PACIFIC MACHINERY & ENGINEERING CO., LTD.) under the conditions of a rotational speed of 11200 rpm at a flow rate of 800 kg/h.

The number of particles and the particle size distribution before and after the pulverization in the preparation liquid were determined by TSUB-TEC M100. Incidentally, the determination was carried out in the same manner as in Example 11. The number of particles in the liquid corresponding to a first preparation liquid was 778 counts/s, and the average particle size was 172 μm. The number of particles in the preparation liquid before the pulverization was 2634 counts/s, and the average particle size (on a number basis) was 21.2 μm. The number of particles in the liquid corresponding to a second preparation liquid after the pulverization was 4675 counts/s, and the average particle size was 18.4 μm. From these determination results, the number of particles of the water-soluble salt was increased by 2041 counts/s by the pulverization.

The pulverized second preparation liquid was spray-dried in the same manner as in Example 1. In addition, the particle constituting the resulting supporting particles was analyzed for a cave-in hole. As a result, the particles were composed of 85% of cave-in particles, in which a hole having a projected area diameter of 2 to 70% of a projected area diameter of a particle and a depth of 10% or more of the projected area diameter of the particle was present at one or more points. In addition, the average value of $$\frac{\text{projected area diameter of hole}}{\text{projected area diameter of particle}} \times 100$$

of a cave-in hole for the above 90% of cave-in particles was 15%.

Detergent Particles 18 were prepared in the same manner as in Example 1 using the resulting Particles for Supporting Surfactant 18. The amount of an amorphous aluminosilicate supplied, as the minimum amount in which the bleed-out property of the detergent particles is to be evaluated as 1, was 5 parts by weight.

Example 13

A second preparation liquid having a water content of 45% by weight prepared in the same manner as in Example 5 was subjected to wet pulverization by COLLOID MILL, Model: MZ-80 at a flow rate of 800 kg/h.

The number of particles and the particle size distribution before and after the pulverization in the preparation liquid were determined by TUB-TEC M100. Incidentally, the determination was carried out before and after pulverizing a liquid corresponding to a second preparation liquid, which was prepared without blending zeolite in Example 5. The number of particles in the preparation liquid before the pulverization was 6351 counts/s, and the average particle size (on a number basis) was 20.0 μm. The number of particles in the liquid corresponding to a second preparation liquid after the pulverization was 8916 counts/s, and the average particle size was 17.0 μm. From these determination results, the number of particles of the water-soluble salt was increased by 2565 counts/s by the pulverization.

The pulverized second preparation liquid was spray-dried in the same manner as in Example 1. The high-temperature gas to be fed to the spray-drying tower was fed at a temperature of 220° C. from the bottom of the tower, and exhausted at 110° C. from the top of the tower. The water content of the resulting Particles for Supporting Surfactant 19 was 4%.

Detergent Particles 19 were prepared in the same manner as in Example 1 using the resulting Particles for Supporting Surfactant 19. The amount of an amorphous aluminosilicate supplied, as the minimum amount in which the bleed-out property of the detergent particles is to be evaluated as 1, was 0.5 parts by weight.

Example 14

A second preparation liquid at 70° C. prepared in the same manner as in Example 9 was subjected to wet pulverization by CAVITRON Model: CD1010 under the conditions of a rotational speed of 11200 rpm at a flow rate of 800 kg/h.

The number of particles and the particle size distribution before and after the pulverization in the preparation liquid were determined by TUB-TEC M100. Incidentally, the determination was carried out before and after pulverizing a liquid corresponding to a second preparation liquid, which was prepared without formulating zeolite in Example 9. The number of particles in the preparation liquid before the pulverization was 8255 counts/s, and the average particle size (on a number basis) was 28.0 μm. The number of particles in the liquid corresponding to a second preparation liquid after the pulverization was 11831 counts/s, and the average particle size was 20.3 μm. From these determination results, the number of particles of the water-soluble salt was increased by 3576 counts/s by the pulverization. The pulverized second preparation liquid was spray-dried in the same manner as in Example 1. The high-temperature gas to be fed to the spray-drying tower was fed at a temperature of 220° C. from the bottom of the tower, and exhausted at 110° C. from the top of the tower. The water content of the resulting Particles for Supporting Surfactant 20 was 4%.

Detergent Particles 20 were prepared in the same manner as in Example 1 using the resulting Particles for Supporting Surfactant 20. The amount of an amorphous aluminosilicate supplied, as the minimum amount in which the bleed-out property of the detergent particles is to be evaluated as 1, was 3.5 parts by weight.

The composition, the properties and the like of each group of the resulting Particles for Supporting Surfactant 17 to 20 are shown in Table 7, and the properties of each group of Detergent Particles 17 to 20 are shown in Table 8.

As shown in the results of Tables 7 and 8, by subjecting the particles of the water-soluble salt in a slurry to wet pulverization to increase the number of the particles, the supporting ability of the particles for supporting a surfactant could be improved, and the amount of the amorphous aluminosilicate could be reduced. In addition, the more the amount of undissolved substance in a slurry, the greater the effect of the improvement in the supporting ability of the particles for supporting a surfactant by wet pulverization.

TABLE 7

| | Ex. 11 | Ex. 12 | Ex. 13 | Ex. 14 |
|---|---|---|---|---|
| Composition % By Weight | | | | |
| Zeolite | 44.0 | 44.0 | 44.0 | 44.0 |
| Sodium Carbonate | 21.0 | 21.0 | 23.0 | 23.0 |
| Sodium Sulfate | 21.0 | 21.0 | 23.0 | 23.0 |
| Sodium Sulfite | 0.8 | 0.8 | 0.8 | 0.8 |
| Sodium Polyacrylate | 5.0 | 5.0 | 5.0 | 5.0 |
| Fluorescent Dye | 0.2 | 0.2 | 0.2 | 0.2 |
| Sodium Chloride | 4.0 | 4.0 | 0.0 | 0.0 |
| Sodium Bromide | 0.0 | 0.0 | 0.0 | 0.0 |
| Water | 4.0 | 4.0 | 4.0 | 4.0 |
| TOTAL | 100.0 | 100.0 | 100.0 | 100.0 |
| Operation | | | | |
| Post-Addition of Microcrystal-Precipitating Agent | | ○ | | |
| Concentration Operation | | | ○ | |
| Precipitation by Temperature Adjustment | | | | ○ |
| Slurry Pulverization | ○ | ○ | ○ | ○ |
| Slurry | | | | |
| Water Content of Slurry [%] | 42 | 42 | 50→45 | 45 |
| Temperature of Slurry [° C.] | 40 | 40 | 60 | 40→70 |

TABLE 7-continued

| | Ex. 11 | Ex. 12 | Ex. 13 | Ex. 14 |
|---|---|---|---|---|
| Increased Amount of Undissolved Salt [%] | — | 16.3 | 19 | 10.2 |
| Particle Properties | | | | |
| Average Particle Size [μm] | 240 | 252 | 258 | 244 |
| Bulk Density [g/L] | 604 | 605 | 602 | 610 |
| Particle Strength [MPa] | 31 | 31 | 30 | 30 |
| Supporting Capacity [mL/g] | 0.42 | 0.51 | 0.65 | 0.54 |
| Mode Diameter of Microporous Capacity Distribution [μm] | 1.05 | 0.76 | 0.56 | 0.92 |
| 0.01–3 μm [mL/g] | 0.3 | 0.32 | 0.36 | 0.32 |

TABLE 8

| | Ex. 11 | Ex. 12 | Ex. 13 | Ex. 14 |
|---|---|---|---|---|
| Composition of Detergent Parts by Weight | | | | |
| Particles for Supporting Surfactant 17 | 100 | | | |
| Particles for Supporting Surfactant 18 | | 100 | | |
| Particles for Supporting Surfactant 19 | | | 100 | |
| Particles for Supporting Surfactant 20 | | | | 100 |
| Surfactants | 50 | 50 | 50 | 50 |
| (Sodium Alkylbenzenesulfonate) | (21) | (21) | (21) | (21) |
| (Polyoxyethylene Alkyl Ether) | (21) | (21) | (21) | (21) |
| (Polyethylene Glycol) | (4) | (4) | (4) | (4) |
| (Water) | (4) | (4) | (4) | (4) |
| Amorphous Aluminosilicate | 8 | 5 | 0.5 | 3.5 |
| Properties | | | | |
| Average Particle Size [μm] | 251 | 267 | 273 | 256 |
| Bulk Density [g/L] | 743 | 741 | 750 | 755 |
| Flowability [s] | 6.2 | 6.2 | 6.1 | 6.3 |
| Bleed-out Property | 1 | 1 | 1 | 1 |

Example 15

A first preparation liquid having a water content of 51% by weight was prepared in the same manner as in Example 4, and subjected to wet pulverization by COLLOID MILL, Model: MZ-80 at a flow rate of 800 kg/h. Thereafter, the ground first preparation liquid was subjected up to a concentration operation to a water content of 48% by weight, to give a second preparation liquid. This second preparation liquid was spray-dried, to give Particles for Supporting Surfactant 21. Detergent Particles 21 were prepared in the same manner as in Example 1 using Particles for Supporting Surfactant 21. The amount of an amorphous aluminosilicate fed, as the minimum amount in which the bleed-out property of the detergent particles is to be evaluated as 1, was 7 parts by weight.

Comparative Example 7

A first preparation liquid having a water content of 48% by weight was prepared in the same manner as in Example 15, and spray-dried without carrying out wet pulverization and concentration, to give Particles for Supporting Surfactant 22. Detergent Particles 22 were prepared in the same manner as in Example 15 using Particles for Supporting Surfactant 22. However, in the case where the amorphous aluminosilicate was used in an amount of 7 parts by weight, the same amount as that of Example 15, Particles for Supporting Surfactant 22 did not sufficiently support the surfactant composition during the agitation in a Lodige Mixer, and became aggregated, so that the values of the properties were deteriorated to an extent to be undeterminable.

Example 16

A first preparation liquid having a water content of 48% by weight was prepared in the same manner as in Example 8, and subjected to wet pulverization by COLLOID MILL, Model: MZ-80 at a flow rate of 800 kg/h. Thereafter, the preparation liquid was heated to 70° C., to give a second-preparation liquid. This second preparation liquid was spray-dried, to give Particles for Supporting Surfactant 23. Detergent Particles 23 were prepared in the same manner as in Example 1 using Particles for Supporting Surfactant 23. The amount of an amorphous aluminosilicate supplied, as the minimum amount in which the bleed-out property of the detergent particles is to be evaluated as 1, was 7 parts by weight.

Comparative Example 8

A first preparation liquid having a water content of 48% by weight was prepared in the same manner as in Example 16, and spray-dried without carrying out wet pulverization and concentration, to give Particles for Supporting Surfactant 24. Detergent Particles 24 were prepared in the same manner as in Example 16 using Particles for Supporting Surfactant 24. However, in the case where the amorphous aluminosilicate was formulated in an amount of 7 parts by weight, the same amount as that of Example 16, Particles for Supporting Surfactant 24 did not sufficiently support the surfactant composition, so that the values of the properties of the detergent particles discharged from a Lodige Mixer were considerably deteriorated.

The composition, the properties and the like of each group of the resulting Particles for Supporting Surfactant 21 to 24 are shown in Table 9, and the properties of each group of Detergent Particles 21 to 24 are shown in Table 10.

From the results shown in Tables 9 and 10, the supporting ability of the particles for supporting a surfactant was improved, even when the concentration and the heating operation were carried out after subjecting the first preparation liquid to wet pulverization.

TABLE 9

| | Ex. 15 | Comp. Ex. 7 | Ex. 16 | Comp. Ex. 8 |
|---|---|---|---|---|
| Composition % By Weight | | | | |
| Zeolite | 40.0 | 40.0 | 40.0 | 40.0 |
| Sodium Carbonate | 13.0 | 13.0 | 36.0 | 36.0 |
| Sodium Sulfate | 36.0 | 36.0 | 13.0 | 13.0 |
| Sodium Sulfite | 0.8 | 0.8 | 0.8 | 0.8 |
| Sodium Polyacrylate | 6.0 | 6.0 | 6.0 | 6.0 |
| Fluorescent Dye | 0.2 | 0.2 | 0.2 | 0.2 |
| Sodium Chloride | 0.0 | 0.0 | 0.0 | 0.0 |

TABLE 9-continued

| | Ex. 15 | Comp. Ex. 7 | Ex. 16 | Comp. Ex. 8 |
|---|---|---|---|---|
| Sodium Bromide | 0.0 | 0.0 | 0.0 | 0.0 |
| Water | 4.0 | 4.0 | 4.0 | 4.0 |
| TOTAL | 100.0 | 100.0 | 100.0 | 100.0 |
| Operation | | | | |
| Post-Addition of Microcrystal-Precipitating Agent | | | | |
| Concentration Operation | ○ | | | |
| Precipitation by Temperature Adjustment | | | ○ | |
| Slurry Pulverization | ○ | | ○ | |
| Slurry | | | | |
| Water Content of Slurry [%] | 51→48 | 48 | 48 | 48 |
| Temperature of Slurry [° C.] | 50 | 50 | 40→70 | 40 |
| Increased Amount of Undissolved Salt [%] | 11.6 | — | 9 | — |
| Particle Properties | | | | |
| Average Particle Size [μm] | 225 | 205 | 210 | 198 |
| Bulk Density [g/L] | 545 | 551 | 505 | 460 |
| Particle Strength [MPa] | 22 | 16 | 17 | 12 |
| Supporting Capacity [mL/g] | 0.45 | 0.38 | 0.46 | 0.4 |
| Mode Diameter of Microporous Capacity Distribution [μm] | 1.12 | 1.89 | 1.2 | 1.5 |
| 0.01–3 μm [mL/g] | 0.33 | 0.28 | 0.36 | 0.38 |

TABLE 10

| | Ex. 15 | Comp. Ex. 7 | Ex. 16 | Comp. Ex. 8 |
|---|---|---|---|---|
| Composition of Detergent Parts by Weight | | | | |
| Particles for Supporting Surfactant 21 | 100 | | | |
| Particles for Supporting Surfactant 22 | | 100 | | |
| Particles for Supporting Surfactant 23 | | | 100 | |
| Particles for Supporting Surfactant 24 | | | | 100 |
| Surfactants | 50 | 50 | 50 | 50 |
| (Sodium Alkylbenzenesulfonate) | (21) | (21) | (21) | (21) |
| (Polyoxyethylene Alkyl Ether) | (21) | (21) | (21) | (21) |
| (Polyethylene Glycol) | (4) | (4) | (4) | (4) |
| (Water) | (4) | (4) | (4) | (4) |
| Amorphous Aluminosilicate | 7 | 7 | 7 | 7 |
| Properties | | | | |
| Average Particle Size [μm] | 243 | Undeter-minable | 231 | 240 |
| Bulk Density [g/L] | 721 | Undeter-minable | 702 | 623 |
| Flowability [s] | 6.2 | Undeter-minable | 6.2 | 8.6 |
| Bleed-out Property | 1 | 5 | 1 | 4 |

Example 17

Particles for Supporting Surfactant 25 were obtained in the same manner as in Example 12. Incidentally, as a 40% by weight aqueous solution of sodium polyacrylate, there was used one prepared according to the following method.

An amount 80.3 kg of water was supplied, and heated to 100° C. While keeping the temperature at 100° C., 190 kg (2.1 kmol) of 80% by weight acrylic acid and 3.9 kg (48.6 mol) of a 98% aqueous solution of 2-mercaptoethanol are added dropwise at a constant rate over 4 hours, and 5.0 kg (6.3 mol) of a 30% by weight aqueous sodium persulfate is added dropwise at a constant rate over 6 hours, to carry out polymerization. After the termination of the dropping polymerization, 21.1 kg (217.6 mol) of a 35% by weight aqueous solution of hydrogen peroxide is added dropwise over 1 hour for deodorization. Further, the resulting mixture is matured for 4 hours, and cooled. When the internal temperature is 60° C., 3.3 kg (11.5 mol) of a 35% by weight aqueous sodium hydrogensulfite is added as a reducing agent, and the resulting mixture is reacted for 1 hour. Thereafter, the mixture was cooled, and 167 kg (2 kmol) of a 48% by weight aqueous sodium hydroxide was added thereto, while keeping the temperature 40° C. or lower. Water was added to the resulting mixture, to give 485 kg of a desired 40% by weight aqueous solution of a polymer. The weight-average molecular weight of the resulting polymer was 10000.

Method for Molecular Weight Determination

1. Standard substance for calculation: polyacrylic acid (AMERICAN STANDARDS CORP)
2. Eluent: 0.2 mol/L phosphate buffer/$CH_3CN$: 9/1 (volume ratio)
3. Column: PWXL+G4000PWXL+G2500PWXL (manufactured by Tosoh Corporation)
4. Detector: RI
5. Sample concentration: 5 mg/mL
6. Injected amount: 0.1 mL
7. Temperature for determination: 40° C.
8. Flow rate: 1.0 mL/min In addition, the particle constituting the resulting supporting particles was analyzed for a cave-in hole. As a result, the particles were composed of 90% of cave-in particles, in which a hole having a projected area diameter of 2 to 70% of a projected area diameter of a particle and a depth of 10% or more of the projected area diameter of the particle was present at one or more points. In addition, the average value of $$\frac{\text{projected area diameter of hole}}{\text{projected area diameter of particle}} \times 100$$

of a cave-in hole for the above 90% of cave-in particles was 19%.

Detergent Particles 21 were prepared in the same manner as in Example 1 using the resulting Particles for Supporting Surfactant 25. Detergent Particles 25 had a sufficiently excellent flowability, and the level of the bleed-out property was evaluated as 1 without addition of an amorphous aluminosilicate.

Example 18

A first preparation liquid having a water content of 55% by weight was prepared in the same manner as in Example 6, and thereafter the first preparation liquid was subjected to a concentration operation up to a water content of 51% by weight. Further, a microcrystal-precipitating agent was added to adjust the preparation liquid to a water content of 50% by weight, and thereafter the resulting preparation liquid was spray-dried, to give Particles for Supporting Surfactant 26. Detergent Particles 26 were prepared in the same manner as in Example 1 using Particles for Supporting Surfactant 26. At this time, 55 parts by weight of a surfactant composition were supplied.

Detergent Particles 26 had a sufficiently excellent flowability, and the level of the bleed-out property was evaluated as 1 without addition of an amorphous aluminosilicate.

Comparative Example 9

Particles for Supporting Surfactant 27 were obtained in the same manner as in Comparative Example 1. Detergent Particles 27 were prepared in the same manner as in Example 17 using the resulting Particles for Supporting Surfactant 27. An amorphous aluminosilicate was not added in the same manner as in Example 17. However, since the supporting ability of Particles for Supporting Surfactant 27 is lower than that of Particles for Supporting Surfactant 25, Particles for Supporting Surfactant 27 did not sufficiently support the surfactant composition and became aggregated in a Lödige Mixer, so that the values of the properties were deteriorated to an extent to be undeterminable.

The composition and the properties of each group of the resulting Particles for Supporting Surfactant 25 to 27 are shown in Table 11, and the properties of each group of Detergent Particles 25 to 27 are shown in Table 12.

From the results shown in Tables 11 and 12, the supporting ability of the particles for supporting a surfactant can be further improved depending on the composition of particles for supporting a surfactant or the water content of the preparation liquid. Since each group of Particles for Supporting Surfactant 25 and 26 obtained according to the method of the present invention has a mode diameter of microporous capacity distribution of 1.5 μm or less and a high supporting ability, detergent particles having an excellent bleed-out property can be obtained by using these groups of particles without addition of an amorphous aluminosilicate, and a higher amount of the surfactant composition could be further formulated.

TABLE 11

| | Ex. 17 | Ex. 18 | Comp. Ex. 9 |
|---|---|---|---|
| Composition % By Weight | | | |
| Zeolite | 36.0 | 36.0 | 36.0 |
| Sodium Carbonate | 25.0 | 25.0 | 250 |
| Sodium Sulfate | 23.8 | 23.8 | 23 8 |
| Sodium Sulfite | 1.0 | 1.0 | 1.0 |
| Sodium Polyacrylate | 6.0 | 6.0 | 6.0 |
| Fluorescent Dye | 0.2 | 0.2 | 0.2 |
| Sodium Chloride | 4.0 | 4.0 | 4.0 |
| Sodium Bromide | 0.0 | 0.0 | 0.0 |
| Water | 4.0 | 4.0 | 4.0 |
| TOTAL | 100.0 | 100.0 | 100.0 |
| Operation | | | |
| Post-Addition of Microcrystal-Precipitating Agent | ○ | ○ | |
| Concentration Operation | | ○ | |
| Precipitation by Temperature Adjustment | | | |
| Slurry Pulverization | ○ | | |
| Slurry | | | |
| Water Content of Slurry [%] | 50 | 55→50 | 50 |
| Temperature of Slurry [° C.] | 50 | 60 | 50 |

TABLE 11-continued

| | Ex. 17 | Ex. 18 | Comp. Ex. 9 |
|---|---|---|---|
| Increased Amount of Undissolved Salt [%] | 11.7 | 24.1 | — |
| Particle Properties | | | |
| Average Particle Size [μm] | 259 | 263 | 250 |
| Bulk Density [g/L] | 542 | 548 | 579 |
| Particle Strength [MPa] | 30 | 36 | 15 |
| Supporting Capacity [mL/g] | 0.68 | 0.72 | 0.52 |
| Mode Diameter of Microporous Capacity Distribution [μm] | 0.81 | 0.48 | 1.63 |
| 0.01–3 μm [mL/g] | 0.43 | 0.45 | 0.5 |

TABLE 12

| | Ex. 17 | Ex. 18 | Comp. Ex. 9 |
|---|---|---|---|
| Composition of Detergent Parts by Weight | | | |
| Particles for Supporting Surfactant 25 | 100 | | |
| Particles for Supporting Surfactant 26 | | 100 | |
| Particles for Supporting Surfactant 27 | | | 100 |
| Surfactants | 50 | 55 | 50 |
| (Sodium Alkylbenzenesulfonate) | (21) | (23) | (21) |
| (Polyoxyethylene Alkyl Ether) | (21) | (23) | (21) |
| (Polyethylene Glycol) | (4) | (4.5) | (4) |
| (Water) | (4) | (4.5) | (4) |
| Amorphous Aluminosilicate | 0 | 0 | 5 |
| Properties | | | |
| Average Particle Size [μm] | 272 | 274 | Undeterminable |
| Bulk Density [g/L] | 738 | 743 | Undeterminable |
| Flowability [s] | 6.2 | 6.1 | Undeterminable |
| Bleed-out Property | 1 | 1 | 5 |

Example 19

A mixing vessel equipped with a jacket, comprising an agitator, was charged with 650 parts by weight of water. After the water temperature reached 35° C., 72 parts by weight of sodium carbonate, 194 parts by weight of sodium sulfate, and 83 parts by weight of a 40% by weight aqueous solution of sodium polyacrylate were sequentially added thereto. The resulting mixture was agitated for 30 minutes, to give a homogenous aqueous solution in which water-soluble components were completely dissolved (water content: 70% by weight).

The aqueous solution was spray-dried in the same manner as in Example 1. The high-temperature gas to be fed to the spray-drying tower was fed at a temperature of 230° C. from the bottom of the tower, and exhausted at 95° C. from the top of the tower. The water content of the resulting particle was 5% by weight.

The particle was subjected to dry pulverization using ATOMIZER, Model: EIIW-7.5 (manufactured by Fuji Paudal Co., Ltd.) under the conditions of the diameter of a screen mesh of 0.5 mm; a feed amount for pulverization of 60 kg/h; and a rotational speed of 5000 rpm, to give a fine powder having an average particle size of 5 μm (hereinafter referred to as a fine powder).

In addition, another mixing vessel equipped with a jacket, comprising an agitator, was charged with 462 parts by weight of water. After the water temperature reached 35° C., 95 parts by weight of sodium sulfate, 5 parts by weight of sodium sulfite, and 1 part by weight of a fluorescent dye were added thereto, and the resulting mixture was agitated for 10 minutes. One-hundred and twenty-three pauts by weight of sodium carbonate were added to the mixture, and 64 parts by weight of a 40% by weight aqueous solution of sodium polyacrylate were added thereto. The resulting mixture was agitated for 10 minutes. To this first preparation liquid, 52 parts by weight of the fine powder were added, and the resulting mixture was agitated for 10 minutes. Further, 198 parts by weight of zeolite were added thereto, and the resulting mixture was agitated for 30 minutes, to give a second preparation liquid (water content: 50% by weight). The final temperature of this second preparation liquid was 50° C.

After the preparation of the first preparation liquid and 10 minutes after the addition of the fine powder, a sample was taken from each of the preparation liquids, and the number of particles and the particle size distribution were determined by TSUB-TEC M100. In the first preparation liquid, an inorganic salt was entirely dissolved, so that the number of particles was hardly detected. The number of particles in the second preparation liquid after the addition of the fine powder was 4009 counts/s, and the average particle size was 10.5 μm.

The second preparation liquid was spray-dried in the same manner as in Example 1. The high-temperature gas to be fed to the spray-drying tower was fed at a temperature of 220° C. from the bottom of the tower, and exhausted at 110° C. from the top of the tower. The water content of the resulting Particles for Supporting Surfactant 28 was 4% by weight.

Detergent Particles 28 were prepared in the same manner as in Example 1 using the resulting Particles for Supporting Surfactant 28. The amount of an amorphous aluminosilicate supplied, as the minimum amount in which the bleed-out property of the detergent particles is to be evaluated as 1, was 3 parts by weight.

Comparative Example 10

Particles for Supporting Surfactant 29 were obtained in the same manner as in Example 19 except that a fine particle was not added. Detergent Particles 29 were prepared in the same manner as in Example 19 using the resulting Particles for Supporting Surfactant 29. However, when the amorphous aluminosilicate was added in an amount of 3 parts by weight, the same amount as that of Example 19, the particles for supporting a surfactant did not sufficiently support the surfactant composition and became aggregated in a Lodige Mixer, so that the values of the properties were deteriorated to an extent to be undeterminable.

The composition and the properties of each group of the resulting Particles for Supporting Surfactant 28 and 29 are shown in Table 13, and the properties of each group of Detergent Particles 28 and 29 are shown in Table 14.

Particles for Supporting Surfactant 29 of Comparative Example 10, in which a fine particle of a water-soluble salt is not added, have a poor particle strength and a large mode diameter of microporous capacity distribution. Therefore, bleeding-out of a surfactant composition, which was once absorbed in the particles for supporting a surfactant, due to disintegration of the particle, and the like, was found in the step of supporting the surfactant composition, so that the properties of the detergent particles were drastically deteriorated. On the other hand, since Particles for Supporting Surfactant 28 have a relatively high particle strength while having the same composition, and has a mode diameter of microporous capacity distribution of 1.5 μm or less and a high supporting ability, the amorphous aluminosilicate used was considerably reduced when using Particles for Supporting Surfactant 28.

TABLE 13

| | Ex. 19 | Comp. Ex. 10 |
|---|---|---|
| Composition % By Weight | | |
| Zeolite | 38.0 | 38.0 |
| Sodium Carbonate | 26.0 | 26.0 |
| Sodium Sulfate | 24.8 | 24.8 |
| Sodium Sulfite | 1.0 | 1.0 |
| Sodium Polyacrylate | 6.0 | 6.0 |
| Fluorescent Dye | 0.2 | 0.2 |
| Sodium Chloride | 0.0 | 0.0 |
| Sodium Bromide | 0.0 | 0.0 |
| Water | 4.0 | 4.0 |
| TOTAL | 100.0 | 100.0 |
| Operation | | |
| Post-Addition of Microcrystal-Precipitating Agent Concentration Operation Increased Amount of Undissolved Salt [%] Slurry Pulverization Addition of Fine Particle | ○ | |
| Slurry | | |
| Water Content of Slurry [%] | 50 | 50 |
| Temperature of Slurry [° C.] | 50 | 50 |
| Increased Amount of Undissolved Salt [%] | 23.3 | — |
| Particle Properties | | |
| Average Particle Size [μm] | 255 | 269 |
| Bulk Density [g/L] | 510 | 461 |
| Particle Strength [MPa] | 25 | 12 |
| Supporting Capacity [mL/g] | 0.57 | 0.44 |
| Mode Diameter of Microporous Capacity Distribution [μm] | 0.88 | 1.85 |
| 0.01–3 μm [mL/g] | 0.48 | 0.4 |

TABLE 14

| | Ex. 19 | Comp. Ex. 10 |
|---|---|---|
| Composition of Detergent Parts by Weight | | |
| Particles for Supporting Surfactant 28 | 100 | |
| Particles for Supporting Surfactant 29 | | 100 |
| Surfactants | 50 | 50 |
| (Sodium Alkylbenzenesulfonate) | (21) | (21) |
| (Polyoxyethylene Alkyl Ether) | (21) | (21) |
| (Polyethylene Glycol) | (4) | (4) |
| (Water) | (4) | (4) |

TABLE 14-continued

| | Ex. 19 | Comp. Ex. 10 |
|---|---|---|
| Amorphous Aluminosilicate | 3 | 8 |
| Properties | | |
| Average Particle Size [μm] | 270 | Undeterminable |
| Bulk Density [g/L] | 723 | Undeterminable |
| Flowability [s] | 6.3 | Undeterminable |
| Bleed-out Property | 1 | 5 |

Example 20

A mixing vessel was charged with 430 parts by weight of water. After the water temperature reached 35° C., 108 parts by weight of sodium sulfate, 5 parts by weight of sodium sulfite, and 2 parts by weight of a fluorescent dye were added thereto, and the resulting mixture was agitated for 10 minutes. One-hundred and fifteen parts by weight of sodium carbonate were added to the mixture, and 150 parts by weight of a 40% by weight aqueous solution of sodium polyacrylate were added thereto. The resulting mixture was agitated for minutes, to give a first preparation liquid. Forty parts by weight of sodium chloride, which was a microcrystal-precipitating agent, were added thereto, and the resulting mixture was agitated for 10 minutes. Subsequently, the mixture was subjected to wet pulverization by COLLOID MILL, Model: MZ-80 at a flow rate of 800 kg/h. Thereafter, 150 parts by weight of zeolite were added, and the resulting mixture was agitated for 30 minutes, to give a homogenous second preparation liquid (water content of slurry: 52% by weight). The final temperature of this preparation liquid was 50° C. The amount of the water-soluble inorganic salt precipitated by the addition of sodium chloride was 17.8% by weight of that dissolved in the first preparation liquid.

After the preparation of the first preparation liquid, 10 minutes after the addition of sodium chloride, and after the pulverization of the preparation liquid, a sample was taken from each of the preparation liquids, and the number of particles and the particle size distribution were determined by TSUB-TEC M100. The number of particles in the first preparation liquid was 557 counts/s, and the average particle size (on a number basis) was 125 μm. The number of particles in the preparation liquid after the addition of sodium chloride was 3798 counts/s, and the average particle size was 20.5 μm, From these determination results, the number of microcrystals was increased by 3241 counts/s by the addition of sodium chloride, and the average particle size of the increased microcrystals was 17.0 μm. In addition, the number of particles in the second preparation liquid after the pulverization was 5438 counts/s, and the average particle size was 18.2 μm. The number of particles of the water-soluble salt was additionally increased by 1640 counts/s by the pulverization.

Spray-drying was carried out in the same manner as in Example 12, to give Particles for Supporting Surfactant 30. Detergent Particles 30 were prepared using Particles for Supporting Surfactant 30 by the method shown below.

A surfactant composition (polyoxyethylene alkyl ether/polyethylene glycol/sodium alkylbenzenesulfonate/water=25/5/25/5 (weight ratio)) was adjusted to 80° C. Next, 100 parts by weight of the resulting particles for supporting a surfactant were supplied into a Lodige Mixer (manufactured by Matsuzaka Giken Co., Ltd.; capacity: 130 L; equipped with a jacket), and the agitation of a main shaft (agitation impellers; rotational speed: 60 rpm; peripheral speed: 1.6 m/s) was started. Incidentally, hot water at 80° C. was allowed to flow through the jacket at 10 L/minute. Sixty parts by weight of the above surfactant composition were supplied into the above mixer in 2 minutes, and thereafter the resulting mixture was agitated for 5 minutes. Further, 20 parts by weight of a crystalline silicate, and zeolite were supplied thereinto. The agitations of the main shaft (rotational speed: 120 rpm; peripheral speed: 3.1 m/s) and a chopper (rotational speed: 3600 rpm; peripheral speed: 28 m/s) were carried out for 1 minute, and Detergent Particles 30 were discharged. The minimum amount of zeolite in which the bleed-out property of the detergent particles is to be evaluated as I was 3 parts by weight.

Example 21

Particles for Supporting Surfactant 31 were obtained in the same manner as in Example 20 except that a 40% by weight aqueous solution of sodium polyacrylate was supplied together with water when a first preparation liquid was prepared. Detergent Particles 31 were prepared in the same manner as in Example 20 using the resulting Particles for Supporting Surfactant 31. Incidentally, Detergent Particles 31 had a sufficiently excellent flowability, and the level of the bleed-out property was evaluated as 1 without addition of zeolite.

Comparative Example 11

Particles for Supporting Surfactant 32 were obtained in the same manner as in Example 1 except that a microcrystal-precipitating agent was not added. Detergent Particles 32 were prepared in the same manner as in Example 20 using the resulting Particles for Supporting Surfactant 32. The minimum amount of zeolite in which the bleed-out property of the detergent particles is to be evaluated as 1 was 16 parts by weight.

Comparative Example 12

Particles for Supporting Surfactant 33 were obtained in the same manner as in Comparative Example 11 except that a 40% by weight aqueous solution of sodium polyacrylate was supplied together with water when a first preparation liquid was prepared. Detergent Particles 33 were prepared in the same manner as in Example 20 using the resulting Particles for Supporting Surfactant 33. The ninimum amount of zeolite in which the bleed-out property of the detergent particles is to be evaluated as 1 was 13 parts by weight.

The composition and the properties of each group of the resulting Particles for Supporting Surfactant 30 to 33 are shown in Table 15, and the properties of each group of Detergent Particles 30 to 33 are shown in Table 16.

In the present examples, when using the technique according to the present invention, the supporting ability of the particles for supporting a surfactant was improved, and the amount of zeolite for surface-modifying could be dramatically reduced, even in the case where the amount of the polymer formulated was increased. In addition, at the time of preparing the first preparation liquid, when the water-soluble polymer was added prior to adding of sodium carbonate, the supporting ability of the particles for supporting a surfactant was improved. However, its effect was small, as compared to the effect of the improvement in the supporting ability by the technique according to the present invention.

TABLE 15

| | Ex. 20 | Ex. 21 | Comp. Ex. 11 | Comp. Ex. 12 |
|---|---|---|---|---|
| Composition % By Weight | | | | |
| Zeolite | 30.0 | 30.0 | 30.0 | 30.0 |
| Sodium Carbonate | 23.0 | 23.0 | 27.0 | 27.0 |
| Sodium Sulfate | 21.6 | 21.6 | 25.6 | 25.6 |
| Sodium Sulfite | 1.0 | 1.0 | 1.0 | 1.0 |
| Sodium Polyacrylate | 12.0 | 12.0 | 12.0 | 12.0 |
| Fluorescent Dye | 0.4 | 0.4 | 0.4 | 0.4 |
| Sodium Chloride | 8.0 | 8.0 | 0.0 | 0.0 |
| Sodium Bromide | 0.0 | 0.0 | 0.0 | 0.0 |
| Water | 4.0 | 4.0 | 4.0 | 4.0 |
| TOTAL | 100.0 | 100.0 | 100.0 | 100.0 |
| Operation | | | | |
| Post-Addition of Microcrystal-Precipitating Agent Concentration Operation | ○ | ○ | | |
| Increased Amount of Undissolved Salt [%] | | | | |
| Slurry Pulverization | ○ | ○ | | |
| Slurry | | | | |
| Water Content of Slurry [%] | 52 | 52 | 52 | 52 |
| Temperature of Slurry [° C.] | 50 | 50 | 50 | 50 |
| Increased Amount of Undissolved Salt [%] | 17.8 | 18.6 | — | — |
| Particle Properties | | | | |
| Average Particle Size [μm] | 255 | 248 | 244 | 243 |
| Bulk Density [g/L] | 536 | 525 | 503 | 512 |
| Particle Strength [MPa] | 35 | 35 | 21 | 23 |
| Supporting Capacity [mL/g] | 0.62 | 0.68 | 0.52 | 0.54 |
| Mode Diameter of Microporous Capacity Distribution [μm] | 0.72 | 0.68 | 2.20 | 1.80 |
| 0.01–3 μm [mL/g] | 0.49 | 0. 49 | 0.47 | 0.47 |

TABLE 16

| | Ex. 20 | Ex. 21 | Comp. Ex. 11 | Comp. Ex. 12 |
|---|---|---|---|---|
| Composition of Detergent Parts by Weight | | | | |
| Particles for Supporting Surfactant 30 | 100 | | | |
| Particles for Supporting Surfactant 31 | | 100 | | |
| Particles for Supporting Surfactant 32 | | | 100 | |
| Particles for Supporting Surfactant 33 | | | | 100 |
| Surfactants | 60 | 60 | 60 | 60 |
| (Sodium Alkylbenzenesulfonate) | (25) | (25) | (25) | (25) |
| (Polyoxyethylene Alkyl Ether) | (25) | (25) | (25) | (25) |
| (Polyethylene Glycol) | (5) | (5) | (5) | (5) |
| (Water) | (5) | (5) | (5) | (5) |
| Zeolite | 3 | 0 | 15 | 12 |
| Crystalline Silicate | 20 | 20 | 20 | 20 |
| Properties | | | | |
| Average Particle Size [μm] | 263 | 255 | 261 | 257 |
| Bulk Density [g/L] | 716 | 725 | 680 | 694 |
| Flowability [s] | 6 | 6.1 | 6.5 | 6.4 |
| Bleed-out Property | 1 | 1 | 1 | 1 |

Example 22

Particles for Supporting Surfactant 34 were obtained in the same manner as in Example 1. Incidentally, as a 40% by weight aqueous solution of sodium polyacrylate, there was used one prepared according to the method described in Examples of Japanese Examined Patent Publication No. Hei 2-24283. The reaction was carried out by supplying an aqueous solution of sodium acrylate having a neutralization degree of 95% and a concentration of 37.7% by weight at a rate of 3.11 kg/h, and supplying an aqueous solution of sodium hydrogensulfite having a concentration of 35% by weight at a rate of 0.13 kg/h, at an average temperature of the jacket of 20° C. with an air feeding rate of 3 $m^3$/h. The weight-average molecular weight was 10000. In addition, the particle constituting the resulting particles for supporting a surfactant was analyzed for a cave-in hole. As a result, the particles were composed of 91% of cave-in particles, in which a hole having a projected area diameter of 2 to 70% of a projected area diameter of a particle and a depth of 10% or more of the projected area diameter of the particle was present at one or more points. In addition, the average value of $$\frac{\text{projected area diameter of hole}}{\text{projected area diameter of particle}} \times 100$$

of a cave-in hole for the above 91% of cave-in particles was 17%. Also, the average value for the depth of the cave-in hole was 55% of the projected area diameter of the particle. The composition and the values of the properties of the resulting particles for supporting a surfactant are shown in Table 17. Incidentally, the absorbency of the liquid surfactant composition determined by the above-described method was expressed as a great value of 0.45 mL/g, so that the liquid surfactant composition was excellent in the absorbency.

Comparative Example 13

Particles for Supporting Surfactant 35 were obtained in the same manner as in Comparative Example 3. Incidentally, "NEOPELEX F-65" (manufactured by Kao Corporation) was used as a 50% by weight aqueous solution of sodium alkylbenzenesulfonate. In the first preparation liquid, which was used for spray-drying, the water-soluble salt was completely dissolved. In addition, the particle constituting the resulting supporting particles was analyzed for a cave-in hole. As a result, there were substantially no cave-in particles, in which a hole having a projected area diameter of 2 to 70% of a projected area diameter of a particle and a depth of 10% or more of the projected area diameter of the particle was present at one or more points. The composition and the values of the properties of the resulting particles for supporting a surfactant are listed in Table 17. Incidentally, the absorbency of the liquid surfactant composition determined by the above-described method was as small as 0.10 mL/g, indicating that the liquid surfactant composition was poor in the absorbency.

Each group of Detergent Particles 34 and 35 was obtained by adding a surfactant to each group of Particles for Supporting Surfactant 34 and 35 of Example 22 and Comparative Example 13 at a ratio shown in Table 18, to support the surfactant thereby. To 10 parts by weight of polyoxyethylene alkyl ether under mixing at 80° C., 1.2% by weight of polyethylene glycol, palmitic acid (LUNAC P-95, manufactured by Kao Corporation) corresponding to 0.7% by weight of sodium palmitate, a precursor of an alkylbenzenesulfonic acid (NEOPELEX GS, manufactured by Kao Corporation) corresponding to 12 parts by weight of a sodium alkylbenzenesulfonate, and an aqueous sodium hydroxide as a neutralizing agent were added, thereby preparing a hydrated surfactant composition having the composition shown in Table 18. Next, 50 parts by weight of the above base particles were supplied into a Lodige Mixer (manufactured by Matsuzaka Giken Co., Ltd.; capacity: 20 L; equipped with a jacket), and the agitations of a main shaft (150 rpm) and a chopper (4000 rpm) were started. Incidentally, hot water at 80° C. was allowed to flow through the jacket at 10 L/minute. The above hydrated surfactant composition was supplied into the above mixer in 2 minutes, and thereafter the resulting mixture was agitated for 4 minutes. Subsequently, 10 parts by weight of a crystalline silicate and 10 parts by weight of zeolite were added to the mixture, and a 2-minute surface-coating operation was carried out, thereby giving each group of Detergent Particles 34 and 35. Further, 2 parts by weight of zeolite and 1% by weight of an enzyme granule were added, to give a granular detergent composition. The composition and the properties of the resulting detergent compositions are shown in Table 18. The detergent composition prepared using Particles for Supporting Surfactant 34 of Example 22 showed satisfactory values for the properties. On the other hand, in the case where Particles for Supporting Surfactant 35 of Comparative Example 13 were used, Particles for Supporting Surfactant 35 did not sufficiently support the surfactant composition within the time of the above operation and became aggregated, so that the values of the properties were deteriorated to an extent to be undeterminable.

TABLE 17

| | Ex. 22 | Comp. Ex. 13 |
|---|---|---|
| Composition % By Weight | | |
| Zeolite | 27.4 | 50.0 |
| Sodium Carbonate | 25.6 | 20.0 |
| Sodium Sulfate | 21.6 | 10.0 |
| Sodium Sulfite | 1.0 | 1.5 |
| Sodium Polyacrylate | 13.0 | 9.0 |
| Fluorescent Dye | 0.4 | 0.5 |
| Sodium Chloride | 8.0 | 0.0 |
| Sodium Alkylbenzenesulfonate | 0.0 | 4.0 |
| Water | 3.0 | 5.0 |
| TOTAL | 100.0 | 100.0 |
| Operation | | |
| Post-Addition of Microcrystal-Precipitating Agent Concentration Operation | ○ | |
| Increased Amount of Undissolved Salt [%] | | |
| Slurry Pulverization | | |
| Slurry | | |
| Water Content of Slurry [%] | 53 | 50 |
| Temperature of Slurry [° C.] | 50 | 58 |
| Increased Amount of Undissolved Salt [%] | 21.5 | — |
| Particle Properties | | |
| Average Particle Size [μm] | 246 | 225 |
| Bulk Density [g/L] | 510 | 620 |
| Particle Strength [MPa] | 40 | 25 |
| Cave-In Granule Ratio [%] | 91 | 0 |
| Average Diameter of Cave-In Hole [%] | 17 | — |
| Average Depth of Cave-In Hole [%] | 55 | — |
| Supporting Capacity [mL/g] | 0.60 | 0.52 |
| Absorbency [mL/g] | 0.45 | 0.10 |
| Mode Diameter of Microporous Capacity Distribution [μm] | 0.73 | 1.60 |
| 0.01–3 μm [mL/g] | 0.48 | 0.28 |

TABLE 18

| | Ex. 22 | Comp. Ex. 13 |
|---|---|---|
| Composition of Detergent Parts by Weight | | |
| Particles for Supporting Surfactant 34 | 50 | |
| Particles for Supporting Surfactant 35 | | 50 |
| Surfactants | 27 | 27 |
| (Sodium Alkylbenzenesulfonate) | (12) | (12) |
| (Polyoxyethylene Alkyl Ether) | (10) | (10) |
| (Sodium Palmitate) | (0.7) | (0.7) |
| (Polyethylene Glycol) | (1.2) | (1.2) |
| (Water) | (3.1) | (3.1) |
| Zeolite | 12 | 12 |
| Crystalline Silicate | 10 | 10 |
| Enzyme Granule | 1 | 1 |
| Properties | | |
| Average Particle Size [μm] | 275 | Undeterminable |
| Bulk Density [g/L] | 745 | Undeterminable |
| Flowability [s] | 6.2 | Undeterminable |
| Bleed-out Property | 1 | — |

INDUSTRIAL APPLICABILITY

According to the present invention, there can be obtained particles for supporting a surfactant having excellent supporting ability (supporting capacity/supporting strength) of the liquid surfactant composition, and particles for supporting a surfactant having excellent absorbency (supporting rate) of the liquid surfactant composition. Further, by supporting the liquid surfactant composition to the particles for supporting a surfactant, detergent particles having excellent detergency performance, quality and the like can be efficiently obtained.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Particles for supporting a surfactant obtainable by spray-drying a preparation liquid comprising a water-soluble polymer and a water-soluble salt, wherein the particles for supporting a surfactant have a mode diameter of the microporous capacity distribution as determined by mercury porosimeter of 1.5 μm or less, a microporous capacity of 0.3 mL/g or more for one having a micropore diameter of from 0.01 to 3.0 μm, and a particle strength of from 15 to 100

Mpa; and wherein the water-soluble polymer has a content of from 5 to 30% by weight.

2. The particles for supporting a surfactant according to claim 1, further comprising a water-insoluble substance, provided that amorphous silicate is not substantially contained.

3. The particles for supporting a surfactant according to claim 1, obtainable by spray-drying the preparation liquid which is obtainable by a process comprising preparing a first preparation liquid comprising a solution or slurry comprising a water-soluble polymer and a water-soluble salt, and subsequently subjecting the first preparation liquid to a treatment of increasing a number of water-soluble salt particles, thereby preparing a second preparation liquid having an increased number of water-soluble salt particles, as compared to the number of water-soluble salt particles which are present in the first preparation liquid.

4. The particles for supporting a surfactant according to claim 1, wherein the treatment of increasing a number of water-soluble salt particles comprises one or more processes selected from the group consisting of (1) adding a microcrystal-precipitating agent to the first preparation liquid; (2) concentrating the first preparation liquid; (3) adjusting a temperature of the first preparation liquid so that the dissolved amount of the water-soluble salt is lowered; (4) subjecting water-soluble salt particles in the first preparation liquid to wet grinding; and (5) adding to the first preparation liquid fine water-soluble salt particles which may be the same as and/or different from the water-soluble salt in the first preparation liquid, under conditions that the fine water-soluble salt particles are capable of being present without substantially being dissolved in the first preparation liquid.

5. A process for preparing particles for supporting a surfactant comprising the steps of preparing a preparation liquid comprising a water-soluble polymer and a water-soluble salt, and spray drying the preparation liquid obtained thereby, wherein the step of preparing the preparation liquid comprises (a) preparing a first preparation liquid comprising a solution or slurry comprising a water-soluble polymer and a water-soluble salt, and (b) subjecting the first preparation liquid to a treatment of increasing a number of water-soluble salt particles, thereby preparing a second preparation liquid having an increased number of water-soluble salt particles, as compared to the number of water-soluble salt particles which are present in the first preparation liquid, wherein the treatment of increasing a number of water-soluble salt particles comprises precipitating a water-soluble salt dissolved in the first preparation liquid by adding a microcrystal-precipitating agent to the first preparation liquid, wherein the microcrystal precipitating agent is a halogenated compound of an alkali metal and/or alkaline earth metal.

6. A process for preparing particles for supporting a surfactant comprising the steps of preparing a preparation liquid comprising a water-soluble polymer and a water-soluble salt, and spray drying the preparation liquid obtained thereby, wherein the step of preparing the preparation liquid comprises (a) preparing a first preparation liquid comprising a solution or slurry comprising a water-soluble polymer and a water-soluble salt, and (b) subjecting the first preparation liquid to a treatment of increasing a number of water-soluble salt particles, thereby preparing a second preparation liquid having an increased number of water-soluble salt particles, as compared to the number of water-soluble salt particles which are present in the first preparation liquid, wherein the treatment of increasing a number of water-soluble salt particles comprises subjecting water-soluble salt particles in the first preparation liquid to wet grinding.

7. A process for preparing particles for supporting a surfactant comprising the steps of preparing a preparation liquid comprising a water-soluble polymer and a water-soluble salt, and spray drying the preparation liquid obtained thereby, wherein the step of preparing the preparation liquid comprises (a) preparing a first preparation liquid comprising a solution or slurry comprising a water-soluble polymer and a water-soluble salt, and (b) subjecting the first preparation liquid to a treatment of increasing a number of water-soluble salt particles, thereby preparing a second preparation liquid having an increased number of water-soluble salt particles, as compared to the number of water-soluble salt particles which are present in the first preparation liquid, wherein the treatment of increasing a number of water-soluble salt particles comprises adding to the first preparation liquid fine water-soluble salt particles which may be the same as and/or different from the water-soluble salt in the first preparation liquid, under conditions that the fine water-soluble salt particles are capable of being present without substantially being dissolved in the first preparation liquid, and wherein said fine water-soluble salt particles have an average particle size of 40 $\mu$m or less.

8. A process for preparing particles for supporting a surfactant comprising the steps of preparing a preparation liquid comprising a water-soluble polymer and a water-soluble salt, and spray drying the preparation liquid obtained thereby, wherein the step of preparing the preparation liquid comprises (a) preparing a first preparation liquid comprising a solution or slurry comprising a water-soluble polymer and a water-soluble salt, and (b) subjecting the first preparation liquid to a treatment of increasing a number of water-soluble salt particles, thereby preparing a second preparation liquid having an increased number of water-soluble salt particles, as compared to the number of water-soluble salt particles which are present in the first preparation liquid, wherein the treatment of increasing a number of water-soluble salt particles comprises process (A) and one or more of the processes selected from the group consisting of (B)–(E):

(A) a process comprising precipitating a water-soluble salt dissolved in the first preparation liquid by adding a microcrystal-precipitating agent to the first preparation liquid, wherein the microcrystal-precipitating agent is a halogenated compound of an alkali metal and/or an alkaline earth metal;

(B) a process comprising precipitating a water-soluble salt dissolved in the first preparation liquid by concentrating the first preparation liquid;

(C) a process comprising precipitating a water-soluble salt dissolved in the first preparation liquid by adjusting a temperature of the first preparation liquid so that a dissolved amount of the water-soluble salt is lowered;

(D) a process comprising subjecting water-soluble salt particles in the first preparation liquid to wet grinding; and (E) a process comprising adding to the first preparation liquid fine water-soluble salt particles which may be the same as and/or different from the water-soluble salt in the first preparation liquid, under conditions that the fine water-soluble salt particles are capable of being present without substantially being dissolved in the first preparation liquid.

9. The process according to any one of claims 5, 6 and 8, wherein the water-soluble salt comprises sodium carbonate and/or sodium sulfate.

10. The process according to any one of claims 5, 6 and 8, wherein the water-soluble polymer is one or more compounds selected from the group consisting of acrylic acid homopolymers, acrylic acid-maleic acid copolymers and salts thereof.

11. A process for preparing detergent particles having a bulk density of from 500 to 1000 g/L, comprising the step of mixing from 10 to 100 parts by weight of a surfactant composition with 100 parts by weight of particles for supporting a surfactant obtainable by the process of any one of claims 5, 6 and 8.

12. The process according to claim 11, further comprising adding a surface coating agent.

13. Detergent particles having a bulk density of from 500 to 1000 g/L, wherein from 10 to 100 parts by weight of a surfactant composition is supported by 100 parts by weight of particles for supporting a surfactant obtainable by the process of any one of claims 5, 6 and 8 wherein the particles for supporting a surfactant have a mode diameter of the microporous capacity distribution as determined by mercury porosimeter of 1.5 $\mu$m or less.

14. The detergent particles according to claim 13, wherein a surface coating agent is further added thereon.

15. A detergent composition comprising the detergent particles of claim 13.

* * * * *